US006610466B2

(12) United States Patent
Sakurada et al.

(10) Patent No.: US 6,610,466 B2
(45) Date of Patent: Aug. 26, 2003

(54) SILVER HALIDE PHOTOGRAPHIC LIGHTSENSITIVE MATERIAL

(75) Inventors: Masami Sakurada, Minami-Ashigara (JP); Kiyoshi Morimoto, Minami-Ashigara (JP); Fumitaka Ueda, Minami-Ashigara (JP); Toru Yamada, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 39 days.

(21) Appl. No.: 09/939,843

(22) Filed: Aug. 28, 2001

(65) Prior Publication Data

US 2002/0177087 A1 Nov. 28, 2002

(30) Foreign Application Priority Data

Aug. 28, 2000 (JP) ..... 2000-258159
Jun. 26, 2001 (JP) ..... 2001-193596

(51) Int. Cl.[7] ..... G03C 1/46

(52) U.S. Cl. ..... 430/505; 430/502; 430/503; 430/567; 430/546; 430/631; 430/556; 430/557

(58) Field of Search ..... 430/505, 502, 430/503, 567, 546, 631, 556, 557

(56) References Cited

U.S. PATENT DOCUMENTS 3,622,316 A 11/1971 Bird et al.
5,744,292 A * 4/1998 Yoneyama ..... 430/510
6,048,681 A * 4/2000 Suzumoto et al. ..... 430/567
6,117,629 A * 9/2000 Yamashita et al. ..... 430/570
6,165,703 A 12/2000 Parton et al.
6,180,332 B1 1/2001 Yamashita et al.
6,333,146 B1 * 12/2001 Kobayashi et al. ..... 430/570
6,387,610 B1 * 5/2002 Yamashita et al. ..... 430/567
6,465,166 B1 * 10/2002 Kobayashi et al. ..... 430/581

FOREIGN PATENT DOCUMENTS

EP 0887700 A1 12/1998

* cited by examiner

*Primary Examiner*—Geraldine Letscher
(74) *Attorney, Agent, or Firm*—Birch, Stewart, Kolasch & Birch, LLP

(57) ABSTRACT

A silver halide photographic lightsensitive material comprising at least one silver halide photographic emulsion layer containing a silver halide photographic emulsion prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion, when agitated at 40° C. for 30 min, exhibits a variation of absorption spectrum integrated intensity ranging from 400 nm to 700 nm of 10% or less.

20 Claims, No Drawings

SILVER HALIDE PHOTOGRAPHIC LIGHTSENSITIVE MATERIAL

CROSS-REFERENCE TO RELATED APPLICATIONS

This application is based upon and claims the benefit of priority from the prior Japanese Patent Applications No. 2000-258159, filed Aug. 28, 2000; and No. 2001-193596, filed Jun. 26, 2001, the entire contents of both of which are incorporated herein by reference.

BACKGROUND OF THE INVENTION

1. Field of the Invention

The present invention relates to a photographic lightsensitive material including a spectrally sensitized silver halide photographic emulsion. More particularly, the present invention relates to a photographic lightsensitive material including a silver halide photographic emulsion which exhibits increased light absorption and light absorption intensity and which has sensitizing dyes adsorbed in multilayer form stably even in the presence of an organic solvent.

2. Description of the Related Art

Intensive efforts have been exerted to enhance the sensitivity of silver halide photographic lightsensitive materials. In silver halide photographic emulsions, light sensitivity is obtained as a result of absorption of light incident on the lightsensitive material by a sensitizing dye adsorbed on the surface of silver halide grains and transfer of thus absorbed light energy to silver halide grains. Accordingly, in the spectral sensitization of silver halides, it is contemplated that increasing the light absorption per unit grain surface area of silver halide grains would enable increasing the light energy transferred to silver halides to thereby accomplish enhancement of the spectral sensitivity of silver halide grains. The increasing of the light absorption in the surface of silver halide grains can be accomplished by increasing the adsorption amount of spectral sensitizing dye per unit grain surface area.

However, there is a limit in the adsorption amount of sensitizing dye on the surface of silver halide grains, and it is difficult to adsorb dye chromophores in an amount greater than monolayer saturated adsorption (namely, one-layer adsorption). Therefore, the current situation is that, in the spectral sensitization region, the absorption of incident photons by individual silver halide grains is still low.

Proposals for resolving this matter have been made, which are as follows.

P. B. Gilman, Jr. et al., in Photographic Science and Engineering, vol. 20, no. 3, page 97 (1976), caused the first layer to adsorb a cationic dye and further caused the second layer to adsorb an anionic dye with the use of electrostatic force.

G. B. Bird et al., in U.S. Pat. No. 3,622,316, caused silver halides to adsorb a plurality of dyes in multilayer form and effected sensitization with the contribution of transfer of excitation energy of the Forster type.

Sugimoto et al., in Jpn. Pat. Appln. KOKAI Publication No. (hereinafter referred to as JP-A-) 63-138341 and JP-A-64-84244, effected spectral sensitization by the energy transfer from luminescent dyes.

R. Steiger et al., in Photographic Science and Engineering, vol. 27, no. 2, page 59 (1983), tried spectral sensitization by the energy transfer from gelatin-substituted cyanine dyes.

Ikegawa et al., in JP-A-61-251842, effected spectral sensitization by the energy transfer from cyclodextrin-substituted dyes.

However, in these proposed methods, the extent of multilayer adsorption of sensitizing dyes on the surface of silver halide grains is actually unsatisfactory with the result that the effect of sensitivity enhancement is extremely poor. Therefore, attempts to realize a substantially effective multilayer adsorption by strengthening the interaction between dye molecules have been made.

It is disclosed in EP No. 838719A2 that increasing of the hydrophobicity of dye molecules would lead to enhancement of the interaction between dye molecules, which is effective in the formation of multilayer adsorption. However, with respect to the thus formed multilayer adsorption, it has become apparent that the state of multilayer adsorption is unstable when an organic solvent is present in the emulsion, especially when a high-boiling organic solvent such as an emulsified substance which is indispensable in the silver halide photographic lightsensitive material is present in the emulsion. Hence, it is an urgent need to develop a technology for stabilizing the state of dye multilayer adsorption.

Parton et al. (JP-A-2000-89406) describe that the stability of multilayer adsorption against external factors such as a dispersion of color forming coupler can be enhanced only when dye layers of the dye multilayer adsorption are bonded with each other through two or more noncovalent attractive forces. However, this stabilization effect is not so high, and, when employed in practicable silver halide photographic lightsensitive materials containing a high-boiling organic solvent, it is difficult to realize such a stability as can endure practical use. Furthermore, substituents are limited, so that the variety of available dyes is limited.

In contrast, it is known that a multilayer adsorption based on a combination of cationic dyes is effective in the enhancements of light absorption and sensitivity. However, the stability of multilayer adsorption is still poor against external factors such as a dispersion of color forming coupler.

The development processing time of color negative lightsensitive materials has been shortened by Kodak processing C-41 introduced in 1972. The wet processing time, not including any drying step, required by the processing is 17 min 20 sec. The processor CN-16FA introduced in the mini-lab market by Fuji Photo Film Co., Ltd. in recent years has enabled shortening the wet processing time to 8 min 15 sec. However, the current situation is that the shop processing and finishing, even speediest in view of the contemporary processing time level, still requires about 30 min to thereby compel a majority of users to make two visits to the photograph shop. Thus, further shortening of development processing time is desired in order to meet the demand for one visit to photograph shop from users.

Reduction of development time by raising the developing temperature of color developer has been investigated in order to attain shortening of color development time. However, the intended shortening is not easy because of the occurrence of sensitivity lowering and because of the increase of photographic property change due to processing variation. Improving the ratio of sensitivity/graininess by effecting a short-time processing is disclosed in JP-A-62-192740. However, the demanded level has not yet been attained thereby. Therefore, there is still a strong demand for improvement of the ratio of sensitivity/graininess and for suppression of the photographic property change due to processing variation.

BRIEF SUMMARY OF THE INVENTION

It is an object of the present invention to provide a photographic lightsensitive material including a silver halide photographic emulsion which is highly sensitive and wherein sensitizing dyes are contained in multilayer form stably even in the presence of an organic solvent.

The inventors have made extensive and intensive studies with a view toward attaining the above object. As a result, it has been found that the stability of dye multilayer adsorption can be dramatically enhanced by the use of specified emulsified substance to thereby attain an effective enhancement of spectral sensitivity even in practical silver halide photographic lightsensitive materials wherein a high-boiling organic solvent is present.

Specifically, although, with respect to highly hydrophobic dyes, it is contemplated that the state of multilayer adsorption is unstable because of their high solubility in organic solvents, there is no report regarding the interrelationship between properties of high-boiling organic solvents and stability of multilayer adsorption, and there is no knowledge as to the interrelationship between properties of surfactants required for dispersing high-boiling organic solvents, or types of color forming couplers dissolved in high-boiling organic solvents, and stability of multilayer adsorption. Noting these, studies have been conducted. As a result, the present invention characterized by the following constitutions has been completed.

(1) A silver halide photographic lightsensitive material comprising at least one silver halide photographic emulsion layer containing a silver halide photographic emulsion prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion, when agitated at 40° C. for 30 min, exhibits a variation of absorption spectrum integrated intensity ranging from 400 nm to 700 nm of 10% or less.

(2) A silver halide photographic lightsensitive material comprising at least one silver halide photographic emulsion layer prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion layer, when the silver halide photographic lightsensitive material is aged at 60° C. in 30% humidity for 3 days, exhibits a variation of absorption spectrum integrated intensity ranging from 400 nm to 700 nm of 10% or less.

(3) A silver halide photographic lightsensitive material comprising, on one side of a support, photographic constituting element layers composed of a unit red-sensitive layer, a unit green-sensitive layer, a unit blue-sensitive layer and a nonlightsensitive layer, wherein each of the unit red-sensitive layer, unit green-sensitive layer and unit blue-sensitive layer comprises two or more layers differing in speed, and wherein, in at least one of the unit red-sensitive layer, unit green-sensitive layer and unit blue-sensitive layer, at least one high-speed-side emulsion layer contains the silver halide photographic emulsion, prepared by mixing the dispersion of silver halide grains with the eulsified dispersion, according to item (1) or (2), and a low-speed-side emulsion layer adjacent to the high-speed-side emulsion layer exhibits a speed of 60% or more based on that of the high-speed-side emulsion layer.

(4) A silver halide photographic lightsensitive material comprising, on one side of a support, photographic constituting element layers composed of a unit red-sensitive layer, a unit green-sensitive layer, a unit blue-sensitive layer and a nonlightsensitive layer, wherein at least one of the photographic constituting element layers contains the silver halide photographic emulsion, prepared by mixing the dispersion of silver halide grains with the emulsified dispersion, according to item (1) or (2), and whose total silver content is in the range of 0.1 to 7.0 g/m$^2$.

(5) The silver halide photographic lightsensitive material according to any of items (1) to (4), wherein the emulsified dispersion contains a surfactant whose critical micell concentration is $4.0\times10^{-3}$ mol/L or less, the surfactant content being 0.01% by mass or more based on the silver halide photographic emulsion layer.

(6) The silver halide photographic lightsensitive material according to any of items (1) to (5), wherein the emulsified dispersion contains a high-boiling organic solvent whose dielectric constant is 7.0 or less, the content of the high-boiling organic solvent being in the range of 0.05 to 10% by mass based on the silver halide photographic emulsion layer.

(7) The silver halide photographic lightsensitive material according to any of items (1) to (6), wherein the emulsified dispersion contains a compound of the formula 1:

1

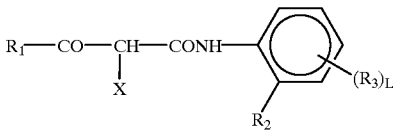

where $R_1$ represents a tertiary alkyl group or an aryl group; $R_2$ represents a hydrogen atom, a halogen atom (F, Cl, Br or I), an alkoxy group, an aryloxy group, an alkyl group or a dialkylamino group; $R_3$ represents a group capable of effecting a substitution on a benzene ring; X represents a hydrogen atom or a heterocycle capable of being eliminated by a coupling reaction with an oxidation product of aromatic primary amine developing agent and capable of bonding at a nitrogen atom with a coupling active site; and L is an integer of 0 to 4, provided that, when L is two or more, two or more $R_3$ groups may be identical with or different from each other.

(8) The silver halide photographic lightsensitive material according to any of items (1) to (7), wherein sensitizing dyes are adsorbed in multilayer form on surfaces of the silver halide grains.

(9) The silver halide photographic lightsensitive material according to item (8), wherein, among the sensitizing dyes adsorbed in multilayer form, a second-layer dye has an excitation energy which is transferred to a first-layer dye at an efficiency of 10% or more.

(10) The silver halide photographic lightsensitive material according to item (8), wherein, among the sensitizing dyes adsorbed in multilayer form, both a first-layer dye and a second-layer dye exhibit a J-band absorption.

(11) The silver halide photographic lightsensitive material according to item (9), wherein both the first-layer dye and the second-layer dye exhibit a J-band absorption.

With respect to spectral variation, it is preferred that the silver halide photographic emulsion, when agitated at 40° C. for 30 min, exhibit a variation of absorption spectrum integrated intensity ranging from 400 nm to 700 nm of 10% or less, or a variation of absorbance maximum of 10% or less. Also, it is preferred that the silver halide photographic emulsion layer, when the silver halide photographic light-sensitive material is aged at 60° C. in 30% humidity for 3 days, exhibit a variation of absorption spectrum integrated intensity ranging from 400 nm to 700 nm of 10% or less, or a variation of absorbance maximum of 10% or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

The present invention relates to a silver halide photographic lightsensitive material containing silver halide grains sensitized by dyes, particularly a high-speed silver halide photographic lightsensitive material containing a silver halide photographic emulsion which has sensitizing dyes adsorbed in multilayer form stably even in the presence of an organic solvent.

In the present invention, the light absorption intensity refers to a light absorption area intensity per grain surface area realized by a sensitizing dye. It is defined as an integral value, over wave number ($cm^{-1}$), of optical density Log (Io/(Io-I)), wherein Io represents the quantity of light incident on each unit surface area of grains and I represents the quantity of light absorbed by the sensitizing dye on the surface. The range of integration is from 5000 $cm^{-1}$ to 35,000 $cm^{-1}$.

The silver halide photographic emulsion of the present invention (hereinafter also simply referred to as "emulsion of the present invention") is prepared by mixing a dispersion of silver halide grains, the dispersion of silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion. The silver halide photographic lightsensitive material of the present invention, in its one embodiment, includes at least one silver halide photographic emulsion layer containing this emulsion. In the present invention, the emulsion of the present invention preferably contains the above silver halide grains in a ratio of ½ or more to the total projected area of silver halide grains. With respect to grains whose spectral absorption maximum wavelength is 500 nm or more, the light absorption intensity thereof is preferably 150 or more, more preferably 170 or more, and most preferably 200 or more. With respect to grains whose spectral absorption maximum wavelength is less than 500 nm, the light absorption intensity thereof is preferably 90 or more, more preferably 100 or more, and most preferably 120 or more. The light absorption intensity thereof, although there is no particular upper limit, is preferably 2000 or less, more preferably 1000 or less, and most preferably 500 or less.

With respect to grains whose spectral absorption maximum wavelength is less than 500 nm, it is preferred that the spectral absorption maximum wavelength be 350 nm or more.

As one method of measuring the light absorption intensity, there can be mentioned the method of using a microscopic spectrophotometer. The microscopic spectrophotometer is a device capable of measuring an absorption spectrum of minute area, whereby a transmission spectrum of each grain can be measured. With respect to the measurement of an absorption spectrum of each grain by the microscopic spectro-photometry, reference can be made to the report of Yamashita et al. (page 15 of Abstracts of Papers presented before the 1996 Annual Meeting of the Society of Photographic Science and Technology of Japan). The absorption intensity per grain can be determined from the absorption spectrum. Because the light transmitted through grains is absorbed by two surfaces, i.e., upper surface and lower surface, however, the absorption intensity per grain surface area can be determined as ½ of the absorption intensity per grain obtained in the above manner. At that time, although the interval for absorption spectrum integration is from 5000 $cm^{-1}$ to 35,000 $cm^{-1}$ in view of the definition of light absorption intensity, experimentally, it is satisfactory to integrate over an interval including about 500 $cm^{-1}$ after and before the interval of absorption by sensitizing dye.

The light absorption intensity is a value unequivocally determined from the oscillator strength and number of adsorbed molecules per area with respect to the sensitizing dye. If, with respect to the sensitizing dye, the oscillator strength, dye adsorption amount and grain surface area are measured, these can be converted into the light absorption intensity.

The oscillator strength of sensitizing dye can be experimentally determined as a value proportional to the absorption area intensity (optical density×$cm^{-1}$ of sensitizing dye solution, so that the light absorption intensity can be calculated within an error of about 10% by the formula:

$$0.156 \times A \times B/C$$

wherein A represents the absorption area intensity per M of dye (optical density×$cm^{-1}$), B represents the adsorption amount of sensitizing dye (mol/molAg) and C represents the grain surface area ($m^2$/molAg).

Calculation of the light absorption intensity through this formula gives substantially the same value as the integral value, over wave number ($cm^{-1}$), of light absorption intensity (Log (Io/(Io-I))) measured in accordance with the aforementioned definition.

For increasing the light absorption intensity, there can be employed any of the method of adsorbing more than one layer of dye chromophore on grain surfaces, the method of increasing the molecular extinction coefficient of dye and the method of decreasing a dye-occupied area. Of these, the method of adsorbing more than one layer of dye chromophore on grain surfaces is preferred.

The expression "adsorption of more than one layer of dye chromophore on grain surfaces" used herein means the presence of more than one layer of dye bound in the vicinity of silver halide grains. Thus, it is meant that dye present in a dispersion medium is not contained. Even if a dye chromophore is connected with a substance adsorbed on grain surfaces through a covalent bond, when the connecting group is so long that the dye chromophore is present in the dispersion medium, the effect of increasing the light absorption intensity is slight and hence it is not regarded as the more than one layer adsorption. Further, in the so-called multi-layer adsorption wherein more than one layer of dye chromophore is adsorbed on grain surfaces, it is required that a spectral sensitization be brought about by a dye not directly adsorbed on grain surfaces. For meeting this requirement, the transfer of excitation energy from the dye not directly adsorbed on silver halide to the dye directly adsorbed on grains is inevitable. Therefore, when the transfer of excitation energy must occur in more than 10 stages, the final transfer efficiency of excitation energy will unfavorably be low. As an example thereof, there can be mentioned such a case that, as experienced in the use of polymer dyes of, for example, JP-A-2-113239, most of dye chromophore is present in a dispersion medium, so that more than 10 stages are needed for the transfer of excitation energy.

In the present invention, the number of dye chromophores per dye molecule is preferably in the range of 1 to 3, more preferably 1 to 2.

The terminology "chromophore" used herein means an atomic group which is the main cause of molecular absorption bands as described on pages 985 and 986 of Physicochemical Dictionary (4th edition, published by Iwanami Shoten, Publishers in 1987), for example, any atomic group selected from among C═C, N═N and other atomic groups having unsaturated bonds.

Examples thereof include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye, an azamethine dye, a coumarin dye, an allylidene dye, an anthraquinone dye, a triphenylmethane dye, an azo dye, an azomethine dye, a spiro compound, a metallocene dye, a fluorenone dye, a fulgide dye, a perillene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperillene dye, a porphyrin dye, a chlorophyll dye, a phthalocyanine dye and a metal complex dye.

Of these, there can preferably be employed polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. More preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimally employed.

Details of these dyes are described in, for example, F. M. Harmer, "Heterocyclic Compounds-Cyanine Dyes and Related Compounds", John Wiley & Sons, New York, London, 1964 and D. M. Sturmer, "Heterocyclic Compounds-Special topics in heterocyclic chemistry", chapter 18, section 14, pages 482 to 515, John Wiley & Sons, New York, London, 1977. As general formulae for preferred dyes, there can be mentioned those given on pages 32 to 36 of U.S. Pat. No. 5,994,051 and pages 30 to 34 of U.S. Pat. No. 5,747,236. With respect to the general formulae for the cyanine dye, merocyanine dye and rhodacyanine dye, those shown in U.S. Pat. No. 5,340,694, columns 21 to 22, (XI), (XII) and (XIII), are preferred. In the formulae, the numbers n12, n15, n17 and n18 are not limited as long as each of these is an integer of 0 or greater (preferably, 4 or less).

The adsorption of a dye chromophore on silver halide grains is preferably carried out in at least 1.5 layers, more preferably at least 1.7 layers, and most preferably at least 2 layers. Although there is no particular upper limit, the number of layers is preferably 10 or less, more preferably 5 or less.

The expression "adsorption of more than one layer of chromophore on silver halide grain surfaces" used herein means that, as aforementioned, dyes bound in the vicinity of silver halide grains are present in the form of more than one layer. The expression more specifically means that the adsorption amount of dye chromophore per area is greater than a one-layer saturated coating amount, this one-layer saturated coating amount defined as the saturated adsorption amount per area attained by a dye which exhibits the smallest dye-occupied area on silver halide grain surfaces among the sensitizing dyes added to the emulsion. The number of adsorption layers means the adsorption amount evaluated on the basis of one-layer saturated coating amount. With respect to dyes having dye chromophores connected to each other by covalent bonds, the dye-occupied area of unconnected individual dyes can be employed as the basis.

The dye-occupied area can be determined from an adsorption isothermal line showing the relationship between isolated dye concentration and adsorbed dye amount, and a grain surface area. The adsorption isothermal line can be determined with reference to, for example, A. Herz et al. "Adsorption from Aqueous Solution", Advances in Chemistry Series, No. 17, page 173 (1968).

The adsorption amount of a sensitizing dye onto emulsion grains can be determined by two methods. The one method comprises centrifuging an emulsion having undergone a dye adsorption to thereby separate the emulsion into emulsion grains and a supernatant aqueous solution of gelatin, determining an unadsorbed dye concentration from the measurement of spectral absorption of the supernatant, and subtracting the same from the added dye amount to thereby determine the adsorbed dye amount. The other method comprises depositing emulsion grains, drying the same, dissolving a given mass of deposit in a 1:1 mixture of an aqueous solution of sodium thiosulfate and methanol, and effecting a spectral absorption measurement thereof to thereby determine the adsorbed dye amount. When a plurality of sensitizing dyes are employed, the absorption amount of each dye can be determined by high-performance liquid chromatography or other techniques. With respect to the method of determining the dye absorption amount by measuring the dye amount in a supernatant, reference can be made to, for example, W. West et al., Journal of Physical Chemistry, vol. 56, page 1054 (1952). However, even unadsorbed dye may be deposited when the addition amount of dye is large, so that it has been experienced that an accurate absorption amount is not always obtained by the method of measuring the dye concentration of the supernatant. On the other hand, in the method in which the absorption amount of dye is determined by dissolving deposited silver halide grains, the deposition velocity of emulsion grains is overwhelmingly faster, so that grains and deposited dye can easily be separated from each other. Thus, only the amount of dye adsorbed on grains can accurately be determined. Therefore, this method is most reliable as a means for determining the dye absorption amount.

The adsorption amount of photographically useful compounds on grains, although can be measured in the same manner as in the adsorption of sensitizing dyes, is preferably measured by the quantitative method based on high-performance liquid chromatography, rather than the quantitative method based on spectral absorption, from the viewpoint that the absorption in visible light region is weak.

As one method of measuring the surface area of silver halide grains, there can be employed the method wherein a transmission electron micrograph is taken according to the replica method and wherein the configuration and size of each individual grain are measured and calculated. In this method, the thickness of tabular grains is calculated from the length of shadow of the replica. With respect to the method of taking a transmission electron micrograph, reference can be made to, for example, Denshi Kenbikyo Shiryo Gijutsu Shu (Electron Microscope Specimen Technique Collection) edited by the Kanto Branch of the Society of Electron Microscope of Japan and published by Seibundo Shinkosha in 1970 and P. B. Hirsch, "Electron Microscopy of Thin Crystals", Buttwrworths, London (1965).

As the other method, reference can be made to, for example, A. M. Kragin et al., Journal of Photographic Science, vol. 14, page 185 (1966), J. F. Paddy, Transactions of the Faraday Society, vol., 60, page 1325 (1964), S. Boyer et al., Journal de Chimie Physique et de Physicochimie biologique, vol., 63, page 1123 (1963), W. West et al., Journal of Physical Chemistry, vol., 56, page 1054 (1952), and E Klein et al., "Scientific Photography", International Coloquium, edited by H. Sauvenier, Liege (1959).

Experimentally, each of the dye-occupied area can be determined from the above methods. Because the molecule-occupied area of sensitizing dye is around $80\times10^{-20}$ $m^2$, however, the number of adsorption layers can be briefly estimated by determining the dye-occupied area of all dyes as $80\times10^{-20}$ $m^2$.

When a multi-layer of dye chromophore is adsorbed on silver halide grains in the present invention, although the reduction potentials and oxidation potentials of the dye chromophore of the first layer, namely the layer directly adsorbed on silver halide grains, vs. the dye chromophore of the second et seq. layers are not particularly limited, it is preferred that the reduction potential of the dye chromophore of the first layer be noble to the remainder of the reduction potential of the dye chromophore of the second et seq. layers minus 0.2V.

Although the reduction potential and oxidation potential can be measured by various methods, the measurement is preferably carried out by the use of phase discrimination second harmonic a.c. polarography, whereby accurate values can be obtained. The method of measuring potentials by the use of phase discrimination second harmonic a.c. polarography is described in Journal of Imaging Science, vol. 30, page 27 (1986).

The dye chromophore of the second et seq. layers preferably consists of a luminescent dye. With respect to the type of luminescent dye, those having the skeletal structure of dye for use in dye laser are preferred. The luminescence yield of second-layer dye, when present alone in gelatin, is 0.1 or more, preferably 0.3 or more, more preferably 0.5 or more, and most preferably 0.7 or more. The luminescence of second-layer dye per se (probability of second-layer dye being excited followed by radiation deactivation thereof), when present as a second-layer dye as a result of multilayer adsorption, is 0.5 or less, preferably 0.3 or less, more preferably 0.1 or less, and most preferably 0.05 or less. These are edited in, for example, Mitsuo Maeda, Laser Kenkyu (Laser Research), vol. 8, pp. 694, 803 and 958 (1980) and ditto, vol. 9, page 85 (1981), and F. Sehaefer, "Dye Lasers", Springer (1973).

Moreover, the absorption maximum wavelength of dye chromophore of the first layer in the silver halide photographic lightsensitive material is preferably greater than that of dye chromophore of the second et seq. layers. Further, preferably, the light emission of dye chromophore of the second et seq. layers and the absorption of dye chromophore of the first layer overlap each other. Also, it is preferred that the dye chromophore of the first layer form a J-association product. Still further, for exhibiting absorption and spectral sensitivity within a desired wavelength range, it is preferred that the dye chromophore of the second et seq. layers also form a J-association product.

In the present invention, it is preferred that the excitation energy of second-layer dye, among the sensitizing dyes adsorbed on silver halide grain surfaces, be transferred to the first-layer dye at an efficiency of 10% or more.

In the present invention, the expression "the excitation energy of second-layer dye is transferred to the first-layer dye at an efficiency of 10% or more" means that the ratio of increase of the speed of the emulsion having two-layer adsorption over the speed of the emulsion having adsorption of a first-layer dye only is 10% or more based on the ratio of increase of the light absorption intensity of the emulsion having two-layer adsorption over the light absorption intensity of the emulsion having adsorption of a first-layer dye only. This efficiency is a measure of the effect of how much the light absorption intensity increased by the lightsensitive material of the present invention contributes to speed increase.

The efficiency of transfer of the excitation energy of second-layer dye to first-layer dye is more preferably 30% or more, still more preferably 60% or more, and most preferably 90% or more. The energy transfer efficiency from second-layer dye to first-layer dye can be determined as [spectral sensitization ratio at the excitation of second-layer dye]/[spectral sensitization ratio at the excitation of first-layer dye].

The meanings of terminologies employed in the present invention are set forth below.

Dye-occupied area: Area occupied by each molecule of dye, which can experimentally be determined from adsorption isothermal lines. With respect to dyes having dye chromophores connected to each other by covalent bonds, the dye-occupied area of unconnected individual dyes can be employed as the basis. In brief, $80\times10^{-20}$ $m^2$.

One-layer saturated coating amount: Dye adsorption amount per grain surface area at one-layer saturated coating, which is the inverse number of the smallest dye-occupied area exhibited by added dyes.

Multi-layer adsorption: In such a state that the adsorption amount of dye chromophore per grain surface area is greater than the one-layer saturated coating amount.

Number of adsorption layers: Adsorption amount of dye chromophore per grain surface area on the basis of one-layer saturated coating amount.

In the present invention, it is preferred that the intergranular distribution of light absorption intensity be narrow. The intergranular distribution of light absorption intensity can be expressed as a variation coefficient of the light absorption intensities of 100 or more grains measured at random by the use of microspectroscopy. The variation coefficient can be calculated by the formula: 100×standard deviation/average (%). Because the light absorption intensity is a value which is proportional to the adsorption amount of dye, the intergranular distribution of light absorption intensity can be expressed as the intergranular distribution of dye adsorption amount. The variation coefficient of intergranular distribution of light absorption intensity is preferably 60% or less, more preferably 30% or less, and most preferably 10% or less.

The variation coefficient of intergranular distribution of interval between the smallest wavelength and the largest wavelength each exhibiting 50% of the maximum Amax of absorption of sensitizing dye is preferably 30% or less, more preferably 10% or less, and most preferably 5% or less.

With respect to the absorption maximum wavelength of sensitizing dye of each individual grain, preferably 70% or more, more preferably 90% or more, in terms of projected area of grains have the absorption maximum within a wavelength range of 10 nm or less. It is more desirable that, with respect to the absorption maximum wavelength of sensitizing dye of each individual grain, preferably 50% or more, more preferably 70% or more, and most preferably 90% or more, in terms of projected area of grains have the absorption maximum within a wavelength range of 5 nm or less.

Although it is known that the intergranular distribution of light absorption intensity (adsorption amount of dye) is uniformized in accordance with an increase of dye adsorption amount when adsorption sites are limited to silver halide grain surfaces, it has been found that, in the multilayer adsorption of the present invention, there is no limit in adsorption sites if the adsorption in the form of two or more layers is possible, and that an intergranular distribution is very likely to occur, for example, some grains having monolayer adsorption while other grains having three-layer adsorption. As a result of an analysis, it has become apparent that, when the ratio of the interactive energy between second-layer dyes to the total adsorption energy of second-layer dyes is increased (the ratio of the interactive energy between first-layer and second-layer dye molecules decreased relatively), an intergranular nonuniformity of dye adsorption amount of a multilayer adsorption system is likely to occur. The interactive energy between first-layer and second-layer dye molecules is preferably 20% or more, more preferably 40% or more, based on the total adsorption energy of second-layer dyes.

In the multilayer adsorption of the present invention, the total adsorption energy is 5 kcal/mol or more, preferably 10 kcal/mol or more, and more preferably 15 kcal/mol or more.

For strengthening the interaction between first-layer dye and second-layer dye, it is preferred to utilize the electrostatic interaction, Van der Waals interaction, hydrogen bond, coordinate bond and composite interactive force thereof between first-layer and second-layer dye molecules. Although it is preferred that the main interaction between second-layer dyes be the Van der Waals interaction between dye chromophores, it is also preferred to utilize the electrostatic interaction, Van der Waals interaction, hydrogen bond, coordinate bond and composite interactive force thereof as long as the above preferred relationship is satisfied.

The ratio of the interactive energy between first-layer and second-layer dye molecules to the total adsorption energy of second-layer dyes, although actually determining it is difficult, can be presumed by the use of the method of computer chemistry such as computation of molecular force fields.

Experimentally, the ratio can be estimated by measuring the cohesive energies between second-layer dye molecules and between first-layer dye and second-layer dye molecules and introducing the measured cohesive energies in the formula: 100×[cohesive energy between first-layer dye and second-layer dye molecules]/[cohesive energy between second-layer dye molecules+cohesive energy between first-layer dye and second-layer dye molecules]. The cohesive energy can be determined by the use of, for example, the method of Matsubara, Tanaka et al. (Journal of the Society of Photographic Science and Technology of Japan, vol. 52, page 395 (1989)).

With respect to the emulsion containing silver halide photographic emulsion grains wherein, when the spectral absorption maximum wavelength is less than 500 nm, the light absorption intensity is 60 or more, while when the spectral absorption maximum wavelength is 500 nm or more, the light absorption intensity is 100 or more, the interval between the smallest wavelength and the largest wavelength each exhibiting 50% of spectral sensitivity maximum Smax and maximum of spectral absorption factor Amax by sensitizing dye is preferably 120 nm or less, more preferably 100 nm or less.

The interval between the smallest wavelength and the largest wavelength each exhibiting 80% of spectral sensitivity maximum Smax and maximum of spectral absorption factor Amax is preferably in the range of 20 nm to 100 nm, more preferably to 80 nm, and most preferably to 50 nm.

The interval between the smallest wavelength and the largest wavelength each exhibiting 20% of spectral sensitivity maximum Smax and maximum of spectral absorption factor Amax is preferably 180 nm or less, more preferably 150 nm or less, still more preferably 120 nm or less, and most preferably 100 nm or less.

The largest wavelength exhibiting a spectral absorption factor equal to 50% of spectral sensitivity maximum Smax or maximum of spectral absorption factor Amax is preferably in the range of 460 to 510 nm, or 560 to 610 nm, or 640 to 730 nm.

As aforementioned, the present invention has been completed on the basis of findings as to the interrelationship between an emulsified dispersion and the stability of dye multilayer adsorption. It is preferred that a high-boiling organic solvent, a 0surfactant, a compound which is reactive with developing agent oxidation products, or a combination thereof be contained in the emulsified dispersion mixed in the emulsion of the present invention. It is especially preferred that a coupler which induces a coupling reaction with an oxidation product of aromatic primary amine developing agent to thereby effect coloring, or a compound which reacts with an oxidation product of aromatic primary amine developing agent to thereby release a dye, a compound having a development inhibiting function and other photographically useful compounds be contained in the emulsified dispersion.

The surfactant which can be employed in the present invention, although not limited as long as the critical micell concentration thereof is $4.0\times10^{-3}$ mol/L or less, is preferably one capable of functioning as a dispersant for high-boiling organic solvents. More preferably, the surfactant for use in the present invention is an anionic surfactant such as a sulfoalkyl or a sulfoaryl, a nonionic surfactant such as an alkylpolyethylene oxide, or a betaine surfactant such as a sulfoalkylammonium. Further, use can be made of a polymer surfactant comprising a polymer having functional groups bonded thereto. Herein, the critical micell concentration refers to the concentration at which the surface tension is the lowest on a concentration/surface tension curve as obtained by first preparing solutions of varied surfactant concentrations, subsequently measuring surface tensions of the solutions with the use of surface tensiometer A3 manufactured by Kyowa Kagaku K.K. and thereafter plotting surface tension values against an axis of concentration logarithm. The critical micell concentration is the lowest concentration allowing the surfactant to form micells. The lower this value, the greater the surface activating capability.

In the present invention, the content of surfactant in the emulsion is preferably 0.01% by mass or more, more preferably 0.02% by mass or more.

Examples of surfactants for use in the present invention will be set out below, to which, however, the present invention is naturally in no way limited:

| | | Critical micell concentration (mol/L) |
|---|---|---|
| A-1 | 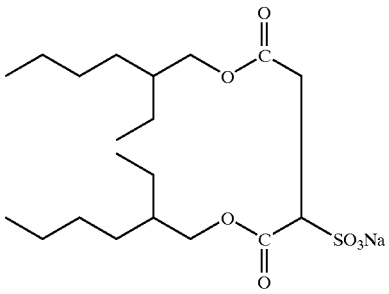 | $2.25 \times 10^{-3}$ |
| A-2 | 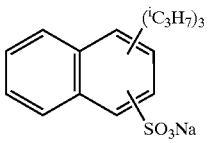 | $3.65 \times 10^{-3}$ |
| A-3 | 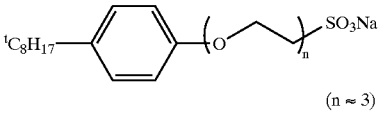 (n ≈ 3) | $0.16 \times 10^{-3}$ |
| A-4 | $C_{12}H_{25}OSO_3Na$ | $1.73 \times 10^{-3}$ |
| A-5 | 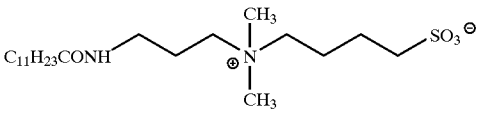 | $1.19 \times 10^{-3}$ |
| A-6 | 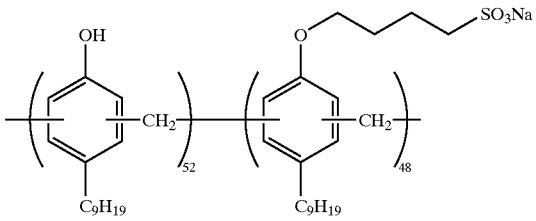 | $4.46 \times 10^{-6}$ |
| A-7 | 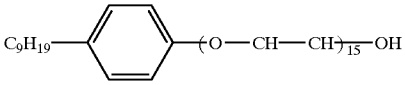 | $0.12 \times 10^{-3}$ |
| A-8 | 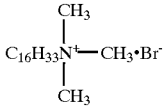 | $1.0 \times 10^{-3}$ |

The high-boiling organic solvent which can be employed in the present invention is preferably one with a dielectric constant of 7.0 or less. It can be selected from among high-boiling organic solvents whose boiling point is about 175° C. or higher at atmospheric pressure, such as phthalic acid esters, phosphoric acid esters, phosphonic acid esters, benzoic acid esters, fatty acid esters, amides, phenols, alcohols, ethers, carboxylic acids, N,N-dialkylanilines, trialkylamines, hydrocarbons, oligomers and polymers. When two or more high-boiling organic solvents are used in mixture, the mixture, if exhibiting a dielectric constant of 7.0 or less, corresponds to the above high-boiling organic solvent of 7.0 or less dielectric constant.

These high-boiling organic solvents with a dielectric constant of 7.0 or less can be used in mixture with a high-boiling organic solvent with a dielectric constant of greater than 7.0. In that case as well, the mixture, if exhibiting a dielectric constant of 7.0 or less, corresponds to the above high-boiling organic solvent of 7.0 or less dielectric constant. Herein, the dielectric constant refers to a specific dielectric constant to vacuum as measured by the transformer bridge method at a measuring temperature of 25° C. and at a measuring frequency of 10 kHz with the use of dielectric constant meter, model TRS-10T, manufactured by Ando Denki. The dielectric constant of organic solvent interrelates with the square of dipole moment of organic solvent molecules, that is, indicates the magnitude of polarity of molecules. Generally, molecules of high dielectric constant have high polarity.

The high-boiling organic solvents preferably employed in the present invention are those of 7.0 or less dielectric constant, represented by the following general formulae [S-1] to [S-8].

[S-1]

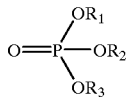

[S-2]

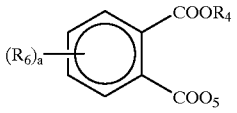

[S-3]

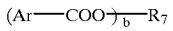

[S-4]

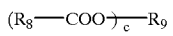

[S-5]

[S-6]

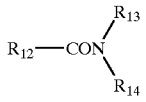

[S-7]

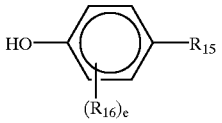

[S-8]

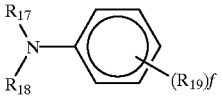

In the formula [S-1], each of $R_1$, $R_2$ and $R_3$ independently represents an alkyl group, a cycloalkyl group or an aryl group. In the formula [S-2], each of $R_4$ and $R_5$ independently represents an alkyl group, a cycloalkyl group or an aryl group; $R_6$ represents a halogen atom (F, Cl, Br or I; the same shall apply hereinafter), an alkyl group, an alkoxy group, an aryloxy group or an alkoxycarbonyl group; and a is an integer of 0 to 3, provided that, when a is 2 or greater, a plurality of $R_6$ groups may be identical with or different from each other.

In the formula [S-3], Ar represents an aryl group; b is an integer of 1 to 6; and $R_7$ represents a b-valent hydrocarbon group or a group of hydrocarbons coupled with each other through an ether bond. In the formula [S-4], $R_8$ represents an alkyl group or a cycloalkyl group; c is an integer of 1 to 6; and $R_9$ represents a c-valent hydrocarbon group or a group of hydrocarbons coupled with each other through an ether bond. In the formula [S-5], d is an integer of 2 to 6; $R_{10}$ represents a d-valent hydrocarbon group (provided that an aromatic group is excluded); and $R_{11}$ represents an alkyl group, a cycloalkyl group or an aryl group. In the formula [S-6], each of $R_{12}$, $R_{13}$ and $R_{14}$ independently represents an alkyl group, a cycloalkyl group or an aryl group, provided that $R_{12}$ and $R_{13}$, or $R_{13}$ and $R_{14}$ may be bonded with each other to thereby form a ring.

In the formula [S-7], $R_{15}$ represents an alkyl group, a cycloalkyl group, an alkoxycarbonyl group, an alkoxysulfonyl group, an arylsulfonyl group, an aryl group or a cyano group; $R_{16}$ represents a halogen atom, an alkyl group, a cycloalkyl group, an aryl group, an alkoxy group or an aryloxy group; and e is an integer of 0 to 3, provided that, when e is 2 or greater, a plurality of $R_{16}$ groups may be identical with or different from each other.

In the formula [S-8], each of $R_{17}$ and $R_{18}$ independently represents an alkyl group, a cycloalkyl group or an aryl group; $R_{19}$ represents a halogen atom, an alkyl group, a cycloalkyl group or an aryloxy group; and f is an integer of 0 to 4, provided that, when f is 2 or greater, a plurality of $R_{19}$ groups may be identical with or different from each other. In the formulae [S-1] to [S-8], when each of $R_1$ to $R_6$, $R_8$ and $R_{11}$ to $R_{19}$ is an alkyl group or a group containing an alkyl group, the alkyl group may be in the form of a linear or a branched chain, may contain an unsaturated bond, and may have a substituent. As the substituent, there can be mentioned, for example, a halogen atom, an aryl group, an alkoxy group, an aryloxy group, an alkoxycarbonyl group, a hydroxyl group, an acyloxy group or an epoxy group.

In the formulae [S-1] to [S-8], when each of $R_1$ to $R_6$, $R_8$ and $R_{11}$ to $R_{19}$ is a cycloalkyl group or a group containing a cycloalkyl group, the cycloalkyl group may contain an unsaturated bond in its 3 to 8-membered ring, and may have a substituent or a crosslink group. As the substituent, there can be mentioned, for example, a halogen atom, a hydroxyl group, an acyl group, an aryl group, an alkoxy group, an epoxy group or an alkyl group. As the crosslink group, there can be mentioned, for example, methylene, ethylene or isopropylidene.

In the formulae [S-1] to [S-8], when each of $R_1$ to $R_6$, $R_8$ and $R_{11}$ to $R_{19}$ is an aryl group or a group containing an aryl group, the aryl group may be substituted with a substituent such as a halogen atom, an alkyl group, an aryl group, an alkoxy group, an aryloxy group or an alkoxycarbonyl group. In the formulae [S-3], [S-4] and [S-5], when each of $R_7$, $R_9$ and $R_{10}$ is a hydrocarbon group, the hydrocarbon group may contain a cyclic structure (for example, a benzene ring, a cyclopentane ring or a cyclohexane ring) or an unsaturated bond, and further may have a substituent. As the substituent, there can be mentioned, for example, a halogen atom, a hydroxyl group, an acyloxy group, an aryl group, an alkoxy group, an aryloxy group or an epoxy group. In the formula [S-1], each of $R_1$, $R_2$ and $R_3$ represents an alkyl group having 1 to 24 (preferably 4 to 18) carbon atoms (total number of carbon atoms in each molecule) (for example, n-butyl, 2-ethylhexyl, 3,3,5-trimethylhexyl, n-dodecyl, n-octadecyl, benzyl, oleoyl, 2-chloroethyl, 2,3-dichloropropyl, 2-butoxyethyl or 2-phenoxyethyl), a cycloalkyl group having 5 to 24 (preferably 6 to 18) carbon atoms (for example, cyclopentyl, cyclohexyl, 4-t-butylcyclohexyl or 4-methylcyclohexyl), or an aryl group having 6 to 24 (preferably 6 to 18) carbon atoms (for example, phenyl, cresyl, p-nonylphenyl, xylyl, cumenyl, p-methoxyphenyl or p-methoxycarbonylphenyl).

In the formula [S-2], each of $R_4$ and $R_5$ represents an alkyl group having 1 to 24 (preferably 4 to 18) carbon atoms (for example, alkyl mentioned above as being represented by $R_1$, ethoxycarbonylmethyl, 1,1-diethylpropyl, 2-ethyl-1-methylhexyl, cyclohexylmethyl or 1-ethyl-1,5-dimethylhexyl), a cycloalkyl group having 5 to 24 (preferably 6 to 18) carbon atoms (for example, cycloalkyl mentioned above as being represented by $R_1$, 3,3,5-trimethylcyclohexyl, mentyl, bornyl or 1-methylcyclohexyl), or an aryl group having 6 to 24 (preferably 6 to 18) carbon atoms (for example, aryl mentioned above as being represented by $R_1$, 4-t-butylphenyl, 4-t-octylphenyl, 1,3,5-trimethylphenyl, 2,4-di-t-butylphenyl or 2,4-di-t-pentylphenyl). $R_6$ represents a halogen atom (preferably Cl), an alkyl group having 1 to 18 carbon atoms (for example, methyl, isopropyl, t-butyl or n-dodecyl), an alkoxy group having 1 to 18 carbon atoms (for example, methoxy, n-butoxy, n-octyloxy, methoxyethoxy or benzyloxy), an aryloxy group having 6 to 18 carbon atoms (for example, phenoxy, p-tolyloxy, 4-methoxyphenoxy or 4-t-butylphenoxy) or an alkoxycarbonyl group having 2 to 19 carbon atoms (for example, methoxycaronyl, n-butoxycaronyl or 2-ethylhexyloxycaronyl); and a is 0 to 3 (preferably 0 or 1).

In the formula [S-3], Ar represents an aryl group having 6 to 24 (preferably 6 to 18) carbon atoms (for example, phenyl, 4-chlorophenyl, 4-methoxyphenyl, 1-naphthyl, 4-n-butoxyphenyl or 1,3,5-trimethylphenyl), and b is an integer of 1 to 6 (preferably 1 to 3). $R_7$ represents a b-valent hydrocarbon group having 2 to 24 (preferably 2 to 18) carbon atoms [for example, alkyl, cycloalkyl or aryl mentioned above as being represented by $R_4$, $—(CH_2)_2—$,

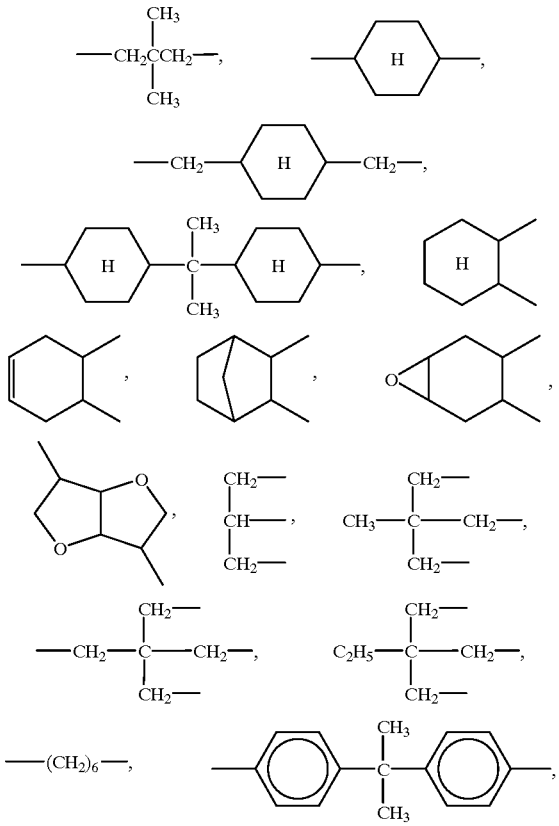

-continued

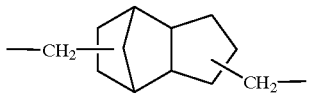

or a b-valent group of hydrocarbons coupled with each other through an ether bond having 4 to 24 (preferably 4 to 18) carbon atoms [for example, $—CH_2CH_2OCH_2CH_2—$, $—CH_2CH_2(OCH_2CH_2)_3—$, $—CH_2CH_2CH_2OCH_2CH_2CH_2—$,

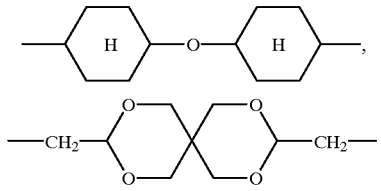

In the formula [S-4], $R_8$ represents an alkyl group having 1 to 24 (preferably 1 to 17) carbon atoms (for example, methyl, n-propyl, 1-hydroxyethyl, 1-ethylpentyl, n-undecyl, pentadecyl or 8,9-epoxyheptadecyl) or a cycloalkyl group having 3 to 24 (preferably 6 to 18) carbon atoms (for example, cyclopropyl, cyclohexyl or 4-methylcyclohexyl); and c is an integer of 1 to 6 (preferably 1 to 3). $R_9$ represents a c-valent hydrocarbon group having 2 to 24 (preferably 2 to 18) carbon atoms or a c-valent group of hydrocarbons coupled with each other through an ether bond having 4 to 24 (preferably 4 to 18) carbon atoms (for example, group mentioned above as being represented by $R_7$).

In the formula [S-5], d is 2 to 6 (preferably 2 or 3); and $R_{10}$ represents a d-valent hydrocarbon group [for example,

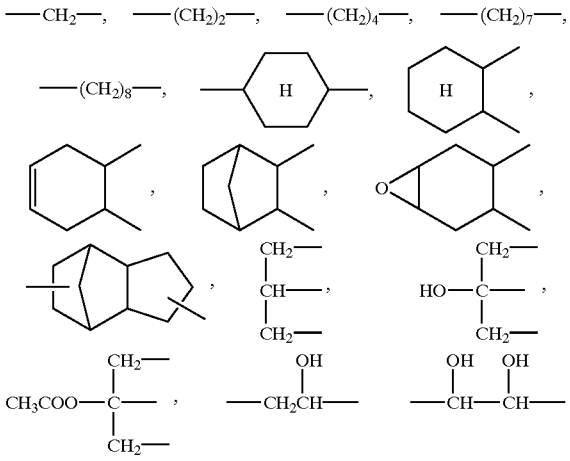

$R_{11}$ represents an alkyl group having 1 to 24 (preferably 4 to 18) carbon atoms, a cycloalkyl group having 5 to 24 (preferably 6 to 18) carbon atoms or an aryl group having 6 to 24 (preferably 6 to 18) carbon atoms [for example, alkyl, cycloalkyl or aryl mentioned above as being represented by $R_4$].

In the formula [S-6], $R_{12}$ represents an alkyl group having 1 to 24 (preferably 3 to 20) carbon atoms [for example, n-propyl, 1-ethylpentyl, n-undecyl, n-pentadecyl, 2,4-di-t-pentylphenoxymethyl, 4-t-octylphenoxymethyl, 3-(2,4-di-t-butylphenoxy)propyl or 1-(2,4-di-t-butylphenoxy)propyl], a cycloalkyl group having 5 to 24 (preferably 6 to 18) carbon atoms (for example, cyclohexyl or 4-methylcyclohexyl) or an aryl group having 6 to 24 (preferably 6 to 18) carbon atoms (for example, aryl mentioned above as being represented by Ar). Each of $R_{13}$ and $R_{14}$ represents an alkyl group having 1 to 24 (preferably 1 to 18) carbon atoms (for example, methyl, ethyl, isopropyl, n-butyl, n-hexyl, 2-ethylhexyl or n-dodecyl), a cycloalkyl group having 3 to 18 (preferably 3 to 15) carbon atoms (for example, cyclopentyl or cyclopropyl) or an aryl group having 6 to 18 (preferably 6 to 15) carbon atoms (for example, phenyl, 1-naphthyl or p-tolyl). $R_{13}$ and $R_{14}$ may be bonded with each other to thereby form a pyrrolidine ring, a piperidine ring or a morpholine ring in cooperation with N. $R_{12}$ and $R_{13}$ may be bonded with each other to thereby form a pyrrolidone ring.

In the formula [S-7], $R_{15}$ represents an alkyl group having 1 to 24 (preferably 1 to 18) carbon atoms (for example, methyl, isopropyl, t-butyl, t-pentyl, t-hexyl, t-octyl, 2-butyl, 2-hexyl, 2-octyl, 2-dodecyl, 2-hexadecyl or t-pentadecyl), a cycloalkyl group having 3 to 18 (preferably 5 to 12) carbon atoms (for example, cyclopentyl or cyclohexyl), an alkoxycarbonyl group having 2 to 24 (preferably 5 to 17) carbon atoms (for example, n-butoxycarbonyl, 2-ethylhexyloxycarbonyl or n-dodecyloxycarbonyl), an alkylsulfonyl group having 1 to 24 (preferably 1 to 18) carbon atoms (for example, methylsulfonyl, n-butylsulfonyl or n-dodecylsulfonyl), an arylsulfonyl group having 6 to 30 (preferably 6 to 24) carbon atoms (for example, p-tolylsulfonyl, p-dodecylphenylsulfonyl or p-hexadecyloxyphenylsulfonyl), an aryl group having 6 to 32 (preferably 6 to 24) carbon atoms (for example, phenyl or p-tolyl) or a cyano group. $R_{16}$ represents a halogen atom (preferably Cl), an alkyl group having 1 to 24 (preferably 1 to 18) carbon atoms (for example, alkyl mentioned above as being represented by $R_{15}$), a cycloalkyl group having 3 to 18 (preferably 5 to 17) carbon atoms (for example, cyclopentyl or cyclohexyl), an aryl group having 6 to 32 (preferably 6 to 24) carbon atoms (for example, phenyl or p-tolyl), an alkoxy group having 1 to 24 (preferably 1 to 18) carbon atoms (for example, methoxy, n-butoxy, 2-ethylhexyloxy, benzyloxy, n-dodecyloxy or n-hexadecyloxy) or an aryloxy group having 6 to 32 (preferably 6 to 24) carbon atoms (for example, phenoxy, p-t-butylphenoxy, p-t-octylphenoxy, m-pentadecylphenoxy or p-dodecyloxyphenoxy); and e is an integer of 0 to 3 (preferably 1 or 2).

In the formula [S-8], $R_{17}$ and $R_{18}$ have the same meaning as those of the above $R_{13}$ and $R_{14}$. $R_{19}$ has the same meaning as that of the above $R_{16}$; and f is an integer of 0 to 4 (preferably 0 to 2).

Among the high-boiling organic solvents represented by the formulae [S-1] to [S-8], those represented by the formula [S-1] ($R_1$, $R_2$ and $R_3$ are preferably alkyl groups), [S-2], [S-3] (b is preferably 1), [S-4], [S-5] and [S-7] are preferred. The high-boiling organic solvents represented by the formulae [S-1], [S-2], [S-4] and [S-5] are most preferred. Specific examples of the high-boiling organic solvents for use in the present invention will be set out below:

| | | Dielectrtic constant |
|---|---|---|
| S-1 | $O{=}P(OC_6H_{13})_3$ | 5.86 |
| S-2 | $O{=}P(OCH_2CH(C_2H_5)C_4H_9)_3$ | 4.80 |

-continued

| | | Dielectrtic constant |
|---|---|---|
| S-3 | $O{=}P(OCH_2CH_2CH(CH_3)CH_2C(CH_3)_2CH_2)_3$ | 4.46 |
| S-4 | $O{=}P(OC_{12}H_{15})_3$ | 3.87 |
| S-5 | $O{=}P(OC_{16}H_{33})_3$ | 3.45 |
| S-6 | $O{=}P{-}(O(CH_2)_8CH{=}CHC_8H_{17})_3$ | 3.63 |
| S-7 | $O{=}P{-}(O{-}C_6H_{10}{-}C_4H_9\text{-}t)_3$ | 5.42 |
| S-8 | $C_6H_4(COOC_6H_{13})_2$ | 5.50 |
| S-9 | $C_6H_4(COOC_7H_{15}\text{ (branched chain)})_2$ | 5.17 |
| S-10 | $C_6H_4(COOCH_2CH(C_2H_5)C_4H_9)_2$ | 5.18 |
| S-11 | $C_6H_4(COOC_{12}H_{25})_2$ | 4.17 |
| S-12 | $C_6H_4(COOC(C_2H_5)_3)_2$ | 5.64 |
| S-13 | $C_6H_5COOCH_2CH(C_2H_5)C_4H_9$ | 4.49 |
| S-14 | $Cl{-}C_6H_3(Cl){-}COOC_8H_{17}$ | 5.18 |
| S-15 | $C_6H_4(COOC_4H_9){-}C_6H_4(COOC_4H_9)$ | 5.28 |
| S-16 | $C_{15}H_{31}COOC_{16}H_{33}$ | 3.06 |

-continued

| | | Dielectrtic constant |
|---|---|---|
| S-17 | $C_8H_{17}CH(O)CH(CH_2)_7COOCH_2CH(C_2H_5)C_4H_9$ | 4.54 |
| S-18 | $CH_3CH(OH)COOCH_2CH(CH_3)CHCH_2C_4H_9\text{-}t$ / $CH_2CH_2CH(CH_2)CH_2C_4H_9\text{-}t$ | 4.48 |
| S-19 | $C_4H_9CH(C_2H_5)COOCH_2CH_2OCOCH(C_2H_5)C_4H_9$ | 4.26 |
| S-20 | $C_4H_9CH(C_2H_5)COOCH_2C(CH_3)_2CH_2OCOCH(C_2H_5)C_4H_9$ | 3.54 |
| S-21 | $C_4H_9CH(C_2H_5)COOCH_2$–H–$CH_2OCOCH(C_2H_5)C_4H_9$ | 3.87 |
| S-22 | $C_4H_9CH(C_2H_5)CH_2OCO(CH_2)_4COOCH_2CH(C_2H_5)C_4H_9$ | 4.23 |
| S-23 | $C_4H_9CH(C_2H_5)CH_2OCO(CH_2)_8COOCH_2CH(C_2H_5)C_4H_9$ | 3.96 |
| S-24 | $C_4H_9OCO(CH_2)_8COOC_4H_9$ | 4.47 |
| S-25 | $(C_2H_5)CH(C_4H_9)CH_2OCO$–CH=CH–$COOCH_2CH(C_2H_5)C_4H_9$ | 4.59 |
| S-26 | O–H–$COOCH_2CH(C_2H_5)C_4H_9$ / $COOCH_2CH(C_2H_5)C_4H_9$ | 5.37 |
| S-27 | $C_4H_9OCO$–[bicyclo]–$COOC_4H_9$ | 4.51 |

-continued

| | | Dielectrtic constant |
|---|---|---|
| S-28 | $CH_3COO$–C($CH_2COOCH_2CH(C_2H_5)C_4H_9$)$_3$ | 4.66 |
| S-29 | t-$C_5H_{11}$–C$_6$H$_4$–$OCH_2CON(C_8H_{17})_2$ / $C_5H_{11}$-t | 5.48 |
| S-30 | $CONHCH_2CH(C_2H_5)C_4H_9$–C$_6$H$_4$–C$_6$H$_4$–$CONHCH_2CH(C_2H_5)C_4H_9$ | 4.32 |
| S-31 | HO–C$_6$H$_4$–$C_5H_{11}$-t / $C_5H_{11}$-t | 3.25 |
| S-32 | HO–C$_6$H$_4$–$C_9H_{19}$ (branched chain) / $C_9H_{19}$ (branched chain) | 2.87 |
| S-33 | $C_{15}H_{31}$–C$_6$H$_4$–HO / $C_8H_{17}$-t | 2.66 |
| S-34 | HO–C$_6$H$_4$–$C_{12}H_{25}$ (branched chain) / $C_{15}H_{31}$-t | 2.54 |
| S-35 | $OC_4H_9$–C$_6$H$_4$–N($C_4H_9$)$_2$ / $C_8H_{17}$-t | 2.76 |

-continued

| | | Dielectrtic constant |
|---|---|---|
| S-36 | 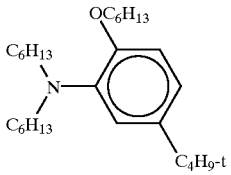 | 2.63 |
| S-37 | 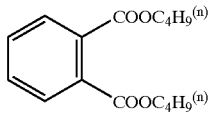 | 6.45 |

These high-boiling organic solvents may be used individually or in mixture [for example, mixtures of di(2-ethylhexyl) phthalate and trioctyl phosphate, di(2-ethylhexyl) sebacate and triisononyl phosphate, and dibutyl phthalate and di(2-ethylhexyl) adipate]. When two or more high-boiling organic solvents are used in combination, it is preferred that the dielectric constant of the mixture be 7.0 or less.

Other compound examples of the high-boiling organic solvents for use in the present invention and/or processes for synthesizing such high-boiling organic solvents are described in, for example, U.S. Pat. Nos. 2,322,027, 2,533,514, 2,772,163, 2,835,579, 3,594,171, 3,676,137, 3,689,271, 3,700,454, 3,748,141, 3,764,336, 3,765,897, 3,912,515, 3,936,303, 4,004,929, 4,080,209, 4,127,413, 4,193,802, 4,207,393, 4,220,711, 4,239,851, 4,278,757, 4,353,979, 4,363,873, 4,430,421, 4,464,464, 4,483,918, 4,540,657, 4,684,606, 4,728,599 and 4,745,049, EP Nos. 276,319A, 286,253A, 289,820A, 309,158A, 309,159A and 309,160A, JP-A's-48-47335, 50-26530, 51-25133, 51-26036, 51-277921, 51-27922, 51-149028, 52-46816, 53-1520, 53-1521, 53-15127, 53-146622, 54-106228, 56-64333, 56-81836, 59-204041, 61-84641, 62-118345, 62-247364, 63-167357, 63-214744, 63-301941 and 64-68745, and Jpn. Pat. Appln. KOKAI Publication No. (hereinafter referred to as JP-A-) 1-101543 and JP-A-1-102454.

In the present invention, the high-boiling organic solvent is preferably contained as an emulsified substance (microdispersion). The average particle diameter of emulsified substance is preferably 50 $\mu$m or less, more preferably 10 $\mu$m or less, still more preferably 2 $\mu$m or less, and most preferably 0.5 $\mu$m or less. In the preparation of emulsified substance, although a dispersion can be effected only by mechanical agitation, it is preferred to add a surfactant. Further, the emulsified substance is preferably prepared by adding a polymer such as gelatin thereto.

The content of high-boiling organic solvent in the emulsion is preferably in the range of 0.05 to 10%, more preferably 0.1 to 10%, and most preferably 0.2 to 10% on a mass basis (mass of high-boiling organic solvent contained in 100 g of emulsion).

In the present invention, the expression "when the emulsion of the present invention is agitated at 40° C. for 30 min, the variation of absorption spectrum ranging from 400 nm to 700 nm thereof is within 10%" means that, in the entire range from 400 nm to 700 nm, the difference between the absorbance before emulsion agitation and that after emulsion agitation is within 10%, or that the difference between the absorbance at absorption maximum before emulsion agitation and that after emulsion agitation or the difference between the absorption integrated intensity ranging from 400 nm to 700 nm before emulsion agitation and that after emulsion agitation is within 10%.

In the present invention, the expression "when the silver halide photographic lightsensitive material is aged at 60° C. in 30% humidity for 3 days, the variation of absorption spectrum ranging from 400 nm to 700 nm is within 10%" means that, in the entire range from 400 nm to 700 nm, the difference between the absorbance before aging of the silver halide photographic emulsion layer and that after aging of the silver halide photographic emulsion layer is within 10%, or that the difference between the absorbance at absorption maximum before aging of the silver halide photographic emulsion layer and that after aging of the silver halide photographic emulsion layer or the difference between the absorption integrated intensity ranging from 400 nm to 700 nm before aging of the silver halide photographic emulsion layer and that after aging of the silver halide photographic emulsion layer is within 10%.

The compound being reactive with developing agent oxidation products, which can be employed in the present invention, is a yellow dye forming coupler represented by the above formula 1 wherein $R_1$ represents a tertiary alkyl group or an aryl group; $R_2$ represents a hydrogen atom, a halogen atom (F, Cl, Br or I; hereinafter, the same applies in the illustration of the formula 1), an alkoxy group, an aryloxy group, an alkyl group or a dialkylamino group; $R_3$ represents a group capable of effecting a substitution on a benzene ring; x represents a hydrogen atom or a heterocycle capable of being eliminated by a coupling reaction with an oxidation product of aromatic primary amine developing agent and capable of bonding at a nitrogen atom with a coupling active site; and L is an integer of 0 to 4, provided that, when L is two or more, two or more $R_3$ groups may be identical with or different from each other.

$R_3$ is, for example, a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group or an arylsulfonyloxy group. When $R_1$ is a tertiary alkyl group, it may contain a cyclic structure such as cyclopropyl, cyclobutyl, cyclopentyl or cyclohexyl.

In the formula 1, it is preferred that $R_1$ represent a t-butyl group, a 1-methylcyclopropyl group, a phenyl group, or a phenyl group substituted with a halogen atom, an alkyl group or an alkoxy group; $R_2$ represent a halogen atom, an alkoxy group or a phenoxy group; $R_3$ represent a halogen atom, an alkoxy group, an alkoxycarbonyl group, a carbonamido group, a sulfonamido group, a carbamoyl group or a sulfamoyl group; X represent a 5 to 7-membered heterocyclic group capable of bonding at a nitrogen atom with a coupling active site, which may contain N, S, O or P; and L be an integer of 0 to 2.

The coupler represented by the formula 1 may be a dimer, higher polymer, homopolymer or copolymer containing noncoupling polymer units, which can bond through a divalent group or group of higher valence at substituent $R_1$, X or
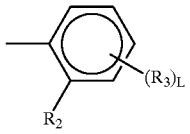
Specific examples of the couplers of the formula 1 will be set out below:
E-1
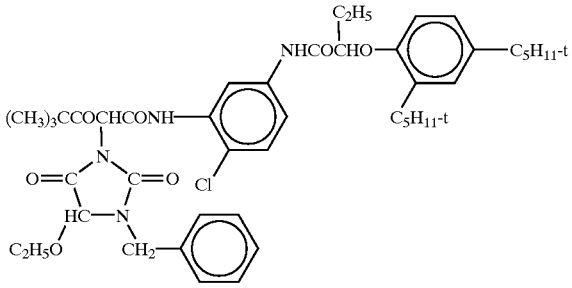
E-2
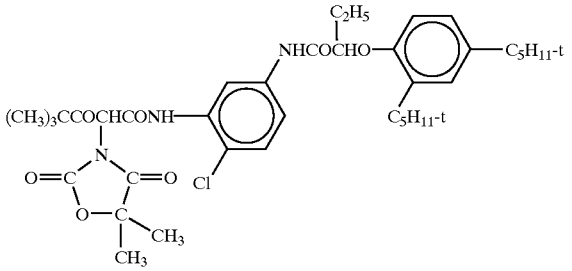
E-3
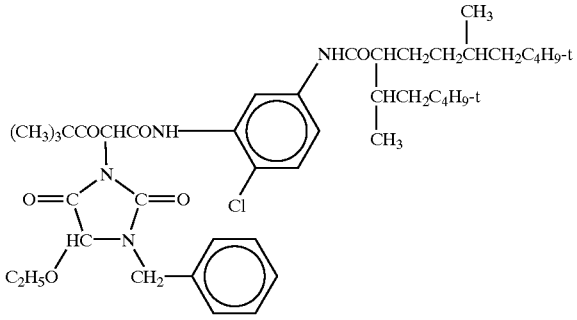
E-4
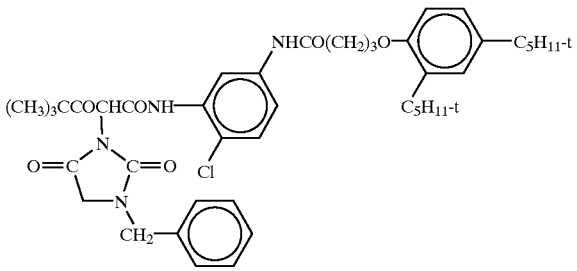
-continued
E-5
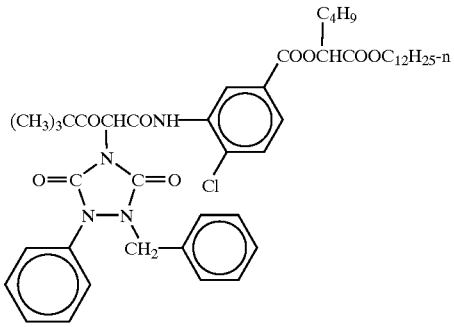
E-6
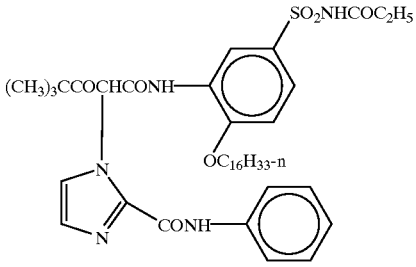
E-7
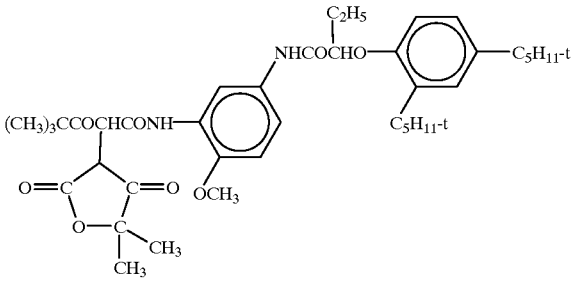
E-8
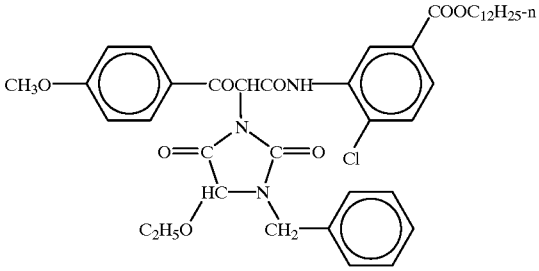
E-9
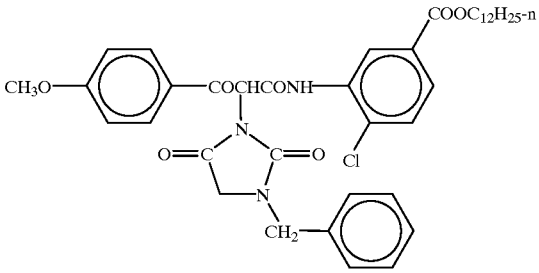

-continued

E-10

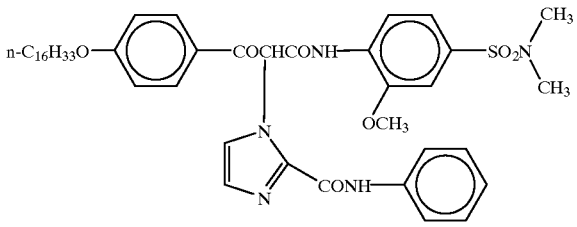

E-11

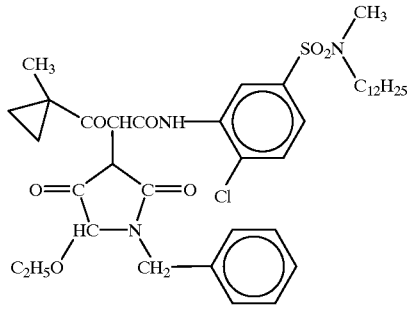

E-12

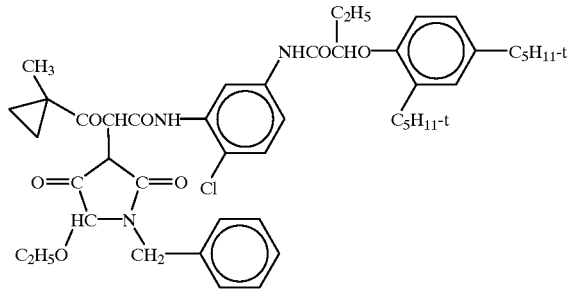

E-13

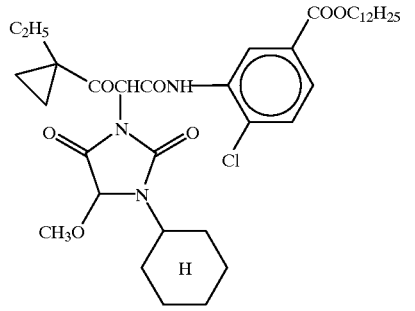

Other compound examples of the yellow couplers for use in the present invention and/or processes for synthesizing such yellow couplers are described in, for example, U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837 and 4,729,944, EP Nos. 30,747A, 284,081A, 296,793A and 313,308A, DE No. 3,107,173C, and JP-A's-58-42044, 59-174839, 62-276547 and 63-123047.

The first preferable method for realizing silver halide grains of less than 500 nm spectral absorption maximum wavelength and 60 or more light absorption intensity, or 500 nm or more spectral absorption maximum wavelength and 100 or more light absorption intensity, is any of those using the following specified dyes.

For example, there can preferably be employed the method of using a dye having an aromatic group, or using cationic and anionic dyes having aromatic groups in combination as described in JP-A's 10-239789, 8-269009, 10-123650 and 8-328189; the method of using a dye of polyvalent charge as described in JP-A-10-171058; the method of using a dye having a pyridinium group as described in JP-A-10-104774; the method of using a dye having a hydrophobic group as described in JP-A-10-186559; the method of using a dye having a coordination bond group as described in JP-A-10-197980; and the method of using specified dyes as described in JP-A's 2000-256573, 2000-275776, 2000-345061, 2000-345060, 2001-005132, 2001-075220, 2001-092068, 2001-081341, 2001-152038, 2001-152044, 2001-075221, 2001-152037, 2001-166413 and Japanese Patent Application No. 2000-18966.

The method of using a dye having at least one aromatic group is most preferred. In particular, the method wherein a positively charged dye, or a dye having intra-molecularly offset charges, or a dye having no charges is used alone, and the method wherein positively and negatively charged dyes are used in combination, at least one thereof having at least one aromatic group as a substituent, are preferred.

The aromatic group will now be described in detail. The aromatic group may be a hydrocarbon aromatic group or a heteroaromatic group. Further, the aromatic group may be a group having the structure of a polycyclic condensed ring resulting from mutual condensation of hydrocarbon aromatic rings or heteroaromatic rings, or a polycyclic condensed ring consisting of a combination of an aromatic hydrocarbon ring and an aromatic heterocycle. The aromatic group may be substituted with, for example, substituent V described later. Examples of preferred aromatic rings contained in the aromatic group include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, quinoline, carbazole, phenanthridine, acridine, phenanthroline, thianthrene, chromene, xanthene, phenoxathiin, phenothiazine and phenazine.

The above hydrocarbon aromatic rings are more preferred. Benzene and naphthalene are most preferred. Benzene is optimal.

For example, any of those aforementioned as examples of dye chromophores can be used as the dye. The dyes aforementioned as examples of polymethine dye chromophores can preferably be employed.

More preferred are a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. Still more preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimal.

Especially preferred methods will be described in detail below with reference to shown structural formulae.

Specifically, the following methods (1) and (2) are preferred. Of them, the method (2) is more preferred.

(1) In this method, use is made of at least one member of cationic, betaine and nonionic methine dyes represented by the following general formula (I).

(2) In this method, at least one member of cationic methine dyes represented by the following general formula (I) and at least one member of anionic methine dyes represented by the following general formula (II) are simultaneously used.

I

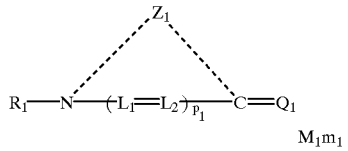

In this formula, $Z_1$ represents an atomic group needed to form a nitrogenous heterocycle, provided that a ring condensation may have been effected thereto. $R_1$ represents an alkyl group, an aryl group or a heterocyclic group. $Q_1$ represents a group needed for the compound of the general formula (I) to form a methine dye. Each of $L_1$ and $L_2$ represents a methine group, and $p_1$ is 0 or 1.

Provided, however, that $Z_1$, $R_1$, $Q_1$, $L_1$ and $L_2$ should have such substituents that the methine dye of the general formula (I) as a whole constitutes a cationic dye, a betaine dye or a nonionic dye. Provided that, when the general formula (I) represents a cyanine dye or a rhodacyanine dye, they preferably have such substituents that the methine dye as a whole constitutes a cationic dye. $M_1$ represents a counter ion for charge balance, and $m_1$ is a number of 0 or greater needed to neutralize a molecular charge.

II

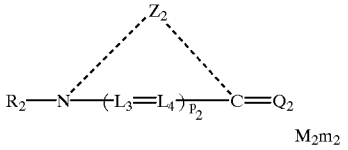

In this formula, $Z_2$ represents an atomic group needed to form a nitrogenous heterocycle, provided that a ring condensation may have been effected thereto. $R_2$ represents an alkyl group, an aryl group or a heterocyclic group. $Q_2$ represents a group needed for the compound of the general formula (II) to form a methine dye. Each of $L_3$ and $L_4$ represents a methine group, and $p_2$ is 0 or 1.

Provided, however, that $Z_2$, $R_2$, $Q_2$, $L_3$ and $L_4$ should have such substituents that the methine dye of the general formula (II) as a whole constitutes an anionic dye. $M_2$ represents a counter ion for charge balance, and $m_2$ is a number of 0 or greater needed to neutralize a molecular charge.

When the compound of the general formula (I) is employed alone, it is preferred that $R_1$ be a group having an aromatic ring.

When the compound of the general formula (I) is employed in combination with the compound of the general formula (II), it is preferred that at least one of $R_1$ and $R_2$ be a group having an aromatic ring.

More preferably, $R_1$ and $R_2$ simultaneously represent a group having an aromatic ring.

Although the cationic dye for use in the present invention is not particularly limited as long as the charges of dye exclusive of counter ions are cationic, it is preferred that the cationic dye be a dye having no anionic substituents. Further, although the anionic dye for use in the present invention is not particularly limited as long as the charges of dye exclusive of counter ions are anionic, it is preferred that the anionic dye be a dye having at least one anionic substituent. The betaine dye for use in the present invention is a dye which, although having charges in its molecule, forms such an intramolecular salt that the molecule as a whole has no charges. The nonionic dye for use in the present invention is a dye having no charges at all in its molecule.

Herein, the anionic substituent refers to a substituent having a negative charge, and can be, for example, a proton dissociative acid group, at least 90% of which undergoes dissociation at a pH of 5 to 8. Examples of suitable anionic substituents include a sulfo group, a carboxyl group, a sulfato group, a phosphate group and a borate group. As other examples of anionic substituents, there can be mentioned groups from which proton is dissociated depending on the pKa thereof and the environmental pH, such as —$CONHSO_2$— (sulfonylcarbamoyl group or carbonylsulfamoyl group), —CONHCO— (carbonylcarbamoyl group), —$SO_2NHSO_2$— (sulfonylsulfamoyl group) and phenolic hydroxyl. Of these, a sulfo group, a carboxyl group, —$CONHSO_2$—, —CONHCO— and —$SO_2NHSO_2$— are preferred.

The groups of the formulae —$CONHSO_2$—, —CONHCO— and —$SO_2NHSO_2$— may not dissociate proton depending on the pKa thereof and the environmental pH. In such instances, the groups are not included in the anionic substituents mentioned herein. That is, when any proton dissociation does not occur, for example, the dye represented by the general formula (I-1) given below, even if substituted with two of such groups, can be regarded as cationic dye.

As the cationic substituent, there can be mentioned, for example, substituted or unsubstituted ammonium groups and pyridinium groups.

Among the dyes of the general formula (I), those of the following general formulae (I-1), (I-2) and (I-3) are especially preferred.

I-1

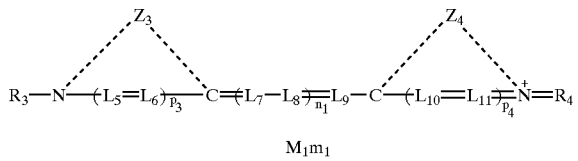

In the general formula (I-1), each of $L_5$, $L_6$, $L_7$, $L_8$, $L_9$, $L_{10}$ and $L_{11}$ represents a methine group, each of $p_3$ and $p_4$ is 0 or 1, and $n_1$ is 0, 1, 2, 3 or 4. Each of $Z_3$ and $Z_4$ represents an atomic group needed to form a nitrogenous heterocycle, provided that a ring condensation may have been effected thereto. Each of $R_3$ and $R_4$ represents an alkyl group, an aryl group or a heterocyclic group. $M_1$ and $m_1$ have the same meaning as in the general formula (I). Provided that $R_3$, $R_4$, $Z_3$, $Z_4$ and $L_5$ to $L_{11}$ have no anionic substituent when the general formula (I-1) represents a cationic dye and have one anionic substituent when the general formula (I-1) represents a betaine dye.

I-2

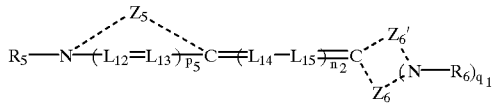

$M_1m_1$

In the general formula (I-2), each of $L_{12}$, $L_{13}$, $L_{14}$ and $L_{15}$ represents a methine group, $p_5$ is 0 or 1, $q_1$ is 0 or 1, and $n_2$ is 0, 1, 2, 3 or 4. $Z_5$ represents an atomic group needed to form a nitrogenous heterocycle, and $Z_6$ and $Z_6'$ represent atomic groups needed to form a heterocycle or a noncyclic acid terminal in cooperation with $(N—R_6)q_1$, provided that a ring condensation may have been effected to $Z_5$ and $Z_6$ and $Z_6'$. Each of $R_5$ and $R_6$ represents an alkyl group, an aryl group or a heterocyclic group. $M_1$ and $m_1$ have the same meaning as in the general formula (I). Provided that $R_5$, $R_6$, $Z_5$, $Z_6$ and $L_{12}$ to $L_{15}$ have a cationic substituent when the general formula (I-2) represents a cationic dye, have one cationic substituent together with one anionic substituent when the general formula (I-2) represents a betaine dye, and have no cationic substituent and no anionic substituent when the general formula (I-2) represents a nonionic dye.

Among the anionic dyes of the general formula (II), those of the following general formulae (II-1), (II-2) and (II-3) are especially preferred.

II-1

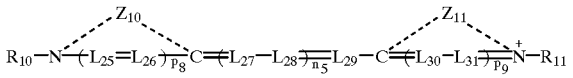

$M_2m_2$

In the general formula (II-1), each of $L_{25}$, $L_{26}$, $L_{27}$, $L_{28}$, $L_{29}$, $L_{30}$ and $L_{31}$ represents a methine group, each of $p_8$ and $p_9$ is 0 or 1, and $n_5$ is 0, 1, 2, 3 or 4. Each of $Z_{10}$ and $Z_{11}$ represents an atomic group needed to form a nitrogenous heterocycle, provided that a ring condensation may have been effected thereto. Each of $R_{10}$ and $R_{11}$ represents an alkyl group, an aryl group or a heterocyclic group. $M_2$ and $m_2$ have the same meaning as in the general formula (II). Provided that $R_{10}$ and $R_{11}$ have an anionic substituent.

I-3

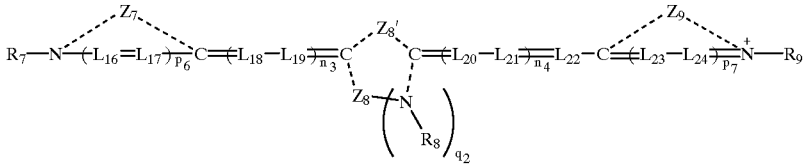

$M_1m_1$

In the general formula (I-3), each of $L_{16}$, $L_{17}$, $L_{18}$, $L_{19}$, $L_{20}$, $L_{21}$, $L_{22}$, $L_{23}$ and $L_{24}$ represents a methine group, each of $p_6$ and $p_7$ is 0 or 1, $q_2$ is 0 or 1, and each of $n_3$ and $n_4$ is 0, 1, 2, 3 or 4. Each of $Z_7$ and $Z_9$ represents an atomic group needed to form a nitrogenous heterocycle, and $Z_8$ and $Z_8'$ represent atomic groups needed to form a heterocycle in cooperation with $(N—R_8)q_2$, provided that a ring condensation may have been effected to $Z_7$, $Z_8$ and $Z_8'$, and $Z_9$. Each of $R_7$, $R_8$ and $R_9$ represents an alkyl group, an aryl group or a heterocyclic group. $M_1$ and $m_1$ have the same meaning as in the general formula (I). Provided that $R_7$, $R_8$, $R_9$, $Z_7$, $Z_8$, $Z_9$ and $L_{16}$ to $L_{24}$ have no anionic substituent when the general formula (I-3) represents a cationic dye and have one anionic substituent when the general formula (I-3) represents a betaine dye.

II-2

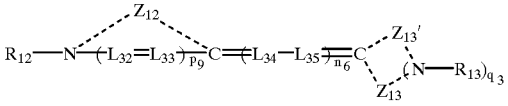

$M_2m_2$

In the general formula (II-2), each of $L_{32}$, $L_{33}$, $L_{34}$ and $L_{35}$ represents a methine group, $p_9$ is 0 or 1, $q_3$ is 0 or 1, and $n_6$ is 0, 1, 2, 3 or 4. $Z_{12}$ represents an atomic group needed to form a nitrogenous heterocycle, and $Z_{13}$ and $Z_{13}'$ represent atomic groups needed to form a heterocycle or a noncyclic acid terminal in cooperation with $(N—R_{13})q_3$, provided that a ring condensation may have been effected to $Z_{12}$ and $Z_{13}$ and $Z_{13}'$. Each of $R_{12}$ and $R_{13}$ represents an alkyl group, an aryl group or a heterocyclic group. $M_2$ and $m_2$ have the same meaning as in the general formula (II). Provided that at least one of $R_{12}$ and $R_{13}$ has an anionic substituent.

II-3

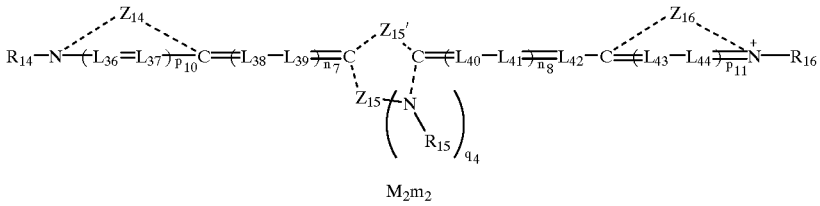

In the general formula (II-3), each of $L_{36}$, $L_{37}$, $L_{38}$, $L_{39}$, $L_{40}$, $L_{41}$, $L_{42}$, $L_{43}$ and $L_{44}$ represents a methine group, each of $p_{10}$ and $p_{11}$ is 0 or 1, $q_4$ is 0 or 1, and each of $n_7$ and $n_8$ is 0, 1, 2, 3 or 4. Each of $Z_{14}$ and $Z_{16}$ represents an atomic group needed to form a nitrogenous heterocycle, and $Z_{15}$ and $Z_{15}'$ represent atomic groups needed to form a heterocycle in cooperation with $(N—R_{15})q_4$, provided that a ring condensation may have been effected to $Z_{14}$, $Z_{15}$ and $Z_{15}'$, and $Z_{16}$. Each of $R_{14}$, $R_{15}$ and $R_{16}$ represents an alkyl group, an aryl group or a heterocyclic group. $M_2$ and $m_2$ have the same meaning as in the general formula (II). Provided that at least two of $R_{14}$, $R_{15}$ and $R_{16}$ have an anionic substituent.

When the compounds of the general formulae (I-1), (I-2) and (I-3) are used alone, at least one, preferably both, of $R_3$ and $R_4$ represents a group having an aromatic ring; at least one, preferably both, of $R_5$ and $R_6$ represents a group having an aromatic ring; and at least one, preferably at least two, and more preferably all three, of $R_7$, $R_8$ and $R_9$ represents a group having an aromatic ring.

When the compounds of the general formulae (I-1), (I-2) and (I-3) are used in combination with the compounds of the general formulae (II-1), (II-2) and (II-3), at least one, preferably two, more preferably three, and most preferably four or more, of $R_3$ to $R_9$ and $R_{10}$ to $R_{16}$ of the combined dyes represents a group having an aromatic ring.

Although silver halide grains of less than 500 nm spectral absorption maximum wavelength and 60 or more light absorption intensity, or 500 nm or more spectral absorption maximum wavelength and 100 or more light absorption intensity, can be realized by the above preferred method, the dye of the second layer is generally adsorbed in the form of a monomer, so that most often the absorption width and spectral sensitivity width are larger than those desired. Therefore, for realizing a high sensitivity within a desired wavelength region, it is preferred that the dye adsorbed into the second layer form a J-association product. Further, the J-association product is preferred from the viewpoint of transmitting light energy absorbed by the dye of the second layer to the dye of the first layer with a proximate light absorption wavelength by the energy transfer of the Forster type, because of the high fluorescent yield and slight Stokes shift exhibited thereby.

In the present invention, the dye of the second et seq. layers refers to the dye that is adsorbed on silver halide grains, the adsorption being, however, not directly effected on the silver halide grains.

In the present invention, the J-association of the dye of the second et seq. layers is defined as the large-wavelength-side absorption width of absorption exhibited by the dye adsorbed in the second et seq. layers being not greater than twice the large-wavelength-side absorption width of absorption exhibited by a dye solution in monomeric form wherein there is no interaction between dye chromophores. Herein, the large-wavelength-side absorption width refers to the energy width between absorption maximum wavelength and such wavelength that is larger than the absorption maximum wavelength and exhibits absorption equal to ½ of absorption maximum. It is generally known that, upon the formation of J-association product, the large-wavelength-side absorption width becomes small as compared with that in monomeric form. When the dye is adsorbed in monomeric form into the second layer, there results nonuniformity of adsorption position and form to thereby bring about an increase to two or more times the large-wavelength-side absorption width of absorption exhibited by a dye solution in monomeric form. Therefore, the above definition enables defining the J-association product of the dye of the second et seq. layers.

The spectral absorption of the dye adsorbed into the second et seq. layers can be determined by subtracting the spectral absorption attributed to the dye of the first layer from the total spectral absorption of the emulsion.

The spectral absorption attributed to the dye of the first layer can be determined by measuring the absorption spectrum exhibited when only the first-layer dye has been added. Further, the spectrum of spectral absorption attributed to the dye of the first layer can be measured by adding a dye desorbing agent to the emulsion having sensitizing dyes adsorbed in multilayer form to thereby desorb the dye of the second et seq. layers.

In an experiment of desorbing dyes from grain surface with the use of a dye desorbing agent, generally, the dye of the first layer is removed only after the desorption of the dye of the second et seq. layers. Therefore, the spectral absorption attributed to the dye of the first layer can be determined by selecting appropriate desorption conditions. As a result, the spectral absorption of the dye of the second et seq. layers can be determined. With respect to the method of using a dye desorbing agent, reference can be made to report of Asanuma (Journal of Physical Chemistry B, vol. 101, pages 2149 to 2153 (1997)).

For forming the J-association product of the dye of the second layer from a cationic dye, betaine dye, or nonionic dye represented by the general formula (I) or an anionic dye represented by the general formula (II), it is preferred that the addition of dye adsorbed as the first layer be separated from the addition of dye adsorbed in the formation of the second et seq. layers, and it is more preferred that the structure of the dye of the first layer be different from that of the dye of the second et seq. layers. With respect to the dye of the second et seq. layers, it is preferred that a cationic dye, a betaine dye and a nonionic dye be added individually, or a cationic dye and an anionic dye be added in combination.

The dye of the first layer, although not particularly limited, preferably consists of the dye represented by the general formula (I) or the general formula (II), more preferably represented by the general formula (I).

As the second-layer dye, the cationic dye, betaine dye or nonionic dye represented by the general formula (I) is preferably used alone. When a cationic dye and an anionic dye are used in combination as an also preferred second-layer dye, it is preferred that one of them be the cationic dye of the general formula (I) or the anionic dye of the general formula (II). More preferably, both the cationic dye of the general formula (I) and the anionic dye of the general formula (II) are contained in the second layer. The ratio of cationic dye to anionic dye in the dye of the second layer is preferably in the range of 0.5 to 2, more preferably 0.75 to 1.33, and most preferably 0.9 to 1.11.

In the present invention, although dyes other than those represented by the general formula (I) and the general formula (II) can be added, the dyes of the general formula (I) or the general formula (II) are preferably added in an amount of 50% or more, more preferably 70% or more, and most preferably 90% or more, based on the total addition amount of dyes.

The addition of second-layer dyes in the above manner enables increasing the interaction between second-layer dyes while promoting a rearrangement of second-layer dyes, so that the formation of J-association product can be realized.

With respect to the dyes of the general formula (I) or the general formula (II), when used as the first-layer dye, it is preferred that each of $Z_1$ and $Z_2$ be a basic nucleus substituted with an aromatic group or a basic nucleus resulting from condensation of three or more rings. In the use as the dye of the second et seq. layer, it is preferred that each of $Z_1$ and $Z_2$ be a basic nucleus resulting from condensation of three or more rings.

With respect to the number of condensed rings in basic nuclei, it is, for example, 2 in a benzoxazole nucleus and 3 in a naphthoxazole nucleus. Even if the benzoxazole nucleus is substituted with a phenyl group, the number of condensed rings thereof is 2. Although the basic nucleus resulting from condensation of three or more rings is not particularly limited as long as it is a polycyclic condensed-ring-type heterocyclic basic nucleus resulting from condensation of three or more rings, it is preferred that the basic nucleus consist of a tricyclic condensed-ring-type heterocycle or a tetracyclic condensed-ring-type heterocycle. As a preferred tricyclic condensed-ring-type heterocycle, there can be mentioned, for example, naphth[2,3-d]oxazole, naphth[1,2-d]oxazole, naphth[2,1-d]oxazole, naphtho[2,3-d]thiazole, naphtho[1,2-d]thiazole, naphtho[2,1-d]thiazole, naphth[2,3-d]imidazole, naphth[1,2-d]imidazole, naphth[2,1-d]imidazole, naphtho[2,3-d]selenazole, naphtho[1,2-d]selenazole, naphtho[2,1-d]selenazole, indol[5,6-d]oxazole, indol[6,5-d]oxazole, indol[2,3-d]oxazole, indolo[5,6-d]thiazole, indolo[6,5-d]thiazole, indolo[2,3-d]thiazole, benzofur[5,6-d]oxazole, benzofur[6,5-d]oxazole, benzofur[2,3-d]oxazole, benzofuro[5,6-d]thiazole, benzofuro[6,5-d]thiazole, benzofuro[2,3-d]thiazole, benzothien[5,6-d]oxazole, benzothien[6,5-d]oxazole or benzothien[2,3-d]oxazole. As a preferred tetracyclic condensed-ring-type heterocycle, there can be mentioned, for example, anthr[2,3-d]oxazole, anthr[1,2-d]oxazole, anthr[2,1-d]oxazole, anthra[2,3-d]thiazole, anthra[1,2-d]thiazole, phenanthro[2,1-d]thiazole, phenanthr[2,3-d]imidazole, anthr[1,2-d]imidazole, anthr[2,1-d]imidazole, anthra[2,3-d]selenazole, phenanthro[1,2-d]selenazole, phenanthro[2,1-d]selenazole, carbazol[2,3-d]oxazole, carbazol[3,2-d]oxazole, dibenzofur[2,3-d]oxazole, dibenzofur[3,2-d]oxazole, carbazolo[2,3-d]thiazole, carbazolo[3,2-d]thiazole, dibenzofuro[2,3-d]thiazole, dibenzofuro[3,2-d]thiazole, benzofur[5,6-d]oxazole, dibenzothien[2,3-d]oxazole, dibenzothien[3,2-d]oxazole, tetrahydrocarbazol[6,7-d]oxazole, tetrahydrocarbazol[7,6-d]oxazole, dibenzothieno[2,3-d]thiazole, dibenzothieno[3,2-d]thiazole or tetrahydrocarbazolo[6,7-d]thiazole. The basic nucleus resulting from condensation of three or more rings is more preferably selected from among naphth[2,3-d]oxazole, naphth[1,2-d]oxazole, naphth[2,1-d]oxazole, naphtho[2,3-d]thiazole, naphtho[1,2-d]thiazole, naphtho[2,1-d]thiazole, indol[5,6-d]oxazole, indol[6,5-d]oxazole, indol[2,3-d]oxazole, indolo[5,6-d]thiazole, indolo[2,3-d]thiazole, benzofur[5,6-d]oxazole, benzofur[6,5-d]oxazole, benzofur[2,3-d]oxazole, benzofuro[5,6-d]thiazole, benzofuro[2,3-d]thiazole, benzothien[5,6-d]oxazole, anthr[2,3-d]oxazole, anthr[1,2-d]oxazole, anthra[2,3-d]thiazole, anthra[1,2-d]thiazole, carbazol[2,3-d]oxazole, carbazol[3,2-d]oxazole, dibenzofur[2,3-d]oxazole, dibenzofur[3,2-d]oxazole, carbazolo[2,3-d]thiazole, carbazolo[3,2-d]thiazole, dibenzofuro[2,3-d]thiazole, dibenzofuro[3,2-d]thiazole, dibenzothien[2,3-d]oxazole and dibenzothien[3,2-d]oxazole. The basic nucleus resulting from condensation of three or more rings is most preferably selected from among naphth[2,3-d]oxazole, naphth[1,2-d]oxazole, naphtho[2,3-d]thiazole, indol[5,6-d]oxazole, indol[6,5-d]oxazole, indolo[5,6-d]thiazole, benzofur[5,6-d]oxazole, benzofuro[5,6-d]thiazole, benzofuro[2,3-d]thiazole, benzothien[5,6-d]oxazole, carbazol[2,3-d]oxazole, carbazol[3,2-d]oxazole, dibenzofur[2,3-d]oxazole, dibenzofur[3,2-d]oxazole, carbazolo[2,3-d]thiazole, carbazolo[3,2-d]thiazole, dibenzofuro[2,3-d]thiazole, dibenzofuro[3,2-d]thiazole, dibenzothien[2,3-d]oxazole and dibenzothien[3,2-d]oxazole.

Another preferable method for realizing such a state of adsorption that the surface of silver halide grains is coated with a multilayer of dye chromophores comprises utilizing a dye compound having two or more dye chromophore portions connected to each other by a covalent bond through a connecting group. Usable dye chromophores are not particularly limited, and, for example, the aforementioned dye chromophores can be employed. The aforementioned polymethine dye chromophores are preferred. More preferred are a cyanine dye, a merocyanine dye, a rhodacyanine dye and an oxonol dye. Most preferred are a cyanine dye, a rhodacyanine dye and a merocyanine dye. A cyanine dye is optimal.

Preferred examples thereof include the method of using dyes connected to each other by methine chains as described in JP-A-9-265144, the method of using a dye comprising oxonol dyes connected to each other as described in JP-A-10-226758, the method of using connected dyes of specified structure as described in JP-A's-10-110107, 10-307358, 10-307359 and 10-310715, the method of using connected dyes having specified connecting groups as described in JP-A's-9-265143 and 10-204306, the method of using connected dyes of specified structure as described in JP-A's-2000-231174, 2000-231172 and 2000-231173, and the method of using a dye having a reactive group to thereby form a connected dye in the emulsion as described in JP-A-2000-081678.

As preferred connected dyes, there can be mentioned those of the following general formula (III).

$$D_1\text{-}(La\text{-}[D_2]q)r \qquad \text{III}$$

$$M_3m_3$$

In the formula, each of $D_1$ and $D_2$ represents a dye chromophore. La represents a connecting group or a single bond, and each of q and r is an integer of 1 to 100. $M_3$ represents a charge balance counter ion, and $m_3$ is a number required to neutralize a molecular charge.

$D_1$, $D_2$ and La will be described in greater detail.

The dye chromophore represented by $D_1$ or $D_2$ is not particularly limited, and, for example, the aforementioned dye chromophores can be employed. The aforementioned polymethine dye chromophores are preferred. More preferred are a cyanine dye, a merocyanine dye, a rhodacyanine dye and an oxonol dye. Most preferred are a cyanine dye, a merocyanine dye and a rhodacyanine dye. A cyanine dye is optimal.

As preferred general formulae for dyes, there can be mentioned those given on pages 32 to 36 of U.S. Pat. No. 5,994,051 and on pages 30 to 34 of U.S. Pat. No. 5,747,236. As preferred general formulae for cyanine dyes, merocyanine dyes and rhodacyanine dyes, there can be mentioned those given on columns 21 and 22 of U.S. Pat. No. 5,340,694 ((XI), (XII) and (XIII) wherein n12, n15, n17 and n18 are numbers not particularly limited, for example, an integer of 0 or greater (preferably 4 or less)).

In the present invention, when the connected dye of the general formula (III) is adsorbed on silver halide grains, it is preferred that $D_2$ be a chromophore not directly adsorbed on silver halides.

That is, it is preferred that the adsorptive force of $D_2$ to silver halide grains be smaller than that of $D_1$. Further, it is most preferred that the adsorptive force to silver halide grains be in the order of $D_1$>La>$D_2$.

Although, as aforementioned, $D_1$ is preferably a sensitizing dye moiety having adsorptivity to silver halide grains, the adsorption thereof can equally be effected by a physical adsorption or a chemical adsorption.

Preferably, $D_2$ exhibits low adsorptivity to silver halide grains and consists of a luminescent dye. With respect to the type of luminescent dye, those having the skeletal structure of dye for use in dye laser are preferred. These are pigeonholed in, for example, Mitsuo Maeda, Laser Kenkyu (Laser Research), vol. 8, pp. 694, 803 and 958 (1980) and ibid, vol. 9, page 85 (1981), and F. Sehaefer, "Dye Lasers", Springer (1973).

Moreover, it is preferred that the absorption maximum wavelength of $D_1$ in the silver halide photographic light-sensitive material be greater than that of $D_2$. Further, preferably, the light emission of $D_2$ and the absorption of $D_1$ overlap each other. Also, it is preferred that $D_1$ form a J-association product. Still further, for enabling the connected dye of the general formula (III) to exhibit absorption and spectral sensitivity within desired wavelength ranges, it is preferred that $D_2$ also form a J-association product.

Although the reduction potentials and oxidation potentials of $D_1$ and $D_2$ are not limited, it is preferred that the reduction potential of $D_1$ be noble to the value of reduction potential of $D_2$ minus 0.2V.

La represents a connecting group (preferably a divalent connecting group) or a single bond. This connecting group preferably consists of an atom or atomic group including at least one member selected from among a carbon atom, a nitrogen atom, a sulfur atom and an oxygen atom. Also, the connecting group is preferably one having 0 to 100 carbon atoms, more preferably 1 to 20 carbon atoms, constituted of one member or a combination of at least two members selected from among an alkylene group (e.g., methylene, ethylene, propylene, butylene or pentylene), an arylene group (e.g., phenylene or naphthylene), an alkenylene group (e.g., ethenylene or propenylene), an alkynylene group (e.g., ethynylene or propynylene), an amido group, an ester group, a sulfoamido group, a sulfonic ester group, a ureido group, a sulfonyl group, a sulfinyl group, a thioether group, an ether group, a carbonyl group, —N(Va)— (Va represents a hydrogen atom or a monovalent substituent; as the monovalent substituent, there can be mentioned V described later) and a heterocyclic bivalent group (e.g., 6-chloro-1,3,5-triazine-2,4-diyl group, pyrimidine-2,4-diyl group or quinoxarine-2,3-diyl group).

The above connecting group may further have a substituent represented by V described later, and may contain a ring (aromatic or nonaromatic hydrocarbon ring or heterocycle).

As more preferred connecting groups, there can be mentioned alkylene groups each having 1 to 10 carbon atoms (e.g., methylene, ethylene, propylene and butylene), arylene groups each having 6 to 10 carbon atoms (e.g., phenylene and naphthylene), alkenylene groups each having 2 to 10 carbon atoms (e.g., ethenylene and propenylene), alkynylene groups each having 2 to 10 carbon atoms (e.g., ethynylene and propynylene), and bivalent substituents each comprising one member or a combination of two or more members selected from among an ether group, an amido group, an ester group, a sulfoamido group and a sulfonic ester group and having 1 to 10 carbon atoms. These may be substituted with V described later.

La is a connecting group which may induce an energy transfer or electron moving by through-bond interaction. The through-bond interaction includes, for example, tunnel interaction and super-exchange interaction. Especially, the through-bond interaction based on super-exchange interaction is preferred. The through-bond interaction and super-exchange interaction are as defined in Shammai Speiser, Chem. Rev., vol. 96, pp. 1960–1963, 1996. As the connecting group capable of inducing an energy transfer or electron moving by such an interaction, there can preferably be employed those described in Shammai Speiser, Chem. Rev., vol. 96, pp. 1967–1969, 1996.

Each of q and r is an integer of 1 to 100, preferably 1 to 5, more preferably 1 or 2, and most preferably 1. When q and r are 2 or greater, the contained plurality of La's and $D_2$'s may represent connecting groups and dye chromophores which are different from each other, respectively.

The dyes of the general formula (III) preferably have a charge of −1 as a whole.

More preferably, in the general formula (III), each of $D_1$ and $D_2$ independently represents a methine dye represented by the following general formula (IV), (V), (VI) or (VII).

IV

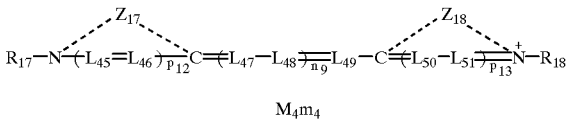

$M_4m_4$

In the general formula (IV), each of $L_{45}$, $L_{46}$, $L_{47}$, $L_{48}$, $L_{49}$, $L_{50}$ and $L_{51}$ represents a methine group, each of $p_{12}$ and $p_{13}$ is 0 or 1, and $n_9$ is 0, 1, 2, 3 or 4. Each of $Z_{17}$ and $Z_{18}$ represents an atomic group needed to form a nitrogenous heterocycle, provided that a ring condensation may have been effected thereto. $M_4$ represents a charge balance counter ion, and $m_4$ is a number of 0 or greater required to neutralize a molecular charge. Each of $R_{17}$ and $R_{18}$ represents an alkyl group, an aryl group or a heterocyclic group.

V

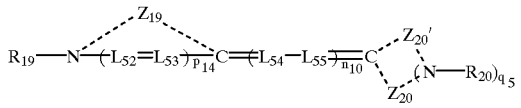

$M_5m_5$

In the general formula (V), each of $L_{52}$, $L_{53}$, $L_{54}$ and $L_{55}$ represents a methine group, $p_{14}$ is 0 or 1, $q_5$ is 0 or 1, and $n_{10}$ is 0, 1, 2, 3 or 4. $Z_{19}$ represents an atomic group needed to form a nitrogenous heterocycle, and $Z_{20}$ and $Z_{20}'$ represent atomic groups needed to form a heterocycle or a noncyclic acid terminal in cooperation with $(N—R_{20})q_5$, provided that a ring condensation may have been effected to $Z_{19}$ and $Z_{20}$ and $Z_{20}'$. $M_5$ represents a charge balance counter ion, and $m_5$ is a number of 0 or greater required to neutralize a molecular charge. Each of $R_{19}$ and $R_{20}$ represents an alkyl group, an aryl group or a heterocyclic group.

$D_2$ of the general formula (III) preferably represents a methine dye of the above general formula (IV), (V) or (VII), more preferably a methine dye of the general formula (IV) or (V), and most preferably a methine dye of the general formula (IV).

The methine compounds represented by the general formulae (I) (including formulae I-1,2,3), (II) (including formulae II-1,2,3), (IV), (V), (VI) and (VII) will be described in detail below.

In the general formulae (I) and (II), each of $Q_1$ and $Q_2$ represents a group needed to form a methine dye. As methine dyes, although any type thereof can be formed by selecting $Q_1$ and $Q_2$, there can be mentioned those set out hereinbefore as examples of dye chromophores.

As preferred methine dyes, there can be mentioned, for example, a cyanine dye, a merocyanine dye, a rhodacyanine dye, a trinuclear merocyanine dye, a tetranuclear merocyanine dye, an allopolar dye, a hemicyanine dye and a styryl dye. As more preferred methine dyes, there can be mentioned a cyanine dye, a merocyanine dye and a rhodacyanine dye. A cyanine dye is most preferred. Details of these dyes are described in, for example, F. M. Harmer, "Heterocyclic Compounds-Cyanine Dyes and Related Compounds", John Wiley & Sons, New York, London, 1964 and D. M. Sturmer, "Heterocyclic Compounds-Special topics in heterocyclic chemistry", chapter 18, section 14, pages 482 to 515.

As general formulae for preferred dyes, there can be mentioned those given on pages 32 to 36 of U.S. Pat. No. 5,994,051 and those given on pages 30 to 34 of U.S. Pat. No. 5,747,236. As general formulae for preferred cyanine dye, merocyanine dye and rhodacyanine dye, there can be mentioned those given in U.S. Pat. No. 5,340,694, columns 21 to 22, (XI), (XII) and (XIII) (wherein the numbers n12, n15, n17 and n18 are not limited, for example, an integer of 0 or greater (preferably 4 or less)).

With respect to the general formulae (I) and (II), when a cyanine dye or a rhodacyanine dye is formed by $Q_1$ and $Q_2$, they can be expressed by the following resonance formulae.

VI

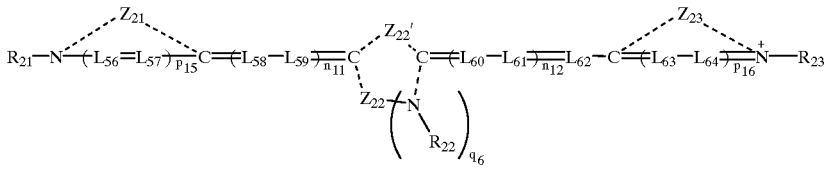

$M_6m_6$

In the general formula (VI), each of $L_{56}$, $L_{57}$, $L_{58}$, $L_{59}$, $L_{60}$, $L_{61}$, $L_{62}$, $L_{63}$ and $L_{64}$ represents a methine group, each of $p_{15}$ and $p_{16}$ is 0 or 1, $q_6$ is 0 or 1, and each of $n_{11}$ and $n_{12}$ is 0, 1, 2, 3 or 4. Each of $Z_{21}$ and $Z_{23}$ represents an atomic group needed to form a nitrogenous heterocycle, and $Z_{22}$ and $Z_{22}'$ represent atomic groups needed to form a heterocycle in cooperation with $(N—R_{22})q_6$, provided that a ring condensation may have been effected to $Z_{21}$, $Z_{22}$ and $Z_{22}'$, and $Z_{23}$. $M_6$ represents a charge balance counter ion, and $m_6$ is a number of 0 or greater required to neutralize a molecular charge. Each of $R_{21}$, $R_{22}$ and $R_{23}$ represents an alkyl group, an aryl group or a heterocyclic group.

VII

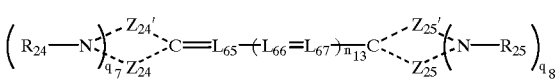

$M_7m_7$

In the general formula (VII), each of $L_{65}$, $L_{66}$ and $L_{67}$ represents a methine group, each of $q_7$ and $q_8$ is 0 or 1, and $n_{13}$ is 0, 1, 2, 3 or 4. $Z_{24}$ and $Z_{24}'$, and $Z_{25}$ and $Z_{25}'$, represent atomic groups needed to form a heterocycle or a noncyclic acid terminal in cooperation with $(N—R_{24})q_7$ and $(N—R_{25})q_8$, respectively, provided that a ring condensation may have been effected to $Z_{24}$ and $Z_{24}'$, and $Z_{25}$ and $Z_{25}'$. $M_7$ represents a charge balance counter ion, and $m_7$ is a number of 0 or greater required to neutralize a molecular charge. Each of $R_{24}$ and $R_{25}$ represents an alkyl group, an aryl group or a heterocyclic group.

$D_1$ of the general formula (III) preferably represents a methine dye of the above general formula (IV), (V) or (VI), more preferably a methine dye of the general formula (IV).

I

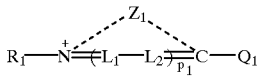

$M_1m_1$

II

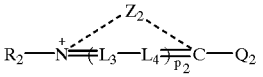

$M_2m_2$

In the general formulae (I), (II), (IV), (V) and (VI), each of $Z_1$, $Z_2$, $Z_3$, $Z_4$, $Z_5$, $Z_7$, $Z_9$, $Z_{10}$, $Z_{11}$, $Z_{12}$, $Z_{14}$, $Z_{16}$, $Z_{17}$, $Z_{18}$, $Z_{19}$, $Z_{21}$ and $Z_{23}$ represents an atomic group needed to form a nitrogenous heterocycle, preferably a 5 or 6-membered nitrogenous heterocycle, provided that a ring condensation may have been effected thereto. The ring may be an aromatic or a nonaromatic ring, preferably an aromatic ring. For example, it can be a hydrocarbon aromatic ring such as a benzene ring or a naphthalene ring, or a heteroaromatic ring such as a pyrazine ring or a thiophene ring.

The nitrogenous heterocycle can be, for example, any of a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus. Of these, a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, a 2-quinoline nucleus, a 4-quinoline nucleus, a 1-isoquinoline nucleus and a 3-isoquinoline nucleus are preferred. A benzothiazole nucleus, a benzoxazole nucleus, a 3,3-dialkylindolenine nucleus (e.g., 3,3-dimethylindolenine) and a benzimidazole nucleus are more preferred. A benzoxazole nucleus, a benzothiazole nucleus and a benzimidazole nucleus are still more preferred. A benzoxazole nucleus and a benzothiazole nucleus are most preferred.

These nitrogenous heterocycle may have a substituent represented by V. The substituent represented by V, although not particularly limited, can be, for example, a halogen atom, an alkyl group (including a cycloalkyl and a bicycloalkyl), an alkenyl group (including a cycloalkenyl and a bicycloalkenyl), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including anilino), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclic thio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclic azo group, an imido group, a phosphino group, a phosphinyl group, a phosphinyloxy group, a phosphinylamino group, or a silyl group.

More specifically, the substituent represented by V can be a halogen atom (e.g., a chlorine atom, a bromine atom or an iodine atom); an alkyl group [representing a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, alkyl of alkylthio group) also means the alkyl group of this concept]; an alkenyl group [representing a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; an alkynyl group (preferably a substituted or unsubstituted alkynyl group having 2 to 30 carbon atoms, such as ethynyl, propargyl or trimethylsilylethynyl); an aryl group (preferably a substituted or unsubstituted aryl group having 6 to 30 carbon atoms, such as phenyl, p-tolyl, naphthyl, m-chlorophenyl or o-hexadecanoylaminophenyl); a heterocyclic group (preferably a monovalent group corresponding to a 5- or 6-membered substituted or unsubstituted aromatic or nonaromatic heterocyclic compound from which one hydrogen atom is removed, more preferably a 5- or 6-membered aromatic heterocyclic group having 3 to 30 carbon atoms, such as 2-furyl, 2-thienyl, 2-pyrimidinyl or 2-benzothiazolyl); a cyano group; a hydroxyl group; a nitro group; a carboxyl group; an alkoxy group (preferably a substituted or unsubstituted alkoxy group having 1 to 30 carbon atoms, such as methoxy, ethoxy, isopropoxy, t-butoxy, n-octyloxy or 2-methoxyethoxy); an aryloxy group (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); a silyloxy group (preferably a silyloxy group having 3 to 20 carbon atoms, such as trimethylsilyloxy or t-butyldimethylsilyloxy); a heterocyclic oxy group (preferably a substituted or unsubstituted heterocyclic oxy group having 2 to 30 carbon atoms, such as 1-phenyltetrazol-5-oxy or 2-tetrahydropyranyloxy); an acyloxy group (preferably a formyloxy group, a substituted or unsubstituted alkylcarbonyloxy group having 2 to 30 carbon atoms or a substituted or unsubstituted arylcarbonyloxy group having 6 to 30 carbon atoms, such as formyloxy, acetyloxy, pivaloyloxy, stearoyloxy, benzoyloxy or n-methoxyphenylcarbonyloxy); a carbamoyloxy group (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); an alkoxycarbonyloxy group (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); an aryloxycarbonyloxy group (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); an amino group (preferably an amino group, a substituted or unsubstituted alkylamino group having 1 to 30 carbon atoms or a substituted or unsubstituted anilino group having 6 to 30 carbon atoms, such as amino, methylamino, dimethylamino, anilino, N-methylanilino or diphenylamino); an acylamino group (preferably an formylamino group, a substituted or unsubstituted alkylcarbonylamino group having 1 to 30 carbon atoms or a substituted or unsubstituted arylcarbonylamino group having 6 to 30 carbon atoms, such as formylamino, acetylamino, pivaloylamino, lauroylamino, benzoylamino or 3,4,5-tri-n-octyloxyphenylcarbonylamino); an aminocarbonylamino group (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); an alkoxycarbonylamino group (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methylmethoxycarbonylamino); an aryloxycarbonylamino group (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); a sulfamoylamino group (preferably a substituted or unsubstituted sulfamoylamino group having 0 to 30 carbon atoms, such as sulfamoylamino, N,N-dimethylaminosulfonylamino or N-n-octylaminosulfonylamino); an alkyl- or arylsulfonylamino group (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; an alkylthio group (preferably a substituted or unsubstituted alkylthio group having 1 to 30 carbon atoms, such as methylthio, ethylthio or n-hexadecylthio); an arylthio group (preferably a substituted or unsubstituted arylthio group having 6 to 30 carbon atoms, such as phenylthio, p-chlorophenylthio or m-methoxyphenylthio); a heterocyclic thio group (preferably a substituted or unsubstituted heterocyclic thio group having 2 to 30 carbon atoms, such as 2-benzothiazolylthio or 1-phenyltetrazol-5-ylthio); a sulfamoyl group (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; an alkyl- or arylsulfinyl group (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); an alkyl- or arylsulfonyl group (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); an acyl group (preferably a formyl group, a substituted or unsubstituted alkylcarbonyl group having 2 to 30 carbon atoms, a substituted or unsubstituted arylcarbonyl group having 7 to 30 carbon atoms or a substituted or unsubstituted heterocyclic carbonyl group having 4 to 30 carbon atoms wherein a carbonyl group is bonded at carbon atom, such as acetyl, pivaloyl, 2-chloroacetyl, stearoyl, benzoyl, p-n-octyloxyphenylcarbonyl, 2-pyridylcarbonyl or 2-furylcarbonyl); an aryloxycarbonyl group (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); an alkoxycarbonyl group (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); a carbamoyl group (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); an aryl- or heterocyclic azo group (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); an imido group (preferably N-succinimido or N-phthalimido); a phosphino group (preferably a substituted or unsubstituted phosphino group having 2 to 30 carbon atoms, such as dimethylphosphino, diphenylphosphino or methylphenoxyphosphino); a phosphinyl group (preferably a substituted or unsubstituted phosphinyl group having 2 to 30 carbon atoms, such as phosphinyl, dioctyloxyphosphinyl or diethoxyphosphinyl); a phosphinyloxy group (preferably a substituted or unsubstituted phosphinyloxy group having 2 to 30 carbon atoms, such as diphenoxyphosphinyloxy or dioctyloxyphosphinyloxy); a phosphinylamino group (preferably a substituted or unsubstituted phosphinylamino group having 2 to 30 carbon atoms, such as dimethoxyphosphinylamino or dimethylaminophosphinylamino); or a silyl group (preferably a substituted or unsubstituted silyl group having 3 to 30 carbon atoms, such as trimethylsilyl, t-butyldimethylsilyl or phenyldimethylsilyl).

The substituent represented by V can have the structure of a condensate of rings (including aromatic and nonaromatic hydrocarbon rings and heterocycles, and further including polycyclic condensed rings resulting from combination thereof; for example, a benzene ring, a naphthalene ring, an anthracene ring, a quinoline ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthyridine ring, a quinoxaline ring, a quinoxazoline ring, a quinoline ring, a carbazole ring, a phenanthridine ring, an acridine ring, a phenanthroline ring, a thianthrene ring, a chromene ring, a xanthene ring, a phenoxathiin ring, a phenothiazine ring and a phenazine ring).

With respect to those having a hydrogen atom among the above-listed functional groups, the hydrogen atom may be replaced by any of the above-listed groups. Examples of such functional groups include an alkylcarbonylaminosulfonyl group, an arylcarbonylaminosulfonyl group, an alkylsulfonylaminocarbonyl group and an arylsulfonylaminocarbonyl group. Specific examples thereof include methylsulfonylaminocarbonyl, p-methylphenylsulfonylaminocarbonyl, acetylaminosulfonyl and benzoylaminosulfonyl groups.

As preferred substituents, there can be mentioned the above-listed alkyl group, aryl group, alkoxy group, halogen atom, aromatic ring condensate, sulfo group, carboxyl group and hydroxy group.

The substituent V on $Z_1$, $Z_2$, $Z_3$, $Z_4$, $Z_5$, $Z_7$, $Z_9$, $Z_{10}$, $Z_{11}$, $Z_{12}$, $Z_{14}$ and $Z_{16}$ is more preferably an aromatic group or an aromatic ring condensate.

When the methine dye of the general formula (IV), (V) or (VI) represents the chromophore represented by $D_1$ of the general formula (III), the substituent V on $Z_{17}$, $Z_{18}$, $Z_{19}$, $Z_{21}$ and $Z_{23}$ is more preferably an aromatic group or an aromatic ring condensate.

When the methine dye of the general formula (IV), (V) or (VI) represents the chromophore represented by $D_2$ of the general formula (III), the substituent V on $Z_{17}$, $Z_{18}$, $Z_{19}$, $Z_{21}$ and $Z_{23}$ is more preferably a carboxy group, a sulfo group or a hydroxy group, and most preferably a sulfo group.

Each of combinations of $Z_6$ and $Z_6'$ with $(N—R_6)q_1$, $Z_{13}$ and $Z_{13}'$ with $(N—R_{13})q_3$, $Z_{20}$ and $Z_{20}'$ with $(N—R_{20})q_5$, $Z_{24}$ and $Z_{24}'$ with $(N—R_{24})q_7$, and $Z_{25}$ and $Z_{25}'$ with $(N—R_{25})q_8$ represent atomic groups needed to form a heterocycle or a noncyclic acid terminal. The heterocycle (preferably 5 or 6-membered heterocycle), although not limited, is preferably an acid nucleus. Below, the acid nucleus and noncyclic acid terminal will be described. The acid nucleus and noncyclic acid terminal can have the form of any common acid nucleus and noncyclic acid terminal of merocyanine dye. In preferred form, each of $Z_6$, $Z_{13}$, $Z_{20}$, $Z_{24}$ and $Z_{25}$ represents a thiocarbonyl group, a carbonyl group, an ester group, an acyl group, a carbamoyl group, a cyano group or a sulfonyl group, and more preferably represents a thiocarbonyl group or a carbonyl group. Each of $Z_6'$, $Z_{13}'$, $Z_{20}'$ and $Z_{24}'$ represents a remaining moiety of atomic group needed to form the acid nucleus and noncyclic acid terminal. In the formation of a noncyclic acid terminal, it is preferred that, for example, a thiocarbonyl group, a carbonyl group, an ester group, an acyl group, a carbamoyl group, a cyano group or a sulfonyl group be represented thereby.

Each of $q_1$, $q_3$, $q_5$, $q_7$ and $q_8$ is 0 or 1, preferably 1.

The acid nucleus and noncyclic acid terminal mentioned herein are described on, for example, pages 198 to 200 of T. H. James, The Theory of the Photographic Process, 4th ed., Macmillan, 1977. Herein, the noncyclic acid terminal refers to an acid, namely, electron acceptant terminal which does not form any ring. Particulars of the acid nucleus and noncyclic acid terminal are described in, for example, U.S. Pat. Nos. 3,567,719, 3,575,869, 3,804,634, 3,837,862, 4,002,480 and 4,925,777, JP-A-3-167546, and U.S. Pat. Nos. 5,994,051 and 5,747,236.

The acid nucleus is preferred when a heterocycle (preferably a 5 or 6-membered nitrogenous heterocycle) consisting of carbon, nitrogen and/or chalcogen (typically, oxygen, sulfur, selenium and tellurium) atoms is formed, and is more preferred when a 5 or 6-membered nitrogenous heterocycle consisting of carbon, nitrogen and/or chalcogen (typically, oxygen, sulfur, selenium and tellurium) atoms is formed. For example, there can be mentioned the following acid nuclei:

2-pyrazolin-5-one, pyrazolidine-3,5-dione, imidazolin-5-one, hydantoin, 2 or 4-thiohydantoin, 2-iminoxazolidin-4-one, 2-oxazolin-5-one, 2-thioxazolidine-2,5-dione, 2-thioxazoline-2,4-dione, isoxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide nuclei; and nuclei having an exomethylene structure resulting from substitution of a carbonyl group or thiocarbonyl group as a constituent of these nuclei at an active methylene site of acid nucleus, and nuclei having an exomethylene structure resulting from substitution at an active methylene site of active methylene compound having the structure of, for example, a cyanomethylene or ketomethylene as a feedstock of noncyclic acid terminal.

Ring condensation or substitution by rings or substituents listed above with respect to the substituent V may be effected to these acid nuclei and noncyclic acid terminals.

As preferred combinations of $Z_6$ and $Z_6'$ with $(N—R_6)q_1$, $Z_{13}$ and $Z_{13}'$ with $(N—R_{13})q_3$, $Z_{20}$ and $Z_{20}'$ with $(N—R_{20})q_5$, $Z_{24}$ and $Z_{24}'$ with $(N—R_{24})q_7$, and $Z_{25}$ and $Z_{25}'$ with $(N—R_{25})q_8$, there can be mentioned hydantoin, 2 or 4-thiohydantoin, 2-oxazolin-5-one, 2-thioxazoline-2,4-dione, thiazolidine-2,4-dione, rhodanine, thiazolidine-2,4-dithione, barbituric acid and 2-thiobarbituric acid. As more preferred combinations, there can be mentioned hydantoin, 2 or 4-thiohydantoin, 2-oxazolin-5-one, rhodanine, barbituric acid and 2-thiobarbituric acid. As most preferred combinations, there can be mentioned 2 or 4-thiohydantoin, 2-oxazolin-5-one, rhodanine and barbituric acid.

Heterocycles formed by combinations of $Z_8$ and $Z_8'$ with $(N—R_8)q_2$, $Z_{15}$ and $Z_{15}'$ with $(N—R_{15})q_4$ and $Z_{22}$ and $Z_{22}'$ with $(N—R_{22})q_6$ can be the same as listed above as the heterocycles by combinations of $Z_6$ and $Z_6'$ with $(N—R_6)q_1$, $Z_{13}$ and $Z_{13}'$ with $(N—R_{13})q_3$, $Z_{20}$ and $Z_{20}'$ with $(N—R_{20})q_5$, $Z_{24}$ and $Z_{24}'$ with $(N—R_{24})q_7$, and $Z_{25}$ and $Z_{25}'$ with $(N—R_{25})q_8$. As preferred heterocycles, there can be mentioned those obtained by removing an oxo group or a thioxo group from the acid nuclei listed above with respect to the heterocycles by combinations of $Z_6$ and $Z_6'$ with $(N—R_6)q_1$, $Z_{13}$ and $Z_{13}'$ with $(N—R_{13})q_3$, $Z_{20}$ and $Z_{20}'$ with $(N—R_{20})q_5$, $Z_{24}$ and $Z_{24}'$ with $(N—R_{24})q_7$, and $Z_{25}$ and $Z_{25}'$ with $(N—R_{25})q_8$.

As more preferred heterocycles, there can be mentioned those obtained by removing an oxo group or a thioxo group from the acid nuclei listed above as specific examples of combinations of $Z_6$ and $Z_6'$ with $(N—R_6)q_1$, $Z_{13}$ and $Z_{13}'$ with $(N—R_{13})q_3$, $Z_{20}$ and $Z_{20}'$ with $(N—R_{20})q_5$, $Z_{24}$ and $Z_{24}'$ with $(N—R_{24})q_7$, and $Z_{25}$ and $Z_{25}'$ with $(N—R_{25})q_8$.

As still more preferred heterocycles, there can be mentioned those obtained by removing an oxo group or a thioxo group from hydantoin, 2 or 4-thiohydantoin, 2_oxazolin-5-one, 2-thioxazoline-2,4-dione, thiazolidine-2,4-dione, rhodanine, thiazolidine-2,4-dithione, barbituric acid and 2-thiobarbituric acid. As yet still more preferred heterocycles, there can be mentioned those obtained by removing an oxo group or a thioxo group from hydantoin, 2 or 4-thiohydantoin, 2-oxazolin-5-one, rhodanine, barbituric acid and 2-thiobarbituric acid. As most preferred heterocycles, there can be mentioned those obtained by removing an oxo group or a thioxo group from 2 or 4-thiohydantoin, 2-oxazolin-5-one and rhodanine.

Each of $q_2$, $q_4$ and $q_6$ is 0 or 1, preferably 1.

Each of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$ and $R_{25}$ represents an alkyl group, an aryl group or a heterocyclic group. Specifically, each represents, for example, an unsubstituted alkyl group having 1 to 18, preferably 1 to 7, and more preferably 1 to 4 carbon atoms (e.g., methyl, ethyl, propyl, isopropyl, butyl, isobutyl, hexyl, octyl, dodecyl or octadecyl); a substituted alkyl group having 1 to 18, preferably 1 to 7, and more preferably 1 to 4 carbon atoms {for example, an alkyl group substituted with the above substituent V, preferably an aralkyl group (e.g., benzyl or 2-phenylethyl), an unsaturated hydrocarbon group (e.g., allyl), a hydroxyalkyl group (e.g., 2-hydroxyethyl or 3-hydroxypropyl), a carboxyalkyl group (e.g., 2-carboxyethyl, 3-carboxypropyl, 4-carboxybutyl or carboxymethyl), an alkoxyalkyl group (e.g., 2-methoxyethyl or 2-(2-methoxyethoxy)ethyl), an aryloxyalkyl group (e.g., 2-phenoxyethyl or 2-(1-naphthoxy)ethyl), an alkoxycarbonylalkyl group (e.g., ethoxycarbonylmethyl or 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl or 3-sulfopropoxyethoxyethyl), a sulfoalkenyl group, a sulfatoalkyl group (e.g., 2-sulfatoethyl, 3-sulfatopropyl or 4-sulfatobutyl), a heterocycle-substituted alkyl group (e.g., 2-(pyrrolidin-2-on-1-yl)ethyl or tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), or an alkylsulfonylsulfamoylalkyl group (e.g., methanesulfonylsulfamoylmethyl) }; an unsubstituted aryl group having 6 to 20, preferably 6 to 10, and more preferably 6 to 8 carbon atoms (e.g., phenyl or 1-naphthyl); a substituted aryl group having 6 to 20, preferably 6 to 10, and more preferably 6 to 8 carbon atoms (for example, an aryl group substituted with the above V mentioned as substituent examples, such as p-mehtoxyphenyl, p-methylphenyl or p-chlorophenyl); an unsubstituted heterocyclic group having 1 to 20, preferably 3 to 10, and more preferably 4 to 8 carbon atoms (e.g., 2-furyl, 2-thienyl, 2-pyridyl, 3-pyrazolyl, 3-isoxazolyl, 3-isothiazolyl, 2-imidazolyl, 3-oxazolyl, 2-thiazolyl, 2-pyridazyl, 2-pyrimidyl, 3-pyrazyl, 2-(1,3,5-triazolyl), 3-(1,2,4-triazolyl) or 5-tetrazolyl); or a substituted heterocyclic group having 1 to 20, preferably 3 to 10, and more preferably 4 to 8 carbon atoms (for example, a heterocyclic group substituted with the above V mentioned as substituent examples, such as 5-methyl-2-thienyl or 4-methoxy-2-pyridyl).

Each of $R_1$, $R_3$, $R_4$, $R_5$, $R_6$, $R_7$, $R_8$ and $R_9$ preferably represents a group having an aromatic ring. The aromatic ring can be a hydrocarbon aromatic ring or a heteroaromatic ring, which, further, may be a polycyclic condensed ring resulting from mutual condensation of hydrocarbon aromatic rings or heteroaromatic rings, or a polycyclic condensed ring consisting of a combination of an aromatic hydrocarbon ring and an aromatic heterocycle. The aromatic ring may be substituted with the above-listed substituent V. As preferred aromatic rings, there can be mentioned those listed as aromatic ring examples in the above description of aromatic groups.

The group having an aromatic ring can be represented by the formula —Lb—$A_1$—, wherein Lb represents a single bond or a connecting group. $A_1$ represents an aromatic group. As preferred Lb connecting groups, there can be mentioned those described above as being represented by La. As preferred $A_1$ aromatic groups, there can be mentioned those listed above as aromatic group examples.

Preferably, as an alkyl group having a hydrocarbon aromatic ring, there can be mentioned, for example, an aralkyl group (e.g., benzyl, 2-phenylethyl, naphthylmethyl or 2-(4-biphenyl)ethyl), an aryloxyalkyl group (e.g., 2-phenoxyethyl, 2-(1-naphthoxy)ethyl, 2-(4-biphenyloxy)ethyl, 2-(o, m or p-halophenoxy)ethyl or 2-(o, m or p-methoxyphenoxy)ethyl)), or an aryloxycarbonylalkyl group (3-phenoxycarbonylpropyl or 2-(1-naphthoxycarbonyl)ethyl). Further, as an alkyl group having a heteroaromatic ring, there can be mentioned, for example, 2-(2-pyridyl)ethyl, 2-(4-pyridyl)ethyl, 2-(2-furyl)ethyl, 2-(2-thienyl)ethyl or 2-(2-pyridylmethoxy)ethyl. The hydrocarbon aromatic group can be, for example, 4-methoxyphenyl, phenyl, naphthyl or biphenyl. The heteroaromatic group can be, for example, 2-thienyl, 4-chloro-2-thienyl, 2-pyridyl or 3-pyrazolyl.

More preferably, the group having an aromatic ring is the above alkyl group having a substituted or unsubstituted hydrocarbon aromatic ring or heteroaromatic ring. Most preferably, the group having an aromatic ring is the above alkyl group having a substituted or unsubstituted hydrocarbon aromatic ring.

Each of $R_2$, $R_{10}$, $R_{11}$, $R_{12}$, $R_{13}$, $R_{14}$, $R_{15}$ and $R_{16}$ preferably represents a group having an aromatic ring. Both of $R_{10}$ and $R_{11}$, at least one of $R_{12}$ and $R_{13}$, and at least one of $R_{14}$, $R_{15}$ and $R_{16}$, has an anionic substituent. $R_2$ preferably has an anionic substituent. The aromatic ring can be a hydrocarbon aromatic ring or a heteroaromatic ring, which, further, may be a polycyclic condensed ring resulting from mutual condensation of hydrocarbon aromatic rings or heteroaromatic rings, or a polycyclic condensed ring consisting of a combination of an aromatic hydrocarbon ring and an aromatic heterocycle. The aromatic ring may be substituted with the above-listed substituent V. As preferred aromatic rings, there can be mentioned those listed as aromatic ring examples in the above description of aromatic groups.

The group having an aromatic ring can be represented by the formula —Lc—$A_2$—, wherein Lc represents a single bond or a connecting group. $A_2$ represents an aromatic group. As preferred Lc connecting groups, there can be mentioned those described above as being represented by La. As preferred $A_2$ aromatic groups, there can be mentioned those listed above as aromatic group examples. Lc or $A_2$ is preferably substituted with at least one anionic substituent.

Preferably, as an alkyl group having a hydrocarbon aromatic ring, there can be mentioned, for example, an aralkyl group substituted with a sulfo group, a phosphate group and/or a carboxyl group (e.g., 2-sulfobenzyl, 4-sulfobenzyl, 4-sulfophenethyl, 3-phenyl-3-sulfopropyl, 3-phenyl-2-sulfopropyl, 4,4-diphenyl-3-sulfobutyl, 2-(4'-sulfo-4-biphenyl)ethyl or 4-phosphobenzyl); an aryloxycarbonylalkyl group substituted with a sulfo group, a phosphato group and/or a carboxyl group (e.g., 3-sulfophenoxycarbonylpropyl); or an aryloxyalkyl group substituted with a sulfo group, a phosphato group and/or a carboxyl group (e.g., 2-(4-sulfophenoxy)ethyl, 2-(2-phosphophenoxy)ethyl or 4,4-diphenoxy-3-sulfobutyl).

Further, as an alkyl group having a heteroaromatic ring, there can be mentioned, for example, 3-(2-pyridyl)-3-sulfopropyl, 3-(2-furyl)-3-sulfopropyl or 2-(2-thienyl)-2-sulfopropyl.

As a hydrocarbon aromatic group, there can be mentioned, for example, an aryl group substituted with a sulfo group, a phosphato group and/or a carboxyl group (e.g., 4-sulfophenyl or 4-sulfonaphthyl). As a heteroaromatic group, there can be mentioned, for example, a heterocyclic group substituted with a sulfo group, a phosphato group and/or a carboxyl group (e.g., 4-sulfo-2-thienyl or 4-sulfo-2-pyridyl).

More preferably, the group having an aromatic ring is the above alkyl group having a heteroaromatic ring or hydrocarbon aromatic ring substituted with a sulfo group, a phosphato group and/or a carboxyl group. Still more preferably, the group having an aromatic ring is the above alkyl group having a hydrocarbon aromatic ring substituted with a sulfo group, a phosphato group and/or a carboxyl group. Of these, 2-sulfobenzyl, 4-sulfobenzyl, 4-sulfophenethyl, 3-phenyl-3-sulfopropyl and 4-phenyl-4-sulfobutyl are most preferred.

When the methine dye of the general formula (IV), (V), (VI) or (VII) represents the chromophore represented by $D_1$ of the general formula (III), the substituent represented by $R_{17}$, $R_{18}$, $R_{19}$, $R_{20}$, $R_{21}$, $R_{22}$, $R_{23}$, $R_{24}$ or $R_{25}$ is preferably the above unsubstituted alkyl group or substituted alkyl group (for example, carboxyalkyl, sulfoalkyl, aralkyl or aryloxyalkyl).

When the methine dye of the general formula (IV), (V), (VI) or (VII) represents the chromophore represented by $D_2$ of the general formula (III), the substituent represented by $R_{17}$, $R_{18}$, $R_{19}$, $R_{20}$, $R_{21}$ $R_{22}$, $R_{23}$, $R_{24}$ or $R_{25}$ is preferably the unsubstituted alkyl group or substituted alkyl group, more preferably the alkyl group having an anionic substituent (e.g., carboxyalkyl or sulfoalkyl), and most preferably sulfoalkyl.

Each of $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$, $L_{44}$, $L_{45}$, $L_{46}$, $L_{47}$, $L_{48}$, $L_{49}$, $L_{50}$, $L_{51}$, $L_{52}$, $L_{53}$, $L_{54}$, $L_{55}$, $L_{56}$, $L_{57}$, $L_{58}$, $L_{59}$, $L_{60}$, $L_{61}$, $L_{62}$, $L_{63}$, $L_{64}$, $L_{65}$, $L_{66}$ and $L_{67}$ independently represents a methine group. The methine groups represented by $L_1$ to $L_{67}$ may have substituents, which can be those mentioned above as being represented by V. As such substituents, there can be mentioned, for example, a substituted or unsubstituted alkyl group having 1 to 15 carbon atoms, preferably 1 to 10 carbon atoms, and more preferably 1 to 5 carbon atoms (e.g., methyl, ethyl or 2-carboxyethyl), a substituted or unsubstituted aryl group having 6 to 20 carbon atoms, preferably 6 to 15 carbon atoms, and more preferably 6 to 10 carbon atoms (e.g., phenyl or o-carboxyphenyl), a substituted or unsubstituted heterocyclic group having 3 to 20 carbon atoms, preferably 4 to 15 carbon atoms, and more preferably 6 to 10 carbon atoms (e.g., N,N-dimethylbarbituric acid group), a halogen atom (e.g., chlorine, bromine, iodine or fluorine), an alkoxy group having 1 to 15 carbon atoms, preferably 1 to 10 carbon atoms, and more preferably 1 to 5 carbon atoms (e.g., methoxy or ethoxy), an amino group having 0 to 15 carbon atoms, preferably 2 to 10 carbon atoms, and more preferably 4 to 10 carbon atoms (e.g., methylamino, N,N-dimethylamino, N-methyl-N-phenylamino or N-methylpiperadino), an alkylthio group having 1 to 15 carbon atoms, preferably 1 to 10 carbon atoms, and more preferably 1 to 5 carbon atoms (e.g., methylthio or ethylthio), and an arylthio group having 6 to 20 carbon atoms, preferably 6 to 12 carbon atoms, and more preferably 6 to 10 carbon atoms (e.g., phenylthio or p-methylphenylthio). These may form rings in cooperation with other methine groups, or can form rings in cooperation with $Z_1$ to $Z_{25}$ and $R_1$ to $R_{25}$.

$L_1$, $L_2$, $L_3$, $L_4$, $L_5$, $L_6$, $L_{10}$, $L_{11}$, $L_{12}$, $L_{13}$, $L_{16}$, $L_{17}$, $L_{23}$, $L_{24}$, $L_{25}$, $L_{26}$, $L_{30}$, $L_{31}$, $L_{32}$, $L_{33}$, $L_{36}$, $L_{37}$, $L_{43}$, $L_{44}$, $L_{45}$, $L_{46}$, $L_{50}$, $L_{51}$, $L_{52}$, $L_{53}$, $L_{56}$, $L_{57}$, $L_{63}$ and $L_{64}$ preferably represent unsubstituted methine groups.

Each of $n_1$, $n_2$, $n_3$, $n_4$, $n_5$, $n_6$, $n_7$, $n_8$, $n_9$, $n_{10}$, $n_{11}$, $n_{12}$ and $n_{13}$ is independently 0, 1, 2, 3 or 4, preferably 0, 1, 2 or 3, more preferably 0, 1 or 2, and most preferably 0 or 1. When $n_1$, $n_2$, $n_3$, $n_4$, $n_5$, $n_6$, $n_7$, $n_8$, $n_9$, $n_{10}$, $n_{10}$, $n_{12}$ and $n_{13}$ are 2 or greater, methine groups are repeated, which are, however, not needed to be identical with each other.

Each of $p_1$, $p_2$, $p_3$, $p_4$, $p_5$, $p_6$, $p_7$, $p_8$, $p_9$, $p_{10}$, $p_{11}$, $p_{12}$, $p_{13}$, $p_{14}$, $p_{15}$, $p_{16}$ is independently 0 or 1, preferably 0.

$M_1$, $M_2$, $M_3$, $M_4$, $M_5$ and $M_6$, when required for neutralizing dye ion charges, are included in the formulae in order to indicate the presence of cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$ and $SO_3^-$, when having a proton as a counter ion, can be indicated as $CO_2H$ and $SO_3H$, respectively.

Each of $m_1$, $m_2$, $m_3$, $m_4$, $m_5$ and $m_6$ is a number of 0 or greater required to balance a charge, preferably a number of 0 to 4, and more preferably a number of 0 to 1. When an intramolecular salt is formed, each is 0.

Only specific examples of the dyes for use in especially preferred technologies as described in detail in the description of embodiments of the present invention will now be set out, to which, however, the present invention is naturally in no way limited.

Specific examples of the compounds of the general formula (I) (including subordinate concept structures) according to the present invention:

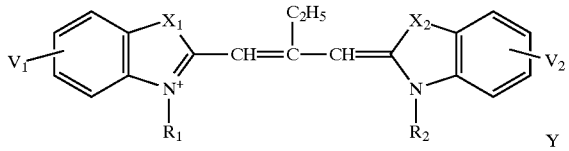
| | $X_1$ | $X_2$ | $V_1$ | $V_2$ | $R_1$ | $R_2$ | Y |
|---|---|---|---|---|---|---|---|
| D-1 | O | O | 5-Ph | 5'-Ph | O—Ph | O—Ph | $SO_3^-$ |
| D-2 | O | O | 5-Ph | 5'-Ph | O CNHSO$_2$ Ph | O CNHSO$_2$ Ph | $Br^-$ |
| D-3 | O | S | 5-Ph | 5'-Ph | O CNHSO$_2$ Ph | O CNHSO$_2$ Ph | $SO_3^-$ |
| D-4 | O | S | 5-Ph | 5'-Ph | O—Ph | O—Ph | $Br^-$ |
| D-5 | O | O | 4,5-Benzo | 4',5'-Benzo | O—Ph | O—Ph | $SO_3^-$ |
| D-6 | O | O | 5,6-Benzo | 5',6'-Benzo | O—Ph | O—Ph | $SO_3^-$ |
| D-7 | O | O | 5,6-Benzo | 5',6'-Benzo | O CNHSO$_2$ Ph | O CNHSO$_3$ Ph | $SO_3^-$ |
| D-8 | O | O | 6, 5, O | 6', 5', O | O CNHSO$_2$ Ph | O CNHSO$_3$ Ph | $SO_3^-$ |

-continued
| | | | | | | | |
|---|---|---|---|---|---|---|---|
| D-9 | O | O | 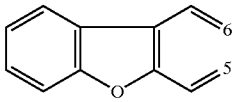 | 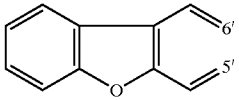 | 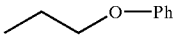 | 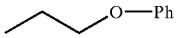 | 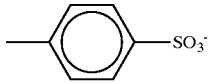 |
| D-10 | O | O | 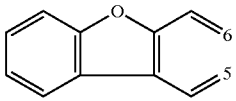 | 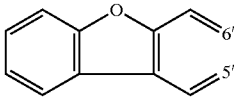 | 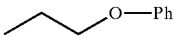 | 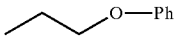 | 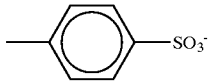 |
| D-11 | S | S | 5-Ph | 5'-Ph | 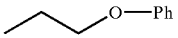 | 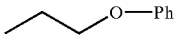 | 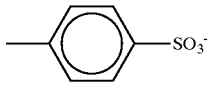 |
| D-12 | S | S | 5-Cl | 5'-Cl | 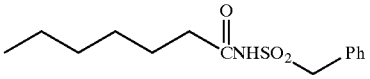 | 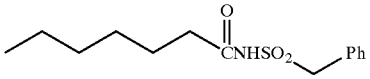 | 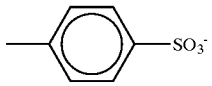 |
| D-13 | S | S | 5,6-Benzo | 5',6'-Benzo | 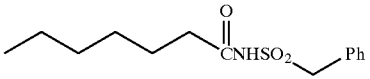 | 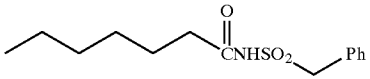 | 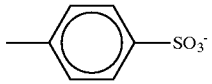 |
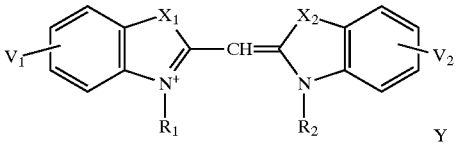
| | | | | | | | |
|---|---|---|---|---|---|---|---|
| D-14 | S | S | 5-Ph | 5-Ph | 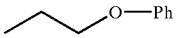 | 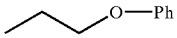 | 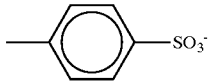 |
| D-15 | S | S | 5-Ph | 5-Ph | 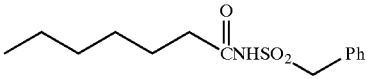 | 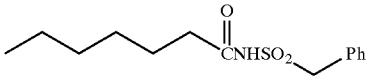 | 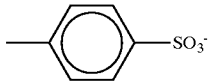 |
| D-16 | S | S | 5,6-Benzo | 5',6'-Benzo | 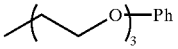 | 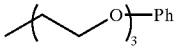 | 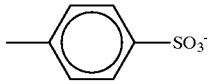 |

-continued
| | | | | | | | |
|---|---|---|---|---|---|---|---|
| D-17 | S | O | 5,6-Benzo | 5',6'-Benzo | O—Ph | O—Ph | $SO_3^-$ |
| D-18 | O | O | 5,6-Benzo | 5',6'-Benzo | O—Ph | O—Ph | $SO_3^-$ |
| D-19 | S | S | 5,6-Benzo | 5',6'-Benzo | O<br>CNHSO$_2$—Ph | O<br>CNHSO$_2$—Ph | $SO_3^-$ |
| D-20 | S | S | 6, 5 | 6', 5' | O<br>CNHSO$_2$—Ph | O<br>CNHSO$_2$—Ph | $SO_3^-$ |
D-37
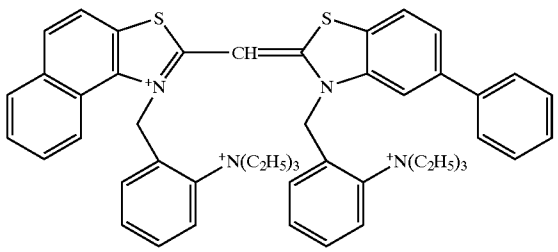
$3Br^-$
D-38
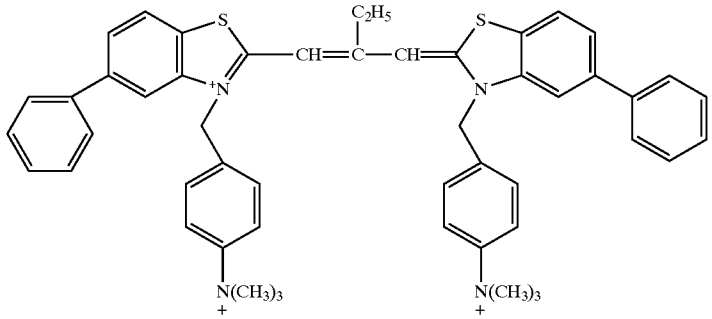
$3Br^-$ -continued
| | |
|---|---|
| D-39 | 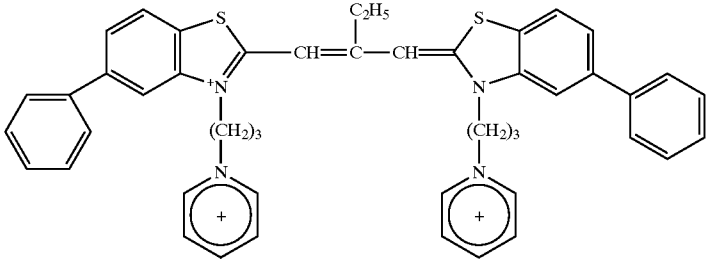 $3Br^-$ |
| D-40 | 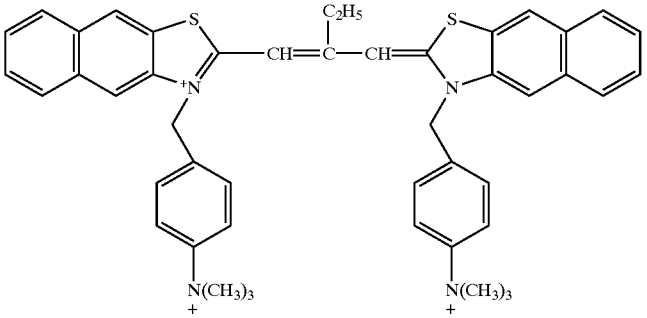 $3Br^-$ |

Specific examples of the compounds of the general formula (II) (including subordinate concept structures) according to the present invention:

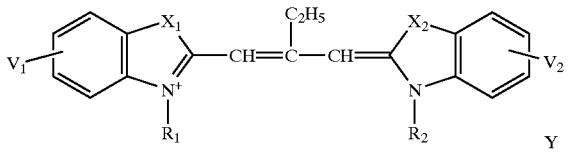

| | $X_1$ | $X_2$ | $V_1$ | $V_2$ | $R_1$ | $R_2$ | Y |
|---|---|---|---|---|---|---|---|
| D-21 | O | O | 5-Ph | 5'-Ph | 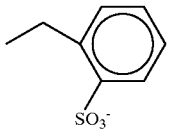 | 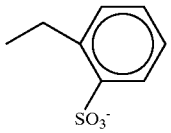 | $Na^+$ |
| D-22 | O | O | 5-Ph | 5'-Ph | 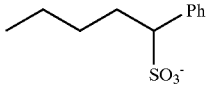 | 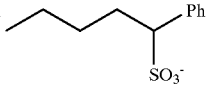 | $Na^+$ |
| D-23 | O | S | 5-Ph | 5'-Ph | 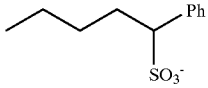 | 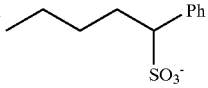 | $HN^+(C_2H_5)_3$ |
| D-24 | S | S | 5-Ph | 5'-Ph | 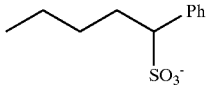 | 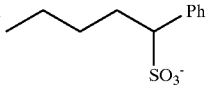 | $HN^+(C_2H_5)_3$ |
| D-25 | S | S | 5-Ph | 5'-Ph | 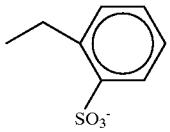 | 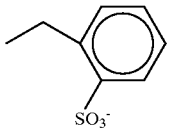 | $HN^+(C_2H_5)_3$ |
| D-26 | O | O | 5,6-Benzo | 5',6'-Benzo | 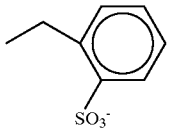 | 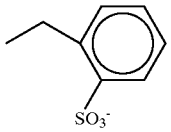 | $HN^+(C_2H_5)_3$ |
| D-27 | O | O | 4,5-Benzo | 5',6'-Benzo | 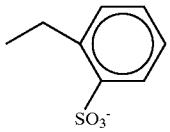 | 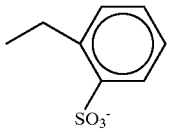 | $HN^+(C_2H_5)_3$ |
| D-28 | O | O | 5,6-Benzo | 5',6'-Benzo | 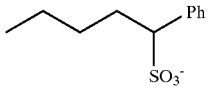 | 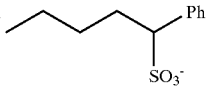 | $HN^+(C_2H_5)_3$ |
| D-29 | O | O | 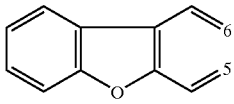 | 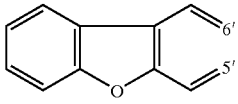 | 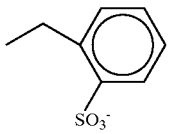 | 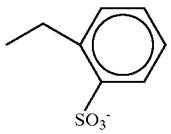 | $HN^+(C_2H_5)_3$ |
| D-30 | S | S | 5-Cl | 5'-Cl | 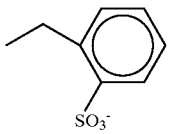 | 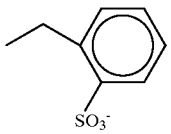 | $HN^+(C_2H_5)_3$ |

-continued
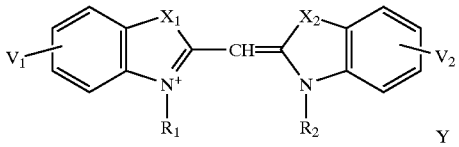
| | | | | | | | |
|---|---|---|---|---|---|---|---|
| D-31 | S | S | 5-Ph | 5-Ph | 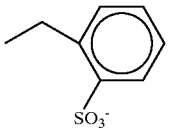 | 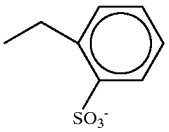 | $Na^+$ |
| D-32 | S | S | 5,6-Benzo | 5',6'-Benzo | 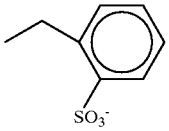 | 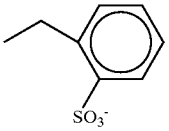 | $Na^+$ |
| D-33 | S | O | 5,6-Benzo | 5',6'-Benzo | 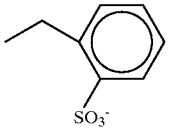 | 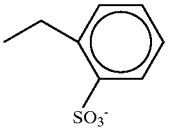 | $Na^+$ |
| D-34 | O | O | 5,6-Benzo | 5',6'-Benzo | 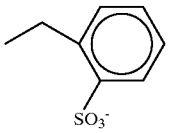 | 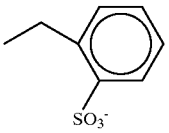 | $Na^+$ |
| D-35 | S | O | 5,6-Benzo | 5-Ph | 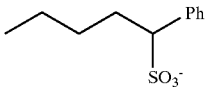 | 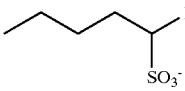 | $Na^+$ |
Specific examples of the compounds of the general formula (III) according to the present invention:
D-36
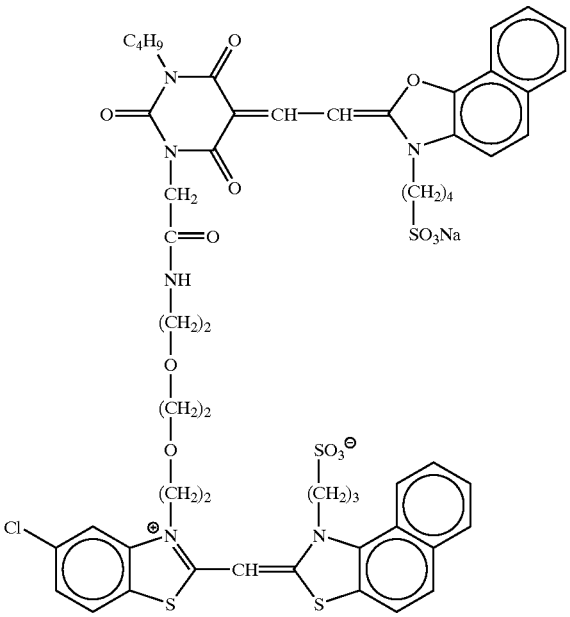

-continued
D-37
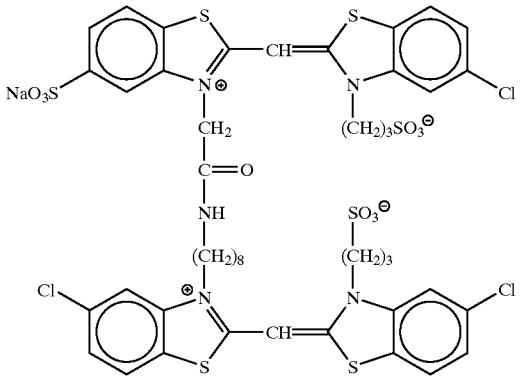
D-38
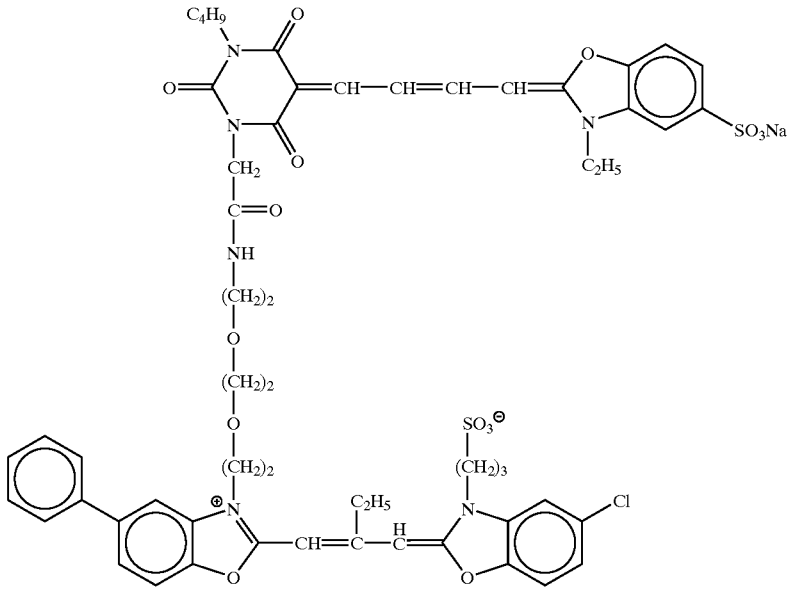
D-39
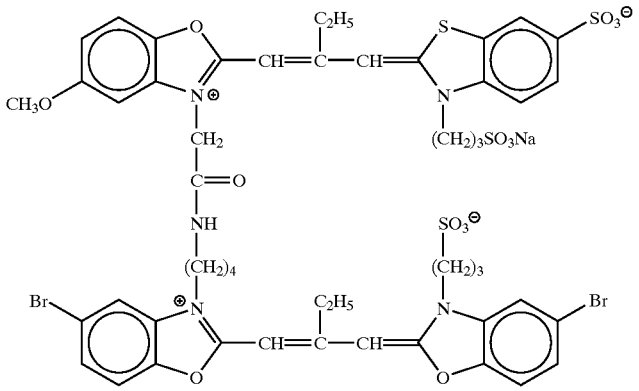

-continued

D-40

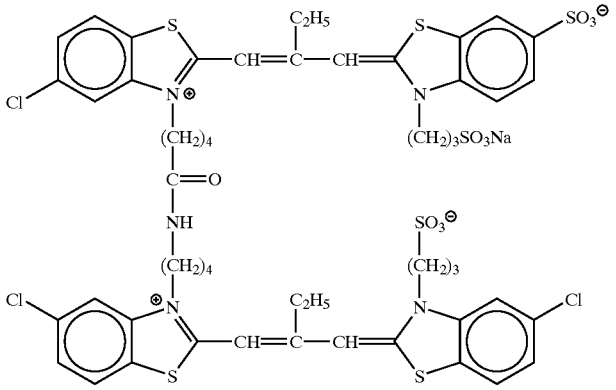

D-41

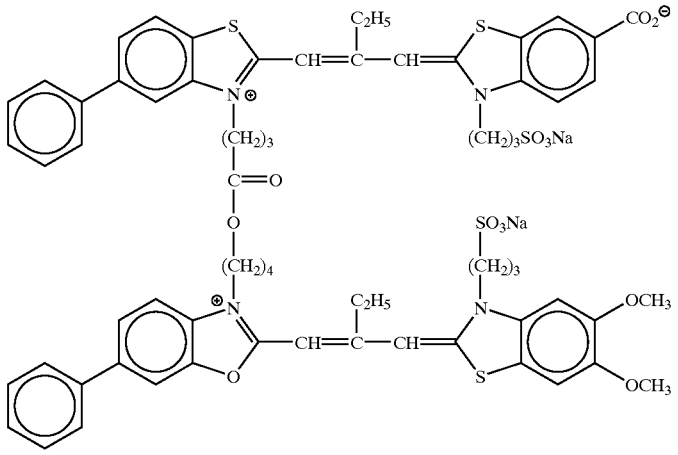

The dyes according to the present invention can be synthesized by the methods described in, for example, F. M. Harmer, "Heterocyclic Compounds-Cyanine Dyes and Related Compounds", John Wiley & Sons, New York, London, 1964; D. M. Sturmer, "Heterocyclic Compounds-Special topics in heterocyclic chemistry", chapter 18, section 14, pages 482 to 515, John Wiley & Sons, New York, London, 1977; Rodd's Chemistry of Carbon Compounds, 2nd. Ed. vol. IV, part B, 1977, chapter 15, pages 369 to 422, Elsevier Science Publishing Company Inc., New York; and the aforementioned patents and literature (cited for describing specific examples).

In the present invention, the sensitizing dyes are not limited to the above sensitizing dyes of the general formulae (I) to (III) (hereinafter also referred to as "sensitizing dye of the present invention"), and other sensitizing dyes can be used individually or in combination therewith. As preferably employed dyes, there can be mentioned, for example, a cyanine dye, a merocyanine dye, a rhodacyanine dye, a trinuclear merocyanine dye, a tetranuclear merocyanine dye, an allopolar dye, a hemicyanine dye and a styryl dye. A cyanine dye, a merocyanine dye and a rhodacyanine dye are more preferred. A cyanine dye is most preferred. Details of these dyes are described in, for example, F. M. Harmer, "Heterocyclic Compounds-Cyanine Dyes and Related Compounds", John Wiley & Sons, New York, London, 1964; and D. M. Sturmer, "Heterocyclic Compounds-Special topics in heterocyclic chemistry", chapter 18, section 14, pages 482 to 515, John Wiley & Sons, New York, London, 1977.

As preferred dyes, further, there can be mentioned sensitizing dyes indicated by general formulae and specific examples listed on pages 32 to 44 of U.S. Pat. No. 5,994,051 and pages 30 to 39 of U.S. Pat. No. 5,747,236.

Further, as the general formulae for preferred cyanine, merocyanine and rhodacyanine dyes, there can be mentioned those shown in U.S. Pat. No. 5,340,694, columns 21 to 22, (XI), (XII) and (XIII) (wherein the numbers n12, n15, n17 and n18 are not limited as long as each of these is an integer of 0 or greater (preferably, 4 or less).

These sensitizing dyes can be used individually or in combination. Sensitizing dye combinations are often employed especially in order to attain supersensitization. Representative examples thereof are described in, for example, U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, GB Nos. 1,344,281 and 1,507,803, Jpn. Pat. Appln. KOKOKU Publication No. (hereinafter referred to as JP-B-) 43-49336, JP-B-53-12375 and JP-A's-52-110618 and 52-109925.

Together with these sensitizing dyes, dyes which have themselves no spectral sensitizing activity or substances which substantially do not absorb visible light and exhibit supersensitization may be contained in the emulsion.

Supersensitizing agents (for example, pyrimidylamino compounds, triazinylamino compounds, azolium compounds, aminostyryl compounds, aromatic organic acid/formaldehyde condensates, azaindene compounds and cadmium salts) and combinations of supersensitizing agent and sensitizing dye, which are useful in the spectral sensitization of the present invention, are described in, for example, U.S. Pat. Nos. 3,511,664, 3,615,613, 3,615,632, 3,615,641, 4,596,767, 4,945,038, 4,965,182, 2,933,390, 3,635,721, 3,743,510 and 3,617,295. With respect to the method of using these as well, those described in the above patents are preferred.

With respect to the timing of loading the silver halide emulsion of the present invention with the sensitizing dye of the present invention (same in the use of other sensitizing dyes and supersensitizing agents), it may be at any stage of the process for preparing the emulsion which has been recognized as being useful. For example, the loading may be performed at any stage prior to silver halide grain formation or/and desilvering or at any stage during desilvering and/or between completion of desilvering and initiation of chemical ripening, as disclosed in, for example, U.S. Pat. Nos. 2,735,766, 3,628,960, 4,183,756 and 4,225,666 and JP-A's-58-184142 and 60-196749. Also, the loading may be performed at any stage immediately before chemical ripening or during chemical ripening or at any stage between completion of chemical ripening and emulsion coating, as disclosed in, for example, JP-A-58-113920. Moreover, as disclosed in, for example, U.S. Pat. No. 4,225,666 and JP-A-58-7629, a particular compound individually or in combination with other structurally different compounds may be divided into, for example, a portion to be added during grain formation and a portion to be added during chemical ripening or to be added after completion of chemical ripening, or into a portion to be added prior to or during chemical ripening and a portion to be added after chemical ripening, before the performing of the loading. In the performing of the loading, the type of compound and compound combination added in division may be changed.

The addition amount of sensitizing dye of the present invention (same in the use of other sensitizing dyes and supersensitizing agents), although varied depending on the configuration and size of silver halide grains, can be in the range of $1\times10^{-6}$ to $8\times10^{-3}$ mol per mol of silver halides. For example, when the size of silver halide grains is in the range of 0.2 to 1.3 $\mu$m, the addition amount is preferably in the range of $2\times10^{-6}$ to $3.5\times10^{-3}$ mol, more preferably $7.5\times10^{-6}$ to $1.5\times10^{-3}$ mol, per mol of silver halides.

When the sensitizing dye of the present invention is adsorbed in multilayer form as aforementioned, the sensitizing dye is added in an amount needed to attain desired multilayer adsorption.

The sensitizing dye of the present invention (same in the use of other sensitizing dyes and supersensitizing agents) can directly be dispersed in the emulsion. Alternatively, the dispersion can be effected by first dissolving the sensitizing dye in an appropriate solvent such as methyl alcohol, ethyl alcohol, methylcellosolve, acetone, water, pyridine or a mixture thereof and adding the resultant solution to the emulsion. The dissolution can be conducted in the presence of additives such as a base, an acid and a surfactant. Also, in the dissolution, use can be made of ultrasonic vibration. The addition of these compounds can be accomplished by, for example, the method of dissolving such compounds in a volatile organic solvent, dispersing the solution into a hydrophilic colloid and adding the dispersion to the emulsion, as described in, for example, U.S. Pat. No. 3,469,987; the method of dispersing such compounds in a water-soluble solvent and adding the dispersion to the emulsion, as described in, for example, JP-B-46-24185; the method of dissolving such compounds in a surfactant and adding the solution to the emulsion, as described in, for example, U.S. Pat. No. 3,822,135; the method of dissolving such compounds with the use of a compound capable of effecting a red shift and adding the solution to the emulsion, as described in, for example, JP-A-51-74624; and the method of dissolving such compounds in an acid which substantially does not contain water and adding the solution to the emulsion, as described in, for example, JP-A-50-80826. Furthermore, the addition to the emulsion can be accomplished by, for example, the methods of U.S. Pat. Nos. 2,912,343, 3,342,605, 2,996,287 and 3,429,835.

In the present invention, it is preferred that photographically useful compounds as well as the sensitizing dye be adsorbed on silver halide grains. As such photographically useful compounds, there can be mentioned, for example, an antifoggant, a stabilizing agent and a nucleating agent. As the antifoggant and stabilizing agent, there can be employed, for example, compounds described in Research Disclosure (hereinafter referred to as RD), vol. 176, item 17643 (RD17643), vol. 187, item 18716 (RD18716), and vol. 308, item 308119 (RD308119). As the nucleating agent, there can be employed, for example, hydrazines described in U.S. Pat. Nos. 2,563,785 and 2,588,982; hydrazones and hydrazides described in U.S. Pat. No. 3,227,552; heterocyclic quaternary salt compounds described in, for example, GB No. 1,283,835, JP-A's-52-69613, 55-138742, 60-11837, 62-210451 and 62-291637, and U.S. Pat. Nos. 3,615,515, 3,719,494, 3,734,738, 4,094,683, 4,115,122, 4,306,016 and 4,471,044; sensitizing dyes having a substituent with nucleating activity in dye molecules, described in U.S. Pat. No. 3,718,470; thiourea-bonded acylhydrazine compounds described in, for example, U.S. Pat. Nos. 4,030,925, 4,031,127, 4,245,037, 4,255,511, 4,266,013 and 4,276,364 and GB No. 2,012,443; and acylhydrazine compounds having a thioamido ring or a heterocyclic group, such as triazolyl or tetrazolyl, bonded thereto as an adsorptive group, described in, for example, U.S. Pat. Nos. 4,080,270 and 4,278,748 and GB No. 2,011,391B.

As photographically useful compounds preferred in the present invention, there can be mentioned nitrogenous heterocyclic compounds such as thiazole and benzotriazole, mercapto compounds, thioether compounds, sulfinic acid compounds, thiosulfonic acid compounds, thioamide compounds, urea compounds, selenourea compounds and thiourea compounds of these, nitrogenous heterocyclic compounds, mercapto compounds, thioether compounds and thiourea compounds are more preferred. Nitrogenous heterocyclic compounds are most preferred. The nitrogenous heterocyclic compounds are preferably those of the general formulae (VII) to (X).

Although the addition of photographically useful compounds can be conducted prior to, or after, or during the loading of sensitizing dye, it is preferred that the addition of photographically useful compounds be performed prior to or during the loading of sensitizing dye. It is more preferred that the addition be performed during the loading of sensitizing dye.

The addition amount of photographically useful compounds, although varied depending on the function of additive and the type of emulsion, is typically in the range of $1\times10^{-6}$ to $5\times10^{-3}$ mol/mol Ag.

In the photographic emulsion which engages in lightsensitive mechanism in the present invention, although all of silver bromide, silver iodobromide, silver chlorobromide, silver iodide, silver iodochloride, silver iodobromochloride and silver chloride can be used as silver halides, a highly secure multilayer adsorption structure can be constructed by causing the halide composition of emulsion outermost surface to contain 0.1 mol % or more, preferably 1 mol % or more, and more preferably 5 mol % or more, of iodide.

Although the grain size distribution may be broad or narrow, a narrow distribution is preferred.

The silver halide grains of photographic emulsion, although may consist of those having a regular crystal form such as a cube, an octahedron, a tetradecahedron or a rhombic dodecahedron, those having an irregular crystal form such as a spherical or platelike shape, those having high-order faces ((hkl) faces) or those composed of a mixture of grains with these crystal forms, preferably consist of tabular grains. Tabular grains will be described in detail below. With respect to grains with high-order faces, reference can be made to pages 247 to 254 of Journal of Imaging Science, vol. 30 (1986).

These silver halide grains, individually or in mixture, may be contained in the silver halide photographic emulsion for use in the present invention. The silver halide grains may have phases which are different between the internal part and the surface layer, or may have a multilayer structure with a junction structure, or may have a phase localized at grain surfaces, or may have a phase which is uniform through the entirety of grains. These may be present in mixture. These various emulsions may be of the surface latent image type wherein latent images are primarily formed on grain surfaces, or may be of the internal latent image type wherein latent images are primarily formed in the internal part of grains.

The silver halide emulsion for use in the present invention preferably consists of tabular silver halide grains exhibiting a high ratio of surface area/volume, wherein the sensitizing dye disclosed in the present invention is adsorbed on grains. These tabular silver halide grains preferably have an aspect ratio of 2 to 100, more preferably 5 to 80, and most preferably 8 to 80. The thickness of these tabular silver halide grains is preferably less than 0.2 $\mu$m, more preferably less than 0.1 $\mu$m, and most preferably less than 0.07 $\mu$m. The following technology can be utilized for the preparation of these thin tabular grains of high aspect ratio.

In the present invention, tabular silver halide grains whose halide composition is silver chloride, silver bromide, silver chlorobromide, silver iodobromide, silver chloroiodobromide or silver iodochloride are preferably employed. Tabular grains having (100) or (111) principal surfaces are preferred. Tabular grains having (111) principal surfaces (hereinafter referred to as (111) tabular grains) generally have trigonal or hexagonal surfaces. Generally, when the distribution becomes narrow, the ratio of tabular grains with hexagonal surfaces would be increased. Hexagonal monodispersed tabular grains are described in JP-B-5-61205.

Tabular grains having (100) faces as principal surfaces (hereinafter referred to as (100) tabular grains) have rectangular or square shapes. In the emulsion, grains of from needle (acicular) grains to grains of less than 5:1 neighboring side ratio are referred to as tabular grains. With respect to the tabular grains of silver chloride or containing silver chloride in high ratio, the stability of principal surfaces is inherently higher in the (100) tabular grains than in the (111) tabular grains. In the use of (111) tabular grains, it is required to stabilize the (111) principal surfaces. With respect to this matter, reference can be made to JP-A's 9-80660 and 9-80656 and U.S. Pat. No. 5,298,388.

The (111) tabular grains of silver chloride or exhibiting a high silver chloride content for use in the present invention are disclosed in the following patents.

Namely, U.S. Pat. Nos. 4,414,306, 4,400,463, 4,713,323, 4,783,398, 4,962,491, 4,983,508, 4,804,621, 5,389,509, 5,217,858 and 5,460,934.

The (111) tabular grains of high silver bromide content for use in the present invention are described in the following patents.

Namely, U.S. Pat. Nos. 4,425,425, 4,425,426, 443,426, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grains for use in the present invention are described in the following patents. Namely, U.S. Pat. Nos. 4,386,156, 5,275,930, 5,292,632, 5,314,798, 5,320, 938, 5,319,635 and 5,356,764; EP Nos. 569,971 and 737, 887; and JP-A's-6-308648 and 9-5911.

The silver halide emulsion is generally chemically sensitized before use. In the chemical sensitization, chalcogen sensitization (sulfur sensitization, selenium sensitization or tellurium sensitization), noble metal sensitization (e.g., gold sensitization) and reduction sensitization are carried out individually or in combination.

In the present invention, the silver halide emulsion having undergone at least selenium sensitization is preferred. That is, selenium sensitization only, or selenium sensitization in combination with chalcogen sensitization and/or noble metal sensitization (especially, gold sensitization) is preferred. A combination of selenium sensitization and noble metal sensitization is especially preferred.

In the selenium sensitization, unstable selenium compounds are used as a sensitizing agent. Unstable selenium compounds are described in JP-B's-43-13489 and 44-15748 and JP-A's-4-25832, 4-109240, 4-271341 and 5-40324. Examples of suitable selenium sensitizing agents include colloidal metallic selenium, selenoureas (e.g., N,N-dimethylselenourea, trifluoromethylcarbonyl-trimethylselenourea and acetyl-trimethylselenourea), selenoamides (e.g., selenoacetamide and N,N-diethylphenylselenoamide), phosphine selenides (e.g., triphenylphosphine selenide and pentafluorophenyl-triphenylphosphine selenide), selenophosphates (e.g., tri-p-tolyl selenophosphate and tri-n-butyl selenophosphate), selenoketones (e.g., selenobenzophenone), isoselenocyanates, selenocarboxylic acids, selenoesters and diacyl selenides. Further, relatively stable selenium compounds such as selenious acid, potassium selenocyanide, selenazoles and selenides (described in JP-B's-46-4553 and 52-34492) can also be used as the selenium sensitizing agent.

In the sulfur sensitization, unstable sulfur compounds are used as a sensitizing agent. Unstable sulfur compounds are described in P. Glafkides, "Chemie et Physique Photographique", Paul Montel, 5th ed., 1987 and Research Disclosure, vol. 307, item 307105. Examples of suitable sulfur sensitizing agents include thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine and 5-benzylidene-N-ethyl-rhodanine), phosphine sulfides (e.g., trimethylphosphine sulfide), thiohydantoins, 4-oxazolidine-2-thiones, dipolysulfides (e.g., dimorpholine disulfide and cystine), mercapto compounds (e.g., cysteine), polythionic acid salts and elemental sulfur. Also, active gelatin can be used as a sulfur sensitizing agent.

In the tellurium sensitization, unstable tellurium compounds are used as a sensitizing agent. Unstable tellurium compounds are described in CA No. 800,958, GB Nos. 1,295,462 and 1,396,696, and JP-A's-4-204640, 4-271341, 4-333043 and 5-303157. Examples of suitable tellurium sensitizing agents include telluroureas (e.g., tetramethyltellurourea, N,N'-dimethylethylenetellurourea and N,N'-diphenylethylenetellurourea), phosphine tellurides (e.g., butyldiisopropylphosphine telluride, tributylphosphine telluride, tributoxyphosphine telluride and ethoxy-diphenylphosphine telluride), diacyl (di)tellurides (e.g., bis(diphenylcarbamoyl) ditelluride, bis(N-phenyl-N-methylcarbamoyl) ditelluride, bis(N-phenyl-N-methylcarbamoyl) telluride and bis(ethoxycarbonyl) telluride), isotellurocyanates, telluroamides, tellurohydrazides, telluroesters (e.g., butylhexyl telluoroester), telluroketones (e.g., telluroacetophenone), colloidal tellurium, (di)tellurides and other tellurium compounds (e.g., potassium telluride and sodium telluropentathionate).

In the noble metal sensitization, salts of noble metals such as gold, platinum, palladium and iridium are used as a sensitizing agent. Nobel metal salts are described in P. Glafkides, "Chemie et Physique Photographique", Paul Montel, 5th ed., 1987 and Research Disclosure, vol. 307, item 307105. Gold sensitization is especially preferred. As aforementioned, the present invention is especially effective in embodiments wherein the gold sensitization is carried out.

That gold can be removed from sensitized nuclei on emulsion grains with the use of a solution containing potassium cyanide (KCN) is described in Photographic Science and Engineering, vol. 19322 (1975) and Journal of Imaging Science, vol. 3228 (1988). As described therein, cyanide ions liberate gold atoms or gold ions adsorbed on silver halide grains as a cyanide complex to thereby inhibit the gold sensitization. Suppressing the formation of cyanide according to the present invention enables satisfactory exertion of the effect of gold sensitization.

Examples of suitable gold sensitizing agents include chloroauric acid, potassium chloroaurate, potassium aurithiocyanate, gold sulfide and gold selenide. Also, use can be made of gold compounds described in the specifications of U.S. Pat. Nos. 2,642,361, 5,049,484 and 5,049,485.

In the reduction sensitization, reducing compounds are used as a sensitizing agent. Reducing compounds are described in P. Glafkides, "Chemie et Physique Photographique", Paul Montel, 5th ed., 1987 and Research Disclosure, vol. 307, item 307105. Examples of suitable reduction sensitizing agents include aminoiminomethanesulfinic acid (thiourea dioxide), borane compounds (e.g., dimethylaminoborane), hydrazine compounds (e.g., hydrazine and p-tolylhydrazine), polyamine compounds (e.g., diethylenetriamine and triethylenetetramine), stannous chloride, silane compounds, reductones (e.g., ascorbic acid), zinc sulfite, aldehyde compounds and hydrogen gas. The reduction sensitization can be effected in an atmosphere of high pH or silver ion excess (namely, silver ripening). The reduction sensitization is preferably carried out during the formation of silver halide grains.

The addition amount of sensitizing agent is generally determined depending on the type of employed silver halide grains and the conditions of chemical sensitization.

The addition amount of chalcogen sensitizing agent is generally in the range of $10^{-8}$ to $10^{-2}$ mol, preferably $10^{-7}$ to $5\times10^{-3}$ mol, per mol of silver halides.

The addition amount of noble metal sensitizing agent is preferably in the range of $10^{-7}$ to $10^{-2}$ mol per mol of silver halides.

Although the conditions of chemical sensitization are not particularly limited, the pAg is generally in the range of 6 to 11, preferably 7 to 10. It is preferred that the pH range from 4 to 10. The temperature is preferably in the range of 40 to 95° C., more preferably 45 to 85° C.

The additives are described in detail in RD Item 17643 (December 1978), Item 18716 (November 1979) and Item 308119 (December 1989). A summary of the locations where they are described will be listed in the following table.

| | Types of additives | RD17643 | RD18716 | RD308119 |
|---|---|---|---|---|
| 1 | Chemical sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbent, filter dyes, ultraviolet absorbents | pages 25–26 | page 649, right column to page 650, left column | page 1003, left column to page 1003, right |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page |

-continued

| | Types of additives | RD17643 | RD18716 | RD308119 |
|---|---|---|---|---|
| 13 | Antistatic agents | page 27 | page 650, right column | 1006, left column page 1006, right column to page 1007, left column |
| 14 | Matting agents | | | page 1008, left column to page 1009, left column. |

With respect to the emulsion of the present invention and with respect to the layer arrangement and related techniques, silver halide emulsions, dye forming couplers, DIR couplers and other functional couplers, various additives and development processing, which can be employed for the photographic lightsensitive material including the emulsion, reference can be made to EP No.0565096A1 (published on Oct. 13, 1993) and patents cited therein. Individual particulars and the locations where they are described will be listed below.

Layer arrangement: page 61 lines 23 to 35, page 61 line 41 to page 62 line14,

Interlayers: page 61 lines 36 to 40,

Interlayer effect imparting layers: page 62 lines 15 to 18,

Silver halide halogen compositions: page 62 lines 21 to 25,

Silver halide grain crystal habits: page 62 lines 26 to 30,

Silver halide grain sizes: page 62 lines 31 to 34,

Emulsion production methods: page 62 lines 35 to 40,

Silver halide grain size distributions: page 62 lines 41 to 42,

Tabular grains: page 62 lines 43 to 46,

Internal structures of grains: page 62 lines 47 to 53,

Latent image forming types of emulsions: page 62 line 54 to page 63 to line 5,

Physical ripening and chemical sensitization of emulsion: page 63 lines 6 to 9,

Emulsion mixing: page 63 lines 10 to 13,

Fogging emulsions: page 63 lines 14 to 31,

Nonlightsensitive emulsions: page 63 lines 32 to 43,

Silver coating amounts: page 63 lines 49 to 50,

Formaldehyde scavengers: page 64 lines 54 to 57,

Mercapto antifoggants: page 65 lines 1 to 2,

Fogging agent, etc. release agents: page 65 lines 3 to 7,

Dyes: page 65, lines 7 to 10,

Color coupler summary: page 65 lines 11 to 13,

Yellow, magenta and cyan couplers: page 65 lines 14 to 25,

Polymer couplers: page 65 lines 26 to 28,

Diffusive dye forming couplers: page 65 lines 29 to 31,

Colored couplers: page 65 lines 32 to 38,

Functional coupler summary: page 65 lines 39 to 44,

Bleaching accelerator release couplers: page 65 lines 45 to 48,

Development accelerator release couplers: page 65 lines 49 to 53,

Other DIR couplers: page 65 line 54 to page 66 to line 4,

Method of dispersing couplers: page 66 lines 5 to 28,

Antiseptic and mildewproofing agents: page 66 lines 29 to 33,

Types of sensitive materials: page 66 lines 34 to 36,

Thickness of lightsensitive layer and swell speed: page 66 line 40 to page 67 line 1, Back layers: page 67 lines 3 to 8, Development processing summary: page 67 lines 9 to 11, Developers and developing agents: page 67 lines 12 to 30, Developer additives: page 67 lines 31 to 44, Reversal processing: page 67 lines 45 to 56, Processing solution open ratio: page 67 line 57 to page 68 line 12, Development time: page 68 lines 13 to 15, Bleach-fix, bleaching and fixing: page 68 line 16 to page 69 line 31, Automatic processor: page 69 lines 32 to 40, Washing, rinse and stabilization: page 69 line 41 to page 70 line 18, Processing solution replenishment and recycling: page 70 lines 19 to 23, Containment of developing agent in sensitive material: page 70 lines 24 to 33, Development processing temperature: page 70 lines 34 to 38, and Application to film with lens: page 70 lines 39 to 41.

Couplers for use in the present invention can be introduced in the lightsensitive material by various known dispersing methods. Examples of high-boiling solvents for use in the in-water oil droplet dispersing method are described in, for example, U.S. Pat. No. 2,322,027. As specific examples of high-boiling organic solvents having a boiling point of 175° C. or higher at atmospheric pressure for use in the in-water oil droplet dispersing method, there can be mentioned phthalic acid esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate and bis(1,1-diethylpropyl) phthalate), esters of phosphoric acid or phosphonic acid (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate and di-2-ethylhexylphenyl phosphonate), benzoic acid esters (e.g., 2-ethylhexyl benzoate, dodecyl benzoate and 2-ethylhexyl p-hydroxybenzoate), amides (e.g., N,N-diethyldodecanamide, N,N-diethyllaurylamide and N-tetradecylpyrrolidone), alcohols or phenols (e.g., isostearyl alcohol and 2,4-di-tert-amylphenol), aliphatic carboxylic acid esters (e.g., bis(2-ethylhexyl) sebacate, dioctyl azelate, glycerol tributylate, isostearyl lactate and trioctyl citrate), aniline derivatives (e.g., N,N-dibutyl-2-butoxy-5-tert-octylaniline), and hydrocarbons (e.g., paraffin, dodecylbenzene and diisopropylnaphthalene). Further, as auxiliary solvents, there can be used, for example, organic solvents having a boiling point of about 30° C. or higher, preferably about 50 to about 160° C. Representative examples thereof include ethyl acetate, butyl acetate, ethyl propionate, methyl ethyl ketone, cyclohexanone, 2-ethoxyethyl acetate and dimethylformamide.

Steps of the latex dispersing method, the effect thereof and specific examples of impregnation latexes are described in, for example, U.S. Pat. No. 4,199,363 and OLS (German patent application) Nos. 2,541,274 and 2,541,230.

Further, the solid dispersing method described in WO No. 88/4794 can be applied.

In the present invention, the specified photographic speed defined and described in detail below is employed for indicating the sensitivity of photographic lightsensitive material. The reason therefor is as follows.

Generally, the ISO speed being international standards is employed for indicating the sensitivity of photographic lightsensitive material. In connection with the ISO speed, it is stipulated that lightsensitive materials are to be developed on the fifth day after exposure, and that the development is to be performed by the processing specified by each company concerned. Thus, in the present invention, the following specified photographic speed is employed so as to shorten the period from completion of exposure to initiation of development (0.5 to 6 hours) and so as to determine the speed through established development processing.

The specified photographic speed of lightsensitive material referred to in the present invention is determined by the following test method according to the ISO speed (in accordance with JIS K 7614-1981).

(1) Testing conditions:

The test is performed in a room of 20±5° C. temperature and 60±10% relative humidity. Every lightsensitive material specimen is allowed to stand still in this state for at least one hour before use.

(2) Exposure:

(i) The relative spectral energy distribution of reference light on exposed surface is as specified in table A.

TABLE A

| Wavelength nm | Relative spectral energy* |
|---|---|
| 360 | 2 |
| 370 | 8 |
| 380 | 14 |
| 390 | 23 |
| 400 | 45 |
| 410 | 57 |
| 420 | 63 |
| 430 | 62 |
| 440 | 31 |
| 450 | 93 |
| 460 | 97 |
| 470 | 98 |
| 480 | 101 |
| 490 | 97 |
| 500 | 100 |
| 510 | 101 |
| 520 | 100 |
| 530 | 104 |
| 540 | 102 |
| 550 | 130 |
| 560 | 100 |
| 570 | 97 |
| 580 | 98 |
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |

TABLE A-continued

| Wavelength nm | Relative spectral energy* |
|---|---|
| 680 | 85 |
| 690 | 75 |
| 700 | 77. |

Note *: values determined with the energy of 560 nm standardized as 100.

(ii) Illuminance variation on exposed surface is effected with the use of an optical wedge. Employed optical wedge is such that, at any portion thereof, the variation of spectral transmission density, in a wavelength range of 360 to 700 nm, is within 10% in a less than 400 nm region and within 5% in a 400 nm or more range.

(iii) Exposure time is 1/100 sec.

(3) Development processing:

(i) During the period from exposure to development processing, the lightsensitive material specimen is held in an atmosphere of 20±5° C. temperature and 60±10% relative humidity.

(ii) The development processing is completed within 30 min to 6 hr of the exposure.

(iii) The development processing is performed through the following steps.

| | | | |
|---|---|---|---|
| 1. | Color development: | 3 min 15 sec, | 38.0 ± 0.1° C. |
| 2. | Bleaching: | 6 min 30 sec, | 38.0 ± 3.0° C. |
| 3. | Washing: | 3 min 15 sec, | 24 to 41° C. |
| 4. | Fixing: | 6 min 30 sec, | 38.0 ± 3.0° C. |
| 5. | Washing: | 3 min 15 sec, | 24 to 41° C. |
| 6. | Stabilization: | 3 min 15 sec, | 38.0 ± 3.0° C. |
| 7. | Drying: | 50° C. or below. | |

The composition of processing solution for use in each of the above steps is as follows:

| | |
|---|---|
| Color developer | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-(bet)-hydroxyethylamino)-2-methylaniline sulfate | 4.5 g |
| Water | q.s. ad 1.0 L |
| pH | 10.0. |
| Bleaching solution | |
| Ethylenediaminetetraacetic acid ferric ammonium salt | 100.0 g |
| Ethylenediaminetetraacetic acid disodium salt | 10.0 g |
| Ammonium bromide | 150.0 g |
| Ammonium nitrate | 10.0 g |
| Water | q. s. ad 1.0 L |
| pH | 6.0. |
| Fixer | |
| Ethylenediaminetetraacetic acid disodium salt | 1.0 g |
| Sodium sulfite | 4.0 g |
| Aq. soln. of ammonium thiosulfate (70%) | 175.0 mL |

-continued

| | |
|---|---|
| Sodium bisulfite | 4.6 g |
| Water | q. s. ad 1.0 L |
| pH | 6.6. |
| Stabilizer | |
| Formaldehyde (40%) | 2.0 mL |
| Polyoxyethylene p-monononylphenyl ether (av. polymn. deg. 10) | 0.3 g |
| Water | q.s. ad 1.0 L. |

(4) Density measurement:

The density is expressed by $\log_{10}(\Phi_0/\Phi)$. $\Phi_0$ represents a lighting luminous flux for density measurement, and $\Phi$ represents a transmitted luminous flux at each part to be measured. With respect to geometrical conditions for density measurement, it is standard to use parallel luminous flux to the normal direction as a lighting luminous flux and to use total luminous flux having been transmitted and extended over a half space as a transmitted luminous flux. When the density measurement is otherwise conducted, a correction by a standard density piece is effected. Further, after the measurement, each emulsion film surface is arranged opposite to a photoreceptor side. The density measurement is effected in terms of blue, green and red status M densities, and the spectral characteristics thereof are so made as to exhibit values listed in Table B as collective properties of light source used for densitometer, optical system, optical filter and phtotoreceptor.

TABLE B

| Status M density spectral characteristics (logarithmic expression, peak values relative to a standard of 5.00) | | | |
|---|---|---|---|
| Wavelength nm | Blue | Green | Red |
| 400 | * | * | * |
| 410 | 2.10 | * | * |
| 420 | 4.11 | * | * |
| 430 | 4.63 | * | * |
| 440 | 4.37 | * | * |
| 450 | 5.00 | * | * |
| 460 | 4.95 | * | * |
| 470 | 4.74 | 1.13 | * |
| 480 | 4.34 | 2.19 | * |
| 490 | 3.74 | 3.14 | * |
| 500 | 2.99 | 3.79 | * |
| 510 | 1.35 | 4.25 | * |
| 520 | ** | 4.61 | * |
| 530 | ** | 4.85 | * |
| 540 | ** | 4.98 | * |
| 550 | ** | 4.98 | * |
| 560 | ** | 4.80 | * |
| 570 | ** | 4.44 | * |
| 580 | ** | 3.90 | * |
| 590 | ** | 3.15 | * |
| 600 | ** | 2.22 | * |
| 610 | ** | 1.05 | * |
| 620 | ** | ** | 2.11 |
| 630 | ** | ** | 4.48 |
| 640 | ** | ** | 5.00 |
| 650 | ** | ** | 4.90 |
| 660 | ** | ** | 4.58 |
| 670 | ** | ** | 4.25 |
| 680 | ** | ** | 3.88 |
| 690 | ** | ** | 3.49 |
| 700 | ** | ** | 3.10 |
| 710 | ** | ** | 2.69 |
| 720 | ** | ** | 2.27 |
| 730 | ** | ** | 1.86 |

TABLE B-continued

| Status M density spectral characteristics (logarithmic expression, peak values relative to a standard of 5.00) | | | |
|---|---|---|---|
| Wavelength nm | Blue | Green | Red |
| 740 | ** | ** | 1.45 |
| 750 | ** | ** | 1.05. |

Note
*: red slope 0.260/nm, green slope 0.106/nm, and blue slope 0.250/nm.
**: red slope 0.040/nm, green slope 0.120/nm, and blue slope 0.220/nm.

(5) Determination of specified photographic speed:

The specified photographic speed is determined from the results of processing and density measurement performed under conditions indicated in items (1) to (4) above in accordance with the following procedure.

(i) The exposure quantities corresponding to densities 0.15 higher than minimum densities with respect to blue, green and red are expressed in terms of lux·sec and referred to as $H_B$, $H_G$ and $H_R$, respectively.

(ii) Of $H_B$ and $H_R$, one of higher value (one of lower speed) is referred to as $H_S$.

(iii) The specified photographic speed S is calculated using the formula A:

$$S=\{2/(H_G \times H_S)\}^{1/2}.$$

With respect to the lightsensitive material of the present invention, it is preferred that the specified photographic speed determined in the above procedure be 320 or more. As apparent from the following experimental results, at specified photographic speeds of less than 320, not only is it practically impossible to conduct photographing in a dark room without the use of any strobe, high speed shutter photographing with the use of telephotographic lens for, for example, sports photographs and photographing for astronomical photographs, but also the probability of failure, such as out of focus or under-exposure, at ordinary photographing would be increased.

With respect to the lightsensitive material of the present invention, it is more preferred that the specified photographic speed be 350 or more.

The amount of silver contained in common lightsensitive materials is in the range of 3.0 to 8.0 g/m$^2$. With respect to commercially available high-speed color negative films whose speed is 320 or more, it is common practice in the art to which the present invention pertains to set the silver content for a high level in order to enhance the sensitivity and graininess, as described in, for example, JP-A-58-147744. However, when the silver content is over 8.0 g/m$^2$, such a level of graininess deterioration as to invite practical problems would be caused by exposure to natural radiation for about half a year to two years. Surprisingly, the graininess deterioration by natural radiation has greatly been relieved by reducing the silver content to 8.0 g/m$^2$ or less. Furthermore, although the enhancement of sharpness and color reproducibility by reducing the silver content has been expected to a certain extent, the degree of the enhancement has been far greater than the expectation. On the other hand, at the silver content of less than 3.0 g/m$^2$, it has been impossible to attain the maximum density required for color negative lightsensitive materials.

The terminology "silver content" used herein means the amount in terms of silver of all silver substances including silver halides and metallic silver. Some methods are known for the analysis of the silver content of lightsensitive materials, and any of them can be employed. For example, the fluorescent X-ray method is simple and easy.

The lightsensitive material produced using the emulsion of the present invention is preferably one having at least one lightsensitive layer constituted by a plurality of silver halide emulsion layers which have the same color sensitivity but exhibit different photographic speeds. This lightsensitive layer consists of a unit lightsensitive layer which is sensitive to any of blue light, green light and red light. In a multi-layered silver halide color photographic lightsensitive material, these unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity.

Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045. Also, as described in JP-A-57-112751, JP-A-62-200350, JP-A-62-206541 and JP-A-62-206543, layers can be arranged so that a low-speed emulsion layer is formed on a side apart from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, layers can be arranged, from the farthest side from a support, in the order of blue-sensitive layer/GH/RH/GL/RL. Furthermore, as described in JP-A-56-25738 and JP-A-62-63936, layers can be arranged, from the farthest side from a support, in the order of blue-sensitive layer/GL/RL/GH/RH.

As described in JP-B-49-15495, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

The lightsensitive material of the present invention, in one embodiment, has at least one red-sensitive silver halide emulsion layer, at least one green-sensitive silver halide emulsion layer and at least one blue-sensitive silver halide emulsion layer. It is preferred that any emulsion layers with identical color sensitivity comprise a plurality of emulsion layers whose speeds are different from each other. It is more preferred that a three-layer structure be constructed from the viewpoint of graininess improvement. These technologies are described in GB No. 923,045 and JP-B-49-15495.

In the field of color negative photographic lightsensitive material, for obtaining a color negative photographic lightsensitive material of high image quality, it is common practice to adopt a design such that, when emulsion layers with identical color sensitivity are composed of a plurality of emulsion layers whose speeds are different from each other, high-speed emulsion layers have high silver contents in order to utilize what is known as a graininess vanishing effect. However, an unexpected disadvantage such that, in high-speed color negative photographic lightsensitive materials of 320 or more specified photographic speed, increasing the silver content of high-speed emulsion layer aggravates the performance deterioration with the passage of time during storage as compared with an increase of the silver content of low-speed emulsion layer has become apparent. Therefore, it is preferred that the silver content of the highest-speed emulsion layer among emulsion layers with identical color sensitivity be not much high. The silver content of the highest-speed emulsion layer of the red-sensitive emulsion layers, green-sensitive emulsion layers or blue-sensitive emulsion layers is preferably in the range of 0.1 to 1.8 g/m$^2$, more preferably 0.1 to 1.6 g/m$^2$, and most preferably 0.1 to 1.4 g/m$^2$.

In the use of the silver halide emulsion of the present invention, the multilayer adsorption enables realizing a speed increase. Thus, in the designing of a silver halide photographic lightsensitive material with the use of the silver halide emulsion, not only, by virtue of the high speed, can the grain size be reduced to thereby enable producing a lightsensitive material with highly excellent graininess but also the silver content of silver halide emulsion layer can be reduced to thereby enable designing a silver halide photographic lightsensitive material whose performance deterioration with the passage of time during storage is relieved. Practically, the amount of silver contained in the lightsensitive material of the present invention can be reduced so as to be in the range of 0.1 to 7.0 g/m$^2$. When the above specified photographic speed is 320 or over, designing can be made so that the amount of silver contained is further reduced so as to be in the range of 0.1 to 6.0 g/m$^2$.

EXAMPLE

The present invention will be described in greater detail below by way of its examples. However, the present invention is in no way limited to these examples.

Example 1

Preparation of Silver Bromide Tabular Emulsion Y 6.4 g of potassium bromide and 6.2 g of a low-molecular-weight gelatin having a weight average molecular weight of 15,000 or less were dissolved in 1.2 lit. of water. While maintaining the temperature of the aqueous solution at 30° C., 8.1 ml of a 16.4% aqueous silver nitrate solution and 7.2 ml of a 23.5% aqueous potassium bromide solution were added thereto over a period of 10 sec by the double jet method. Further, a 11.7% aqueous gelatin solution was added, heated to 75° C., and ripened for 40 min. Thereafter, a 20% aqueous potassium bromide solution and 370 ml of a 32.2% aqueous silver nitrate solution were added over a period of 10 min while maintaining the silver potential at −20 mV. A physical ripening was effected for 1 min, and the temperature was lowered to 35° C. Thus, there were obtained monodispersed pure silver bromide tabular emulsion (specific gravity: 1.15) having an average projected area diameter of 2.32 μm, a thickness of 0.09 μm and a diameter variation coefficient of 15.1%. Thereafter, soluble salts were removed by the flocculation process. While maintaining the temperature at 40° C., 45.6 g of gelatin, 10 ml of a 1 mol/l aqueous sodium hydroxide solution, 167 ml of water and 1.66 ml of 35% phenoxyethanol were added. Thus, the pAg and pH were adjusted to 8.3 and 6.20, respectively.

The thus obtained emulsion was ripened with potassium thiocyanate, bis(1,4,5-trimethyl-1,2,4-triazolium-3-thiolatogold) (1) tetrafluoroborate, pentafluorophenyldiphenylphosphine selenide and N,N,N'-trimethyl-(N'-carboxymethyl)thiourea at 55° C. for 50 min so as to attain the optimum speed. Thus, emulsion Y was obtained.

The amount of silver contained in the obtained emulsion Y was 0.74 molAg/Kg emulsion, and, when the dye-occupied area was $80\times10^{-20}$ $m^2$, the monolayer saturated coating amount was $1.42\times10^{-3}$ mol/mol Ag.

(Emulsion Y-1)

While maintaining 50 g of the emulsion Y at 60° C., $1.06\times10^{-5}$ mol of D-14 and $4.22\times10^{-5}$ mol of D-15 were added thereto and agitated for 60 min. Thereafter, $1.06\times10^{-4}$ mol of D-19 was added and further agitated for 60 min.

(Emulsion Y-2)

While maintaining 50 g of the emulsion Y at 60° C., $1.06\times10^{-5}$ mol of D-14 and $4.22\times10^{-5}$ mol of D-15 were added thereto and agitated for 60 min. Thereafter, $5.30\times10^{-5}$ mol of D-19 and $5.30\times10^{-5}$ mol of D-32 were added and further agitated for 60 min.

(Emulsion Y-3)

While maintaining 50 g of the emulsion Y at 60° C., $6.86\times10^{-5}$ mol of D-36 was added thereto and agitated for 60 min.

(Emulsion Y-4)

While maintaining 50 g of the emulsion Y at 60° C., $7.46\times10^{-5}$ mol of D-38 was added thereto and agitated for 60 min.

(Emulsion Y-5)

While maintaining 50 g of the emulsion Y at 60° C., $6.99\times10^{-5}$ mol of D-40 was added thereto and agitated for 60 min.

The spectral absorption maximum wavelength and light absorption intensity of the emulsion Y-1 were 479 nm and 115, respectively. The spectral absorption maximum wavelength and light absorption intensity of the emulsion Y-2 were 472 nm and 95, respectively. The spectral absorption maximum wavelength and light absorption intensity of the emulsion Y-3 were 475 nm and 103, respectively. The spectral absorption maximum wavelength and light absorption intensity of the emulsion Y-4 were 552 nm and 135, respectively. The spectral absorption maximum wavelength and light absorption intensity of the emulsion Y-5 were 648 nm and 145, respectively.

In all the emulsions Y-1 to Y-5, the dyes were adsorbed in multilayer form, and the second-layer dye was adsorbed as a J-aggregate without exception.

Emulsified substances were prepared in the following manner.

A solution obtained by dissolving 14 g of ExY-7 (as a comparative example with respect to color forming couplers) in 15 cc of ethyl acetate, 4.2 g of HBS-1 (dielectric constant: 7.33) and 0.4 g of W-1 (critical micell concentration: $4.30\times10^{-3}$ mol/L) were added to 100 cc of water having 10 g of gelatin dissolved therein, and agitated at 60° C. for 1 hr. Ethyl acetate was evaporated off in vacuum, thereby obtaining emulsified substance A (as a comparative example with respect to emulsified substances).

Emulsified substance B was prepared by adding E-1 in place of ExY-7 and adding A-1 in place of W-1 in the recipe of emulsified substance A.

Emulsified substance C was prepared by adding E-1 in place of ExY-7 and adding S-1 in place of HBS-1 in the recipe of emulsified substance A.

Emulsified substance D was prepared by adding S-1 in place of HBS-1 and adding A-1 in place of W-1 in the recipe of emulsified substance A.

Emulsified substance E was prepared by adding E-1 in place of ExY-7, adding S-1 in place of HBS-1 and adding A-1 in place of W-1 in the recipe of emulsified substance A.

Emulsified substance F was prepared by adding E-2 in place of ExY-7, adding S-37 in place of HBS-1 and adding A-2 in place of W-1 in the recipe of emulsified substance A.

Emulsified substance G was prepared by adding E-8 in place of ExY-7, adding S-1 (2.0 g), S-37 (0.7 g), S-35 (1.0 g) and HBS-1 (0.5 g) in place of 4.2 g of HBS-1 and adding A-1 (0.2 g), A-2 (0.2 g) and A-3 (0.1 g) in place of W-1 in the recipe of emulsified substance A.

Further, gelatin solution H was prepared by adding water in place of ExY-7, HBS-1 and ethyl acetate in the recipe of emulsified substance A.

Absorption intensity comparison of liquid emulsions and coating films was performed in the following manner.

Liquid Emulsion: At 40° C., 7 g of emulsified substance A to G or gelatin solution H and 37 cc of water were added to 25 g of emulsion having dyes adsorbed therein, and agitated for 30 min. Each resultant liquid emulsion was thinly applied to a slide glass, and a spectral comparison was made by the use of microspectrophotometer MSP 65 manufactured by Karlzeis. Values of the absorbance maximum and the absorption integrated intensity ranging from 400 nm to 700 nm were compared with respect to emulsions loaded with emulsified substances A to G on the basis of those of emulsion loaded with gelatin solution H as a standard of 100. Under these conditions, the organic solvent content in each of the emulsions was 0.5 g/100 g emulsion.

Coating Film: At 40° C., 7 g of emulsified substance A to G and 37 cc of water were added to 25 g of emulsion having dyes adsorbed therein, and agitated for 10 min. Gelatin hardener and coating aid were further added, and each of the resultant emulsions and a gelatin protective layer were simultaneously applied to a support of cellulose acetate film in a coating silver amount of 1.0 g-Ag/$m^2$. With respect to each coating sample obtained, the absorption spectrum exhibited immediately after the coating was compared with that exhibited after storage at 60° C. in 30% humidity for 3 days. Values of the absorbance maximum and the absorption integrated intensity ranging from 400 nm to 700 nm were compared with respect to the coating samples coated with emulsions loaded with emulsified substances A to G after storage at 60° C. in 30% humidity on the basis of those of the coating samples immediately after the coating as a standard of 100.

Moreover, each of the coating samples (Nos. 1 to 11) after the storage was exposed through gelatin filter SC-39 produced by Fuji Photo Film Co., Ltd. and a continuous wedge for 1/100 sec. Each of the coating samples (Nos. 12 to 15) after the storage was exposed through gelatin filter SC-50 produced by Fuji Photo Film Co., Ltd. and a continuous wedge for 1/100 sec. The exposed samples were developed by means of negative processor FP-350 manufactured by Fuji Photo Film Co., Ltd. under the same conditions as in Example 2 of the present invention, and subjected to photographic speed measurement. The photographic speed was expressed by a relative value of inverse number of exposure quantity required for realizing a density of fog+0.1. The photographic speed was calculated by the formula 100×[log ($E_1$/Ex)+1] wherein Ex represents each of $E_1$ to $E_{15}$, these $E_1$ to $E_{15}$ representing exposure quantities required for the optical density of each sample to exhibit a fog plus 0.1. That is, the photographic speed of sample 1 is 100, and that of sample with a speed of twice that of sample 1 (exposure quantity: ½) is 130.

The thus obtained results are listed in Tables 1 and 2. It is generally anticipated that lowering of the dielectric constant of high-boiling organic solvent (increasing of the hydrophobicity thereof) would lead to increasing of the solubility of highly hydrophobic dyes and unstabilization of the multilayer adsorption thereof. However, it has been found that, contrary to the anticipation, the lower the dielectric constant of organic solvent, the more stable the multilayer adsorption. Furthermore, the present invention has enabled clarifying the properties of surfactant and type of color forming coupler required for securing the stability of multilayer adsorption. It is apparent that the use of the emulsified substance of the present invention enables obtaining a high-speed silver halide photographic lightsensitive material which is free from changes of emulsion absorption spectrum even in the presence of high-boiling organic solvent and wherein the multilayer adsorption structure of sensitizing dyes is held stable.

TABLE 1

| | | | Liquid emulsion | | Coating film | | | | |
|---|---|---|---|---|---|---|---|---|---|
| No. | Emulsion name | Emulsified substance name | Absorbance | Absorption integrated intensity | Absorbance | Absorption integrated intensity | Photographic sensitivity | Standard of sensitivity | Remarks |
| 1 | Emulsion Y-1 | Emulsified substance A | 51 | 64 | 59 | 75 | 100 | Sample 1 standardized as 100 | Comparative example |
| 2 | Emulsion Y-1 | Emulsified substance B | 59 | 71 | 71 | 91 | 109 | Sample 1 standardized as 100 | Comparative example |
| 3 | Emulsion Y-1 | Emulsified substance C | 79 | 80 | 82 | 92 | 113 | Sample 1 standardized as 100 | Comparative example |
| 4 | Emulsion Y-1 | Emulsified substance D | 82 | 89 | 88 | 96 | 116 | Sample 1 standardized as 100 | Comparative example |
| 5 | Emulsion Y-1 | Emulsified substance E | 97 | 99 | 98 | 99 | 129 | Sample 1 standardized as 100 | Present invention |
| 6 | Emulsion Y-1 | Emulsified substance F | 92 | 95 | 96 | 98 | 131 | Sample 1 standardized as 100 | Present invention |
| 7 | Emulsion Y-1 | Emulsified substance G | 98 | 99 | 99 | 100 | 133 | Sample 1 standardized as 100 | Present invention |

TABLE 2

| | | | Liquid emulsion | | Coating film | | | | |
|---|---|---|---|---|---|---|---|---|---|
| No. | Emulsion name | Emulsified substance name | Absorbance | Absorption integrated intensity | Absorbance | Absorption integrated intensity | Photographic sensitivity | Standard of sensitivity | Remarks |
| 8 | Emulsion Y-2 | Emulsified substance A | 61 | 65 | 63 | 77 | 100 | Sample 8 standardized as 100 | Comparative example |
| 9 | Emulsion Y-2 | Emulsified substance E | 93 | 96 | 95 | 98 | 123 | Sample 8 standardized as 100 | Present invention |
| 10 | Emulsion Y-3 | Emulsified substance A | 88 | 89 | 89 | 88 | 100 | Sample 10 standardized as 100 | Comparative example |
| 11 | Emulsion Y-3 | Emulsified substance E | 99 | 98 | 98 | 99 | 113 | Sample 10 standardized as 100 | Present invention |
| 12 | Emulsion Y-4 | Emulsified substance A | 89 | 88 | 88 | 89 | 100 | Sample 12 standardized as 100 | Comparative example |
| 13 | Emulsion Y-4 | Emulsified substance E | 99 | 99 | 97 | 97 | 111 | Sample 12 standardized as 100 | Present invention |

TABLE 2-continued

| No. | Emulsion name | Emulsified substance name | Liquid emulsion Absorbance | Liquid emulsion Absorption integrated intensity | Coating film Absorbance | Coating film Absorption integrated intensity | Photographic sensitivity | Standard of sensitivity | Remarks |
|---|---|---|---|---|---|---|---|---|---|
| 14 | Emulsion Y-5 | Emulsified substance A | 87 | 89 | 89 | 88 | 100 | Sample 14 standardized as 100 | Comparative example |
| 15 | Emulsion Y-5 | Emulsified substance E | 97 | 99 | 99 | 98 | 115 | Sample 14 standardized as 100 | Present invention |

Example 2

Silver halide emulsions Em-A to Em-O were prepared by the following processes.

(Preparation of Em-A)

1200 mL of an aqueous solution containing 1.0 g of a low-molecular-weight gelatin whose weight average molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose weight average molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 35 g of gelatin succinate was added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8%, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. The temperature was regulated to 40° C., and 5.6 g, in terms of KI, of the following compound 1 was added. Further, 64 mL of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 55° C., and 1 mg of sodium benzenethiosulfonate was added. Further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively. Thus, tabular grain emulsion A of 1.6 μm average equivalent circle diameter and 0.2 μm average thickness were obtained.

Compound 1

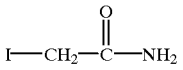

The calcium, magnesium and strontium contents of the thus obtained emulsion were measured by ICP emission spectrochemical analysis. The contents thereof were 15, 2 and 1 ppm, respectively.

The emulsion was heated to 56° C. First, 1 g, in terms of Ag, of an emulsion of 0.05 μm (grain size) pure AgBr fine grains was added to thereby effect shell covering. Subsequently, the following sensitizing dyes 1, 2 and 3 in the form of solid fine dispersion were added in respective amounts of $4.60\times10^{-4}$ mol, $2.40\times10^{-4}$ mol and $7.00\times10^{-6}$ mol per mol of silver. The solid fine dispersions of sensitizing dyes 1, 2 and 3 were prepared in the following manner. Inorganic salts were dissolved in ion-exchanged water, and the sensitizing dye was added. The sensitizing dye was dispersed at 60° C. for 20 min under agitation at 2000 rpm by means of a dissolver blade. Thus, the solid fine dispersions of sensitizing dyes 1, 2 and 3 were obtained. When, after the addition of the sensitizing dyes, the sensitizing dye adsorption reached 90% of the equilibrium-state adsorption, calcium nitrate was added so that the calcium concentration became 250 ppm. The adsorption amount of sensitizing dye was determined by separating the mixture into a solid layer and a liquid layer (supernatant) by centrifugal precipitation and measuring the difference between the amount of initially added sensitizing dye and the amount of sensitizing dye present in the supernatant to thereby calculate the amount of adsorbed sensitizing dye. After the addition of calcium nitrate, potassium thiocyanate, chloroauric acid, sodium thiosulfate, N,N-dimethylselenourea and compound 4 were added to thereby effect the optimum chemical sensitization. N,N-dimethylselenourea was added in an amount of $3.40\times10^{-6}$ mol per mol of silver. Upon the completion of the chemical sensitization, the following compounds 2 and 3 were added to thereby obtain emulsion Em-A.

Spectral sensitizing dye 1

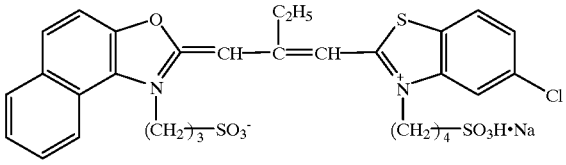

Spectral sensitizing dye 2

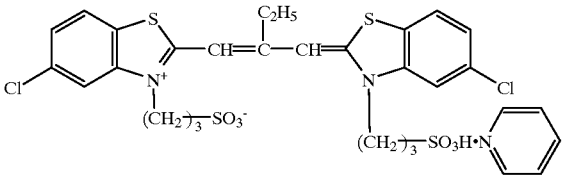

Spectral sensitizing dye 3

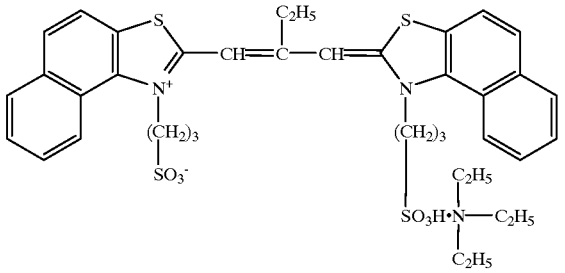

Compound 2

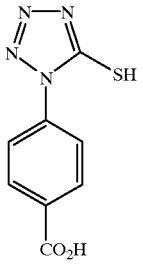

Compound 3

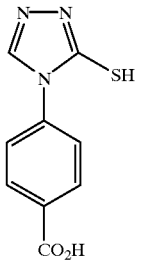

Compound 4

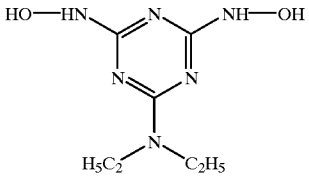

(Preparation of Em-B)

Emulsion Em-B was prepared in the same manner as the emulsion Em-A, except that the amount of KBr added after nucleation was changed to 5 g, that the gelatin succinate was changed to a gelatin converted to trimellitate at a ratio of 98%, the gelatin containing methionine in an amount of 35 μmol per g and having a weight average molecular weight of 100,000, that the compound 1 was changed to 8.0 g, in terms of KI, of compound 6, that the amounts of sensitizing dyes 1, 2 and 3 added prior to the chemical sensitization were changed to $6.50\times10^{-4}$ mol, $3.40\times10^{-4}$ mol and $1.00\times10^{-5}$ mol, respectively, and that the amount of N,N-dimethylselenourea added at the time of chemical sensitization was changed to $4.00\times10^{-6}$ mol.

Compound 5

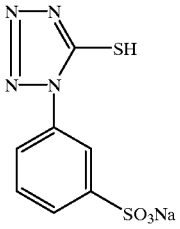

(Preparation of Em-C)

Emulsion Em-B was prepared in the same manner as the emulsion Em-A, except that the amount of KBr added after nucleation was changed to 1.5 g, that the gelatin succinate was changed to a gelatin converted to phthalate a ratio of 97%, the gelatin containing methionine in an amount of 35 μmol per g and having a weight average molecular weight of 100,000, that the compound 1 was changed to 7.1 g, in terms of KI, of compound 7, that the amounts of sensitizing dyes 1, 2 and 3 added prior to the chemical sensitization were changed to $7.80\times10^{-4}$ mol, $4.08\times10^{-4}$ mol and $1.20\times10^{-5}$ mol, respectively, and that the amount of N,N-dimethylselenourea added at the time of chemical sensitization was changed to $5.00\times10^{-6}$ mol.

Compound 6

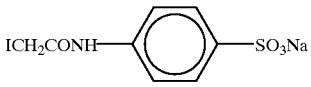

(Preparation of Em-E)

1200 mL of an aqueous solution containing 1.0 g of a low-molecular-weight gelatin whose weight average molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose weight average molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 15 g of gelatin succinate and 20 g of the above gelatin trimellitate were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8%, and the silver potential was maintained at −25 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. KBr was added so that the potential became −60 mV. Thereafter, 1 mg of sodium benzenethiosulfonate was added, and, further, 13 g of lime-processed gelatin having a calcium concentration of 1 ppm was added. After the completion of the addition, while continuously adding 8.0 g, in terms of KI, of AgI fine grain emulsion of 0.008 μm average equivalent sphere diameter (prepared by, just prior to addition, mixing together an aqueous solution of a low-molecular-weight gelatin whose weight average molecular weight was 15,000, an aqueous solution of $AgNO_3$ and an aqueous solution of KI in a separate chamber furnished with a magnetic coupling induction type agitator as described in JP-A-10-43570), an aqueous solution of KBr and 250 mL of an aqueous solution containing 70 g of $AgNO_3$ were added over a period of 20 min with the potential maintained at −60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-A, except that the sensitizing dyes 1, 2 and 3 were changed to the following sensitizing dyes 4, 5 and 6, respectively, whose addition amounts in terms of KI were $7.73\times10^{-4}$ mol, $1.65\times10^{-4}$ mol and $6.20\times10^{-5}$ mol, respectively. Thus, Emulsion Em-E was obtained.

Spectral sensitizing dye 4

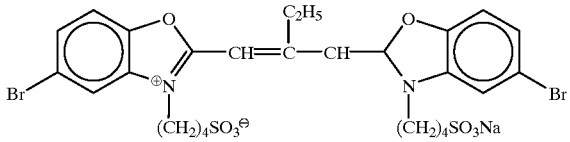

Spectral sensitizing dye 5

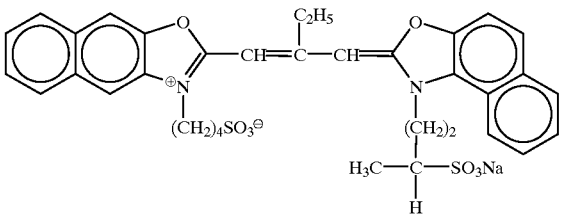

-continued

Spectral sensitizing dye 6

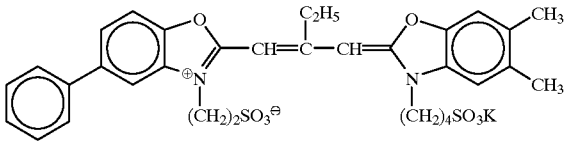

(Preparation of Em-F)

1200 mL of an aqueous solution containing 1.0 g of a low-molecular-weight gelatin whose weight average molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose weight average molecular weight was 15,000 were added by the double jet method over a period of 30 sec to thereby effect a nucleation. During the period, KBr excess concentration was held constant. 5 g of KBr was added and heated to 75° C., and the mixture was ripened. After the completion of ripening, 20 g of gelatin succinate and 15 g of gelatin phthalate were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8%, and the silver potential was maintained at −25 mV.

Still further, an aqueous solution of KBr and 132 mL of an aqueous solution containing 35 g of $AgNO_3$ were added by the double jet method over a period of 7 min. An aqueous solution of KBr was added so as to regulate the potential to −60 mV. Thereafter, 9.2 g, in terms of KI, of a 0.03 μm (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-B, except that the sensitizing dyes 1, 2 and 3 were changed to the sensitizing dyes 4, 5 and 6, respectively, whose addition amounts were $8.50\times10^{-4}$ mol, $1.82\times10^{-4}$ mol and $6.82\times10^{-5}$ mol, respectively. Thus, Emulsion Em-F was obtained.

(Preparation of Em-G)

1200 mL of an aqueous solution containing 1.0 g of a low-molecular-weight gelatin whose weight average molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose weight average molecular weight was 15,000 were added by the double jet method over a period of 30 sec to thereby effect a nucleation. During the period, KBr excess concentration was held constant. 1.5 g of KBr was added and heated to 75° C., and the mixture was ripened. After the completion of ripening, 15 g of the above gelatin trimellitate and 20 g of the above gelatin phthalate were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8%, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential became −60 mV. Thereafter, 7.1 g, in terms of KI, of a 0.03 μm (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-C, except that the sensitizing dyes 1, 2 and 3 were changed to the sensitizing dyes 4, 5 and 6, respectively, whose addition amounts were $1.00\times10^{-3}$ mol, $2.15\times10^{-4}$ mol and $8.06\times10^{-5}$ mol, respectively. Thus, Emulsion Em-G was obtained.

(Preparation of Em-J)

Emulsion Em-J was prepared in the same manner as the emulsion Em-B, except that the sensitizing dyes added prior to the chemical sensitization were changed to the following sensitizing dyes 7 and 8 whose addition amounts were $7.65\times10^{-4}$ mol and $2.47\times10^{-4}$ mol, respectively.

Spectral sensitizing dye 7

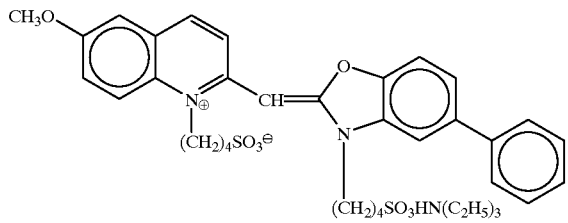

Spectral sensitizing dye 8

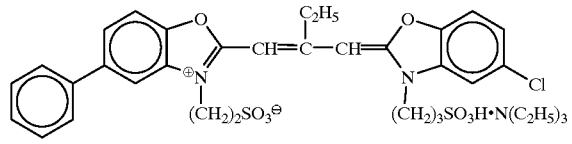

(Preparation of Em-L)

Preparation of Silver Bromide Seed Crystal Emulsion

A silver bromide tabular emulsion having an average equivalent sphere diameter of 0.6 μm and an aspect ratio of 9.0 and containing 1.16 mol of silver and 66 g of gelatin per kg of emulsion was provided.

(Growth Step 1)

0.3 g of a modified silicone oil was added to 1250 g of an aqueous solution containing 1.2 g of potassium bromide and a gelatin converted to succinate at a ratio of 98%. The above silver bromide tabular emulsion was added in an amount containing 0.086 mol of silver and, while maintaining the temperature at 78° C., agitated. Further, an aqueous solution containing 18.1 g of silver nitrate and 5.4 mol, per added silver, of the above silver iodide fine grains of 0.037 μm equivalent sphere diameter were added. During this period, also, an aqueous solution of potassium bromide was added by double jet while regulating the addition so that the pAg was 8.1.

(Growth Step 2)

2 mg of sodium benzenethiosulfonate was added, and thereafter 0.45 g of disodium salt of 3,5-disulfocatechol and 2.5 mg of thiourea dioxide were added.

Further, an aqueous solution containing 95.7 g of silver nitrate and an aqueous solution of potassium bromide were added by double jet while increasing the flow rate over a period of 66 min. During this period, 7.0 mol, per added silver, of the above silver iodide fine grains of 0.037 μm equivalent sphere diameter were added. The amount of potassium bromide added by double jet was regulated so that the pAg was 8.1. After the completion of the addition, 2 mg of sodium benzenethiosulfonate was added.

(Growth Step 3)

An aqueous solution containing 19.5 g of silver nitrate and an aqueous solution of potassium bromide were added by double jet over a period of 16 min. During this period, the amount of the aqueous solution of potassium bromide was regulated so that the pAg was 7.9.

(Addition of Silver Halide Emulsion of Low Solubility 4)

The above host grains were adjusted to 9.3 in pAg with the use of an aqueous solution of potassium bromide. Thereafter, 25 g of the above silver iodide fine grain emulsion of 0.037 μm equivalent sphere diameter was rapidly added within a period of 20 sec.

(Formation of outermost shell layer 5)

Further, an aqueous solution containing 34.9 g of silver nitrate was added over a period of 22 min.

The obtained emulsion consisted of tabular grains having an average aspect ratio of 9.8 and an average equivalent sphere diameter of 1.4 $\mu$m, wherein the average silver iodide content was 5.5 mol.

(Chemical sensitization)

The emulsion was washed, and a gelatin converted to succinate at a ratio of 98% and calcium nitrate were added. At 40° C., the pH and pAg were adjusted to 5.8 and 8.7, respectively. The temperature was raised to 60° C., and $5\times10^{-3}$ mol of 0.07 $\mu$m silver bromide fine grain emulsion was added. 20 min later, the following sensitizing dyes 9, 10 and 11 were added. Thereafter, potassium thiocyanate, chloroauric acid, sodium thiosulfate, N,N-dimethylselenourea and compound 4 were added to thereby effect the optimum chemical sensitization. Compound 3 was added 20 min before the completion of the chemical sensitization, and compound 5 was added at the completion of the chemical sensitization. The terminology "optimum chemical sensitization" used herein means that the sensitizing dyes and compounds are added in an amount selected from among the range of $10^{-1}$ to $10^{-8}$ mol per mol of silver halide so that the speed exhibited when exposure is conducted at 1/100 becomes the maximum.

Spectral sensitizing dye 9

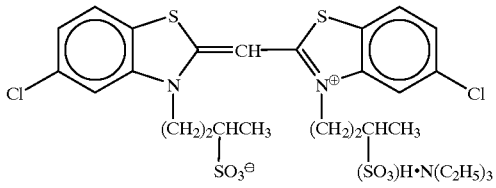

Spectral sensitizing dye 10

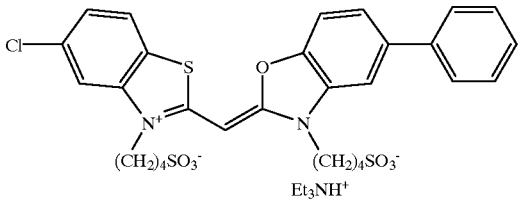

Spectral sensitizing dye 11

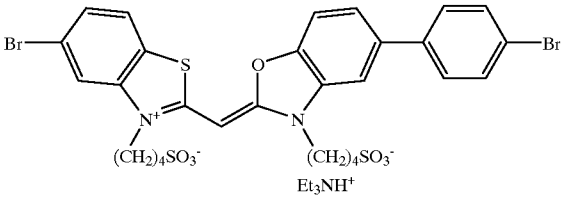

-continued

Compound 7

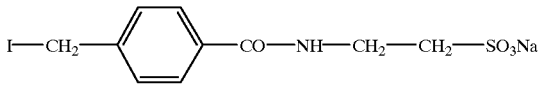

(Preparation of Em-O)

An aqueous solution of gelatin (1250 mL of distilled water, 48 g of deionized gelatin and 0.75 g of KBr) was placed in a reaction vessel equipped with an agitator. The temperature of the aqueous solution was maintained at 70° C. 276 mL of an aqueous solution of $AgNO_3$ (containing 12.0 g of $AgNO_3$) and an equimolar-concentration aqueous solution of KBr were added thereto by the controlled double jet addition method over a period of 7 min while maintaining the pAg at 7.26. The mixture was cooled to 68° C., and 7.6 mL of 0.05% by weight thiourea dioxide was added.

Subsequently, 592.9 mL of an aqueous solution of $AgNO_3$ (containing 108.0 g of $AgNO_3$) and an equimolar-concentration aqueous solution of a mixture of KBr and KI (2.0 mol % KI) were added by the controlled double jet addition method over a period of 18 min 30 sec while maintaining the pAg at 7.30. Further, 18.0 mL of 0.1% by weight thiosulfonic acid was added 5 min before the completion of the addition.

The obtained grains consisted of cubic grains having an average equivalent sphere diameter of 0.19 $\mu$m and an average silver iodide content of 1.8 mol %.

The obtained emulsion Em-O was desalted and washed by the customary flocculation method, and re-dispersed. At 40° C., the pH and pAg were adjusted to 6.2 and 7.6, respectively.

The resultant emulsion Em-O was subjected to the following spectral sensitization and chemical sensitization.

Based on silver, $3.37\times10^{-4}$ mol/mol of each of sensitizing dyes 10, 11 and 12, $8.82\times10^{-4}$ mol/mol of KBr, $8.83\times10^{-5}$ mol/mol of sodium thiosulfate, $5.95\times10^{-4}$ mol/mol of potassium thiocyanate and $3.07\times10^{-5}$ mol/mol of potassium chloroaurate were added. Ripening thereof was performed at 68° C. for a period, which period was regulated so that the speed exhibited when exposure was conducted at 1/100 became the maximum.

Spectral sensitizing dye 12

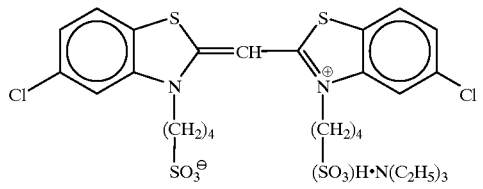

(Em-D, H, I, K, M, N)

In the preparation of tabular grains, a low-molecular-weight gelatin was used in conformity with Examples of JP-A-1-158426. Gold sensitization, sulfur sensitization and selenium sensitization were carried out in the presence of spectral sensitizing dye listed in Table 3 and sodium thiocyanate in conformity with Examples of JP-A-3-237450. Emulsions D, H, I and K contained the optimum amount of Ir and Fe. For the emulsions M and N, reduction sensitization was carried out with the use of thiourea dioxide and thiosulfonic acid at the time of grain preparation in conformity with Examples of JP-A-2-191938.

TABLE 3

| Emulsion | sensitizing dye |
|---|---|
| Em-D | sensitizing dye 1 |
| | sensitizing dye 2 |
| | sensitizing dye 3 |
| Em-H | sensitizing dye 8 |
| | sensitizing dye 13 |
| | sensitizing dye 6 |
| Em-I | sensitizing dye 8 |
| | sensitizing dye 13 |
| | sensitizing dye 6 |
| Em-K | sensitizing dye 7 |
| | sensitizing dye 8 |
| Em-M | sensitizing dye 9 |
| | sensitizing dye 10 |
| | sensitizing dye 11 |
| Em-N | sensitizing dye 9 |
| | sensitizing dye 10 |
| | sensitizing dye 11 |

Spectral sensitizing dye 13

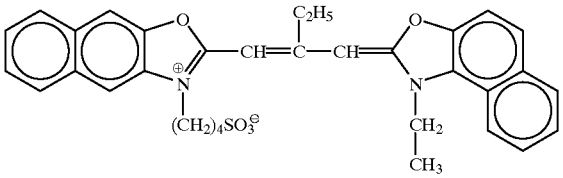

Dislocation lines as described in JP-A-3-237450 were observed in the tabular grains when the observation was conducted through a high-voltage electron microscope.

Preparation of Emulsion Em-P According to Invention

Emulsion Em-P was prepared in the same manner as photographing would be increased. in the preparation of emulsion Em-A, except that the amount of $AgNO_3$ for nucleation was increased 1.5-fold to thereby obtain tabular grains having an average equivalent circle diameter of 1.4 $\mu$m and an average thickness of 0.15 $\mu$m, and except that the chemical sensitization and ensuing steps were changed as follow. The emulsion was heated to 56° C., and, first, 1 g, in terms of Ag, of an emulsion of 0.05 $\mu$m (grain size) pure AgBr fine grains was added to thereby effect shell covering. Subsequently, the sensitizing dye D-41 according to the present invention was added in an amount of $9\times10^{-4}$ mol per mol of silver. Calcium nitrate was added in the same manner as in the preparation of emulsion Em-A, and, thereafter, there were added potassium thiocyanate, bis(1,4,5-trimethyl-1,2,4-triazolium-3-thiolatogold) (1) tetrafluoroborate, N,N'-dimethyl-{N,N'-bis(carboxymethyl)}thiourea, N,N-dimethylselenourea, compound 4 and compound 2 plus compound 3. Thus, emulsion Em-P was obtained. The spectral absorption maximum wavelength was 635 nm and the light absorption intensity was 123.

Preparation of Emulsion Em-Q According to Invention

Emulsion Em-Q was prepared in the same manner as in the preparation of emulsion Em-E, except that the amount of $AgNO_3$ for nucleation was changed to 4.5 g to thereby obtain tabular grains having an average equivalent circle diameter of 1.3 $\mu$m and an average thickness of 0.12 $\mu$m, and except that the chemical sensitization and ensuing steps were changed as follow. The same chemical sensitization as in the preparation of emulsion Em-P was carried out, except that the sensitizing dye was changed to D-39 and that the addition amount thereof was $1.15\times10^{-3}$ mol per mol of silver. Thus, emulsion Em-Q was obtained. The spectral absorption maximum wavelength was 552 nm and the light absorption intensity was 118.

Preparation of Emulsion Em-R According to Invention

Emulsion Em-R was prepared in the same manner as in the preparation of emulsion Em-L, except that the amount of seed crystal emulsion was increased 1.3-fold to thereby obtain tabular grains having an average equivalent circle diameter of 1.05 $\mu$m and an average thickness of 0.17 $\mu$m, and except that the chemical sensitization and ensuing steps were changed as follow. Emulsion Em-R was prepared in the same manner as in the preparation of emulsion Em-L, except that the addition amount of sensitizing dye D-37 was changed to $7\times10^{-4}$ mol per mol of silver. The spectral absorption maximum wavelength was 475 nm and the light absorption intensity was 101.

Samples were prepared by coating cellulose triacetate film supports each having a subbing layer with emulsions Em-P, -Q and -R according to the present invention and emulsions Em-A, -E and -L having undergone the above chemical sensitization, to which the compounds S-1 and A-1 according to the present invention were added in the same amount as in Example 1, with protective layers superimposed thereon, under the coating conditions specified in the following Table 4. Values of the absorption spectrum absorbance maximum and absorption integrated intensity ranging from 400 nm to 700 nm were compared with respect to the coating samples coated with the Em-P, -Q and -R of the present invention after storage at 60° C. in 30% humidity for 3 days on the basis of those of the coating samples immediately after the coating as a standard of 100. With respect to all the coating samples coated with the Em-P, -Q and -R of the present invention, the absorption spectrum absorbance maximum and absorption integrated intensity ranging from 400 nm to 700 nm were 95 or more.

TABLE 4

| Coating conditions of emulsions | |
|---|---|
| (1) Emulsion layer | |
| Emulsion: various emulsions | (Silver $2.1 \times 10^{-2}$ mol/m$^2$) |
| Coupler | ($1.5 \times 10^{-3}$ mol/m$^2$) |
| 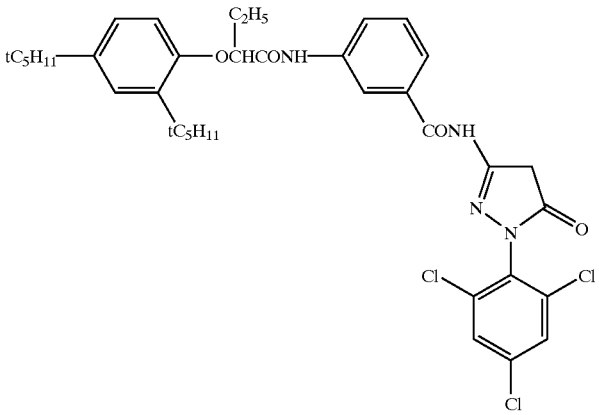 | |
| 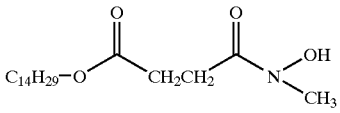 | ($1.1 \times 10^{-4}$ mol/m$^2$) |
| Compound S-1 according to the present invention | (1.10 g/m$^2$) |
| Gelatin | (2.30 g/m$^2$) |
| (2) Protective layer | |
| 2,4-dichloro-6-hydroxy-s-triazine sodium salt. | (0.08 g/m$^2$) |
| Gelatin | (1.80 g/m$^2$) |

These samples were allowed to stand still at 40° C. in a relative humidity of 70% for 14 hr. Thereafter, with respect to red-sensitive emulsions and green-sensitive emulsions, the samples were exposed through gelatin filter SC-50 produced by Fuji Photo Film Co., Ltd. and a continuous wedge for 1/100 sec. With respect to blue-sensitive emulsions, the samples were exposed through gelatin filter SC-39 produced by Fuji Photo Film Co., Ltd. and a continuous wedge for 1/100 sec.

The samples were processed with the use of Negative Processor FP-350 manufactured by Fuji Photo Film Co., Ltd. in accordance with the following method (until the cumulative amount of replenisher became thrice the tank volume of mother liquor).

(Processing Steps)

| Step | Time | Temp. ° C. | Replenishment rate |
|---|---|---|---|
| Color development | 3 min 15 sec | 38 | 45 mL |
| Bleaching | 1 min 00 sec | 38 | 20 mL whole of bleaching soln. overflow flows into bleach-fix tank |

-continued

| Step | Time | Temp. ° C. | Replenishment rate |
|---|---|---|---|
| Bleach-fix | 3 min 15 sec | 38 | 30 mL |
| Water washing (1) | 40 sec | 35 | countercurrent piping from (2) to (1) |
| Water washing (2) | 1 min 00 sec | 35 | 30 mL |
| Stabilization | 40 sec | 38 | 20 mL |
| Drying | 1 min 15 sec | 55 | |

The replenishment rate is represented by a value per 1.1 m of a 35-mm wide sample (equivalent to one 24 Ex. film).

The composition of each processing solution was as follows.

| (Color developer) | Tank soln. (g) | Replenisher (g) |
|---|---|---|
| Diethylenetriamine pentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |

-continued

| (Color developer) | Tank soln. (g) | Replenisher (g) |
|---|---|---|
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water | q.s. ad 1.0 L | |
| pH | 10.05 | 10.10. |

This pH was adjusted by the use of sulfuric acid and potassium hydroxide.

(Bleaching Soln.) common to tank soln. and replenisher (unit: g)

| | |
|---|---|
| Fe(III) ammonium ethylenediaminetetraacetate dihydrate | 20.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Aq. ammonia (27%) | 15.0 mL |
| Water | q.s. ad 1.0 L |
| pH | 6.3 |

This pH was adjusted by the use of aqueous ammonia and nitric acid.

| (Bleach-fix) | Tank soln. (g) | Replenisher (g) |
|---|---|---|
| Fe(III) ammonium ethylenediaminetetraacetate dihydrate | 50.0 | — |
| Disodium ethylenediaminetetraacetate | 5.0 | 2.0 |
| Sodium sulfite | 12.0 | 20.0 |
| Aq. soln. of ammonium thiosulfate (700 g/L) | 240.0 mL | 400.0 mL |
| Aq. ammonia (27%) | 6.0 mL | — |
| Water | q.s. ad 1.0 L | |
| pH | 7.2 | 7.3. |

This pH was adjusted by the use of aqueous ammnia and acetic acid.

(Washing water): common to tank solution and replenisher.

Tap water was passed through a mixed-bed column filled with an H type strongly acidic cation exchange resin (Amberlite IR-120B: available from Rohm & Haas Co.) and an OH type anion exchange resin (Amberlite IR-400) to adjust the concentrations of calcium and magnesium ions to be 3 mg/L or less. Subsequently, 20 mg/L of sodium dichloroisocyanurate and 0.15 g/L of sodium sulfate were added. The pH of the solution ranged from 6.5 to 7.5.

| (Stabilizer): | common to tank solution and replenisher (unit: g) |
|---|---|
| Sodium p-toluenesulfinate | 0.03 |
| Polyoxyethylene p-monononylphenyl ether (average polymerization degree 10) | 0.2 |
| Disodium ethylenediaminetetraacetate | 0.05 |
| 1,2,4-triazole | 1.3 |
| 1,4-bis(1,2,4-triazol-1-ylmethyl)-piperazine | 0.75 |
| Water | q.s. ad 1.0 L |
| pH | 8.5. |

The density of each of the processed samples was measured with the use of a green filter. The sensitivity was expressed by the relative value of inverse number of exposure required for producing a density of fog density plus 0.2. γ was expressed by the slope at a density of 1.0. The RMS granularity was determined by sequentially performing uniform exposure with a light quantity capable of realizing a density of 0.2, the above development processing and measuring in accordance with the method described on page 619 of "The Theory of The Photographic Process" published by Macmillan. The obtained results are listed in Table 5. With respect to the photographic speed and RMS granularity, those of the comparative emulsions Em-A, Em-E and Em-L corresponding to the emulsions Em-P, Em-Q and Em-R according to the present invention were postulated as being 100.

TABLE 5

| Emulsion name | Sensitizing dye | Grain Size (μm) | Sensitivity | Fog | γ | Granularity | Remarks |
|---|---|---|---|---|---|---|---|
| Em-A | Sensitizing dyes 1, 2 and 3 | 0.95 | 100 | 0.20 | 1.0 | 100 | Comparative example |
| Em-P | D-41 | 0.80 | 103 | 0.20 | 1.11 | 89 | Present invention |
| Em-E | Sensitizing dyes 4, 5 and 6 | 0.92 | 100 | 0.30 | 1.05 | 100 | Comparative example |
| Em-Q | D-39 | 0.72 | 104 | 0.29 | 1.13 | 84 | Present invention |
| Em-L | Sensitizing dyes 9, 10 and 11 | 1.33 | 100 | 0.28 | 1.02 | 100 | Comparative example |
| Em-R | D-37 | 1.10 | 103 | 0.26 | 1.06 | 87 | Present invention |

As apparent from Table 5, the multilayer adsorption emulsion of the present invention exhibits high photographic speed and excellent granularity despite the small size.

1) Support

The support employed in the present invention was prepared in the following manner.

1) First Layer and Subbing Layer

Both major surfaces of a 90 μm thick polyethylene naphthalate (PEN) support were treated with glow discharge under such conditions that the treating ambient pressure was 2.66×10 Pa, the $H_2O$ partial pressure of ambient gas 75%, the discharge frequency 30 kHz, the output 2500 W, and the treating strength 0.5 kV·A·min/m$^2$. This support was coated, in a coating amount of 5 mL/m$^2$, with a coating liquid of the following composition to provide the 1st layer in accordance with the bar coating method described in JP-B-58-4589.

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts. mass. |
| Gelatin | 0.5 pt. mass. |
| Water | 49 pts. mass. |
| Polyglycerol polyglycidyl ether | 0.16 pt. mass. |
| Polyoxyethylene sorbitan monolaurate (polymn. degree 20) | 0.1 pt. mass. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/m$^2$, with a coating liquid of the following composition to provide a subbing layer for emulsion in accordance with the bar coating method.

| | |
|---|---|
| Gelatin | 1.01 pts. mass. |
| Salicylic acid | 0.30 pt. mass. |
| Resorcin | 0.40 pt. mass. |
| Polyoxyethylene nonylphenyl ether (polymn. degree 10) | 0.11 pt. mass. |
| Water | 3.53 pts. mass. |
| Methanol | 84.57 pts. mass. |
| n-Propanol | 10.08 pts. mass. |

Furthermore, the following second layer and third layer were superimposed in this sequence on the first layer by coating. Finally, multilayer coating of a color negative lightsensitive material of the composition indicated below was performed on the opposite side. Thus, a transparent magnetic recording medium with silver halide emulsion layer was obtained.

2) Second layer (transparent magnetic recording layer):

(i) Dispersion of magnetic substance:

1100 parts by weight of Co-coated γ-$Fe_2O_3$ magnetic substance (average major axis length: 0.25 μm, $S_{BET}$: 39 m$^2$/g, Hc: 6.56×10$^4$ A/m, σs: 77.1 Am$^2$/kg, and σr: 37.4 Am$^2$/kg), 220 parts by weight of water and 165 parts by weight of silane coupling agent (3-(poly(polymerization degree:

10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr:

| | |
|---|---|
| Thus obtained surface treated magnetic grains | 855 g |
| Diacetylcellulose | 25.3 g |
| Methyl ethyl ketone | 136.3 g |
| Cyclohexanone | 136.3 g. |

Still further, in accordance with the following recipe, a composition was prepared by carrying out fine dispersion by means of a sand mill (¼ G sand mill) at 2000 rpm for 4 hr. Glass beads of 1 mm diameter were used as medium.

| | |
|---|---|
| Thus obtained blend liquid | 45 g |
| Diacetylcellulose | 23.7 g |
| Methyl ethyl ketone | 127.7 g |
| Cyclohexanone | 127.7 g. |

Moreover, in accordance with the following recipe, a magnetic substance containing intermediate liquid was prepared.

(ii) Preparation of Magnetic Substance Containing Intermediate Liquid:

| | |
|---|---|
| Thus obtained fine dispersion of magnetic substance | 674 g |
| Diacetylcellulose soln. (solid content 4.34%, solvent: methyl ethyl ketone/cyclohexanone = 1/1) | 24,280 g |
| Cyclohexanone | 46 g. |

These were mixed together and agitated by means of a disperser to thereby obtain a "magnetic substance containing intermediate liquid".

An α-alumina abrasive dispersion of the present invention was produced in accordance with the following recipe.

(a) Preparation of Sumicorundum AA-1.5 (average primary grain diameter: 1.5 μm, specific surface area: 1.3 m$^2$/g) grain dispersion

| | |
|---|---|
| Sumicorundum AA-1.5 | 152 g |
| Silane coupling agent KBM903 (produced by Shin-Etsu Silicone) | 0.48 g |
| Diacetylcellulose soln. (solid content 4.5%, solvent: methyl ethyl ketone/cyclohexanone = 1/1) | 227.52 g. |

In accordance with the above recipe, fine dispersion was carried out by means of a ceramic-coated sand mill (¼ G sand mill) at 800 rpm for 4 hr. Zirconia beads of 1 mm diameter were used as medium.

(b) Colloidal silica grain dispersion (fine grains)

Use was made of "MEK-ST" produced by Nissan Chemical Industries, Ltd.

This is a dispersion of colloidal silica of 0.015 μm average primary grain diameter in methyl ethyl ketone as a dispersion medium, wherein the solid content is 30%.

(iii) Preparation of a coating liquid for second layer:

| | |
|---|---|
| Thus obtained magnetic substance containing intermediate liquid | 19,053 g |
| Diacetylcellulose soln. (solid content 4.5%, solvent: methyl ethyl ketone/cyclohexanone = 1/1) | 264 g |

-continued

| | |
|---|---|
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) dilution (solid content 20%, diluent solvent: methyl ethyl ketone/cyclohexanone = 1/1) | 203 g |
| Methyl ethyl ketone | 170 g |
| Cyclohexanone | 170 g. |

A coating liquid obtained by mixing and agitating these was applied in a coating amount of 29.3 mL/m$^2$ with the use of a wire bar. Drying was performed at 110° C. The thickness of magnetic layer after drying was 1.0 $\mu$m.

3) Third Layer (higher fatty acid ester sliding agent containing layer)

(i) Preparation of raw dispersion of sliding agent

The following liquid A was heated at 100° C. to thereby effect dissolution, added to liquid B and dispersed by means of a high-voltage homogenizer, thereby obtaining a raw dispersion of sliding agent.

Liquid A Compd. of the formula:

| | |
|---|---|
| $C_6H_{13}CH(OH)(CH_2)_{10}COOC_{50}H_{101}$ Compd. of the formula: | 399 pts.mass. |
| $n\text{-}C_{50}H_{101}O(CH_2CH_2O)_{16}H$ | 171 pts.mass. |
| Cyclohexanone | 830 pts. mass. |
| Liquid B | |
| Cyclohexanone | 8600 pts. mass. |

(ii) Preparation of spherical inorganic grain dispersion

Spherical inorganic grain dispersion (cl) was prepared in accordance with the following recipe.

| | |
|---|---|
| Isopropyl alcohol | 93.54 pts. mass. |

Silane coupling agent KBM903 (produced by Shin-Etsu Silicone) Compd. 1-1: $(CH_3O)_3Si—(CH_2)_3—NH_2$) 5.53 pts. mass.

| | |
|---|---|
| Compd. 8 Compound 8 | 2.93 pts. mass. |

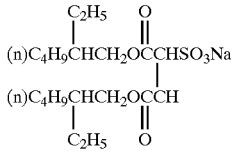

Seahoster KEP50 (amorphous spherical silica, av. grain size 0.5 $\mu$m, produced by Nippon Shokubai

| | |
|---|---|
| Kagaku Kogyo | 88.00 pts.mass. |
| This composition was agitated for 10 min, and further the following was added | 252.93 pts.mass. |
| Diacetone alcohol | |

The resultant liquid was dispersed by means of ultrasonic homogenizer "Sonifier 450 (manufactured by Branson)" for 3 hr while cooling with ice and stirring, thereby finishing spherical inorganic grain dispersion cl.

(iii) Preparation of Spherical Organic Polymer Grain Dispersion

Spherical organic polymer grain dispersion (c2) was prepared in accordance with the following recipe.

| | |
|---|---|
| XC99-A8808 (produced by Toshiba Silicone Co., Ltd., spherical crosslinked polysiloxane grain, av. grain size 0.9 $\mu$m) | 60 pts. mass |
| Methyl ethyl ketone | 120 pts. mass. |
| Cyclohexanone | 120 pts. mass. |

(solid content 20%, solvent: methyl ethyl ketone/cyclohexanone=1/1)

This mixture was dispersed by means of ultrasonic homogenizer "Sonifier 450 (manufactured by Branson)" for 2 hr while cooling with ice and stirring, thereby finishing spherical organic polymer grain dispersion c2.

(iv) Preparation of coating liquid for 3rd layer

A coating liquid for 3rd layer was prepared by adding the following components to 542 g of the aforementioned raw dispersion of sliding agent:

| | |
|---|---|
| Diacetone alcohol | 5950 g |
| Cyclohexanone | 176 g |
| Ethyl acetate | 1700 g |
| Above Seahostar KEP50 dispersion (cl) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g. |

This coating liquid for 3rd layer was applied onto the 2nd layer in a coating amount of 10.35 mL/m$^2$, dried at 110° C. and after-dried at 97° C. for 3 min.

4) Application of lightsensitive layer by coating:

A plurality of layers of the following respective compositions were applied onto the side opposite to the above back layer, thereby obtaining a color negative film.

(Preparation of Sample 1)

The above emulsions A to O were applied in the following manner, thereby obtaining sample 1.

(Composition of Lightsensitive Layer)

Main materials used in each of the layers are classified as follows:

| | |
|---|---|
| ExC: cyan coupler, | UV: ultraviolet absorber, |
| ExM: magenta coupler, | HBS: high b.p. org. solvent, |
| ExY: yellow coupler, | H: gelatin hardener. |

(For each specific compound, in the following description, numeral is assigned after the character, and the formula is shown later).

The numeric value given beside the description of each component is for the coating amount expressed in the unit of g/m$^2$. With respect to the silver halide, the coating amount is in terms of silver quantity.

1st layer (First antihalation layer)

| | | |
|---|---|---|
| Black colloidal silver | silver | 0.122 |
| 0.07 μm silver iodobromide emulsion | silver | 0.01 |
| Gelatin | | 0.919 |
| ExM-1 | | 0.066 |
| ExC-1 | | 0.002 |
| ExC-3 | | 0.002 |
| Cpd-2 | | 0.001 |
| F-8 | | 0.010 |
| HBS-1 | | 0.005 |
| HBS-2 | | 0.002. |

2nd layer (Second antihalation layer)

| | | |
|---|---|---|
| Black colloidal silver | silver | 0.055 |
| Gelatin | | 0.425 |
| ExF-1 | | 0.002 |
| F-8 | | 0.012 |
| Solid disperse dye ExF-9 | | 0.120 |
| HBS-1 | | 0.074. |

3rd layer (Interlayer)

| | | |
|---|---|---|
| ExC-2 | | 0.050 |
| Cpd-1 | | 0.090 |
| Polyethyl acrylate latex | | 0.200 |
| HBS-1 | | 0.100 |
| Gelatin | | 0.700 |

4th layer (Low-speed red-sensitive emulsion layer)

| | | |
|---|---|---|
| Em-D | silver | 0.577 |
| Em-C | silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| ExC-8 | | 0.050 |
| ExC-9 | | 0.020 |
| Cpd-2 | | 0.025 |
| Cpd-4 | | 0.025 |
| HBS-1 | | 0.114 |
| HBS-5 | | 0.038 |
| Gelatin | | 1.474. |

5th layer (Medium-speed red-sensitive emulsion layer)

| | | |
|---|---|---|
| Em-B | silver | 0.431 |
| Em-C | silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.028 |
| HBS-1 | | 0.129 |
| Gelatin | | 1.086. |

6th layer (High-speed red-sensitive emulsion layer)

| | | |
|---|---|---|
| Em-A | silver | 1.108 |
| ExC-1 | | 0.180 |
| ExC-3 | | 0.035 |
| ExC-6 | | 0.029 |
| ExC-8 | | 0.110 |
| ExC-9 | | 0.020 |
| Cpd-2 | | 0.064 |
| Cpd-4 | | 0.077 |
| HBS-1 | | 0.329 |
| HBS-2 | | 0.120 |
| Gelatin | | 1.245. |

7th layer (Interlayer)

| | | |
|---|---|---|
| Cpd-1 | | 0.094 |
| Cpd-6 | | 0.369 |
| Solid disperse dye ExF-4 | | 0.030 |
| HBS-1 | | 0.049 |

-continued

| | | |
|---|---|---|
| Polyethyl acrylate latex | | 0.088 |
| Gelatin | | 0.886. |

8th layer (Layer capable of exerting interlayer effect on red-sensitive layer)

| | | |
|---|---|---|
| Em-J | silver | 0.293 |
| Em-K | silver | 0.293 |
| Cpd-4 | | 0.030 |
| ExM-2 | | 0.120 |
| ExM-3 | | 0.016 |
| ExM-4 | | 0.026 |
| ExY-1 | | 0.016 |
| ExY-6 | | 0.036 |
| ExC-7 | | 0.026 |
| HBS-1 | | 0.090 |
| HBS-3 | | 0.003 |
| HBS-5 | | 0.030 |
| Gelatin | | 0.610. |

9th layer (Low-speed green-sensitive emulsion layer)

| | | |
|---|---|---|
| Em-H | silver | 0.329 |
| Em-G | silver | 0.333 |
| Em-I | silver | 0.088 |
| ExM-2 | | 0.378 |
| ExM-3 | | 0.047 |
| ExY-1 | | 0.017 |
| ExC-7 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470. |

10th layer (Medium-speed green-sensitive emulsion layer)

| | | |
|---|---|---|
| Em-F | silver | 0.457 |
| ExM-2 | | 0.032 |
| ExM-3 | | 0.029 |
| ExM-4 | | 0.029 |
| ExY-5 | | 0.007 |
| ExC-6 | | 0.010 |
| ExC-7 | | 0.010 |
| ExC-8 | | 0.012 |
| HBS-1 | | 0.065 |
| HBS-3 | | 0.002 |
| HBS-5 | | 0.020 |
| Cpd-5 | | 0.004 |
| Gelatin | | 0.446. |

11th layer (High-speed green-sensitive emulsion layer)

| | | |
|---|---|---|
| Em-E | silver | 0.794 |
| ExC-6 | | 0.002 |
| ExC-8 | | 0.010 |
| ExM-1 | | 0.013 |
| ExM-2 | | 0.011 |
| ExM-3 | | 0.030 |
| ExM-4 | | 0.017 |
| ExY-5 | | 0.003 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939. |

12th layer (Yellow filter layer)

| | | |
|---|---|---|
| Cpd-1 | | 0.094 |
| Solid disperse dye ExF-2 | | 0.150 |
| Solid disperse dye ExF-5 | | 0.010 |
| Oil soluble dye ExF-7 | | 0.010 |
| HBS-1 | | 0.049 |
| Gelatin | | 0.630. |

13th layer (Low-speed blue-sensitive emulsion layer)

| | | |
|---|---|---|
| Em-O | silver | 0.112 |
| Em-M | silver | 0.320 |
| Em-N | silver | 0.240 |

-continued

| | | |
|---|---|---|
| ExC-1 | | 0.027 |
| ExC-7 | | 0.013 |
| ExY-1 | | 0.002 |
| ExY-2 | | 0.890 |
| ExY-6 | | 0.058 |
| Cpd-2 | | 0.100 |
| Cpd-3 | | 0.004 |
| HBS-1 | | 0.222 |
| HBS-5 | | 0.074 |
| Gelatin | | 2.058. |
| 14th layer (High-speed blue-sensitive emulsion layer) | | |
| Em-L | silver | 0.714 |
| ExY-2 | | 0.211 |
| ExY-6 | | 0.068 |
| Cpd-2 | | 0.075 |
| Cpd-3 | | 0.001 |
| HBS-1 | | 0.071 |
| Gelatin | | 0.678. |
| 15th layer (1st protective layer) | | |
| 0.07 μm silver iodobromide emulsion | silver | 0.301 |
| UV-1 | | 0.211 |
| UV-2 | | 0.132 |
| UV-3 | | 0.198 |
| UV-4 | | 0.026 |
| F-11 | | 0.009 |
| HBS-10 | | 0.086 |
| HBS-1 | | 0.175 |
| HBS-4 | | 0.050 |
| Gelatin | | 1.984. |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.750. |

In addition to the above components, W-1 to W-5, B-4 to B-6, F-1 to F-17, a lead salt, a platinum salt, an iridium salt and a rhodium salt were appropriately added to the individual layers in order to improve the storage life, processability, resistance to pressure, antiseptic and mildew-proofing properties, antistatic properties and applicability thereof.

Preparation of dispersion of organic solid disperse dye:

The ExF-2 of the 12th layer was dispersed by the following method. Specifically,

| | |
|---|---|
| Wet cake of ExF-2 (contg. 17.6 wt. % water) | 2.800 kg |
| Sodium octylphenyldiethoxymethanesulfonate (31 wt. % aq. sam.) | 0.376 kg |
| F-15 (7% aq. sam.) | 0.011 kg |
| Water | 4.020 kg |
| Total | 7.210 kg |

(adjusted to pH=7.2 with NaOH).

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4, ExF-7 and ExF-9 were obtained in the same manner. The average particle diameters of these dye particulates were 0.28 μm, 0.49 μm and 0.38 μm, respectively. ExF-5 was dispersed by the microprecipitation dispersion method described in Example 1 of EP. No. 549,489A. The average particle diameter thereof was 0.06 μm.

The compounds used in the preparation of each of the layers will be listed below.

ExY-1

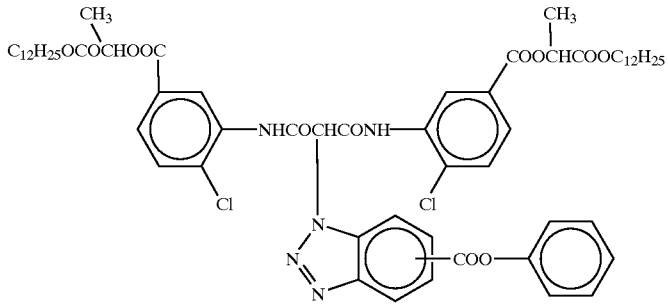

ExY-2

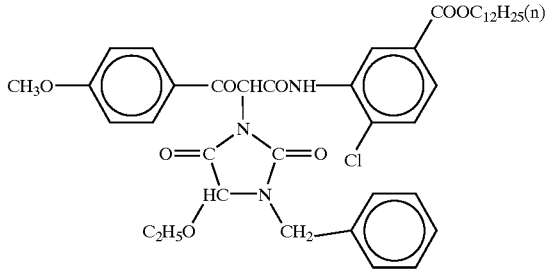

ExY-5

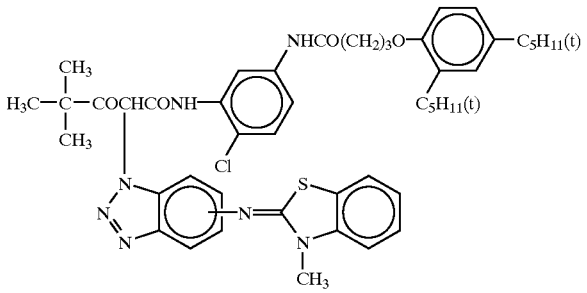

-continued
ExY-6
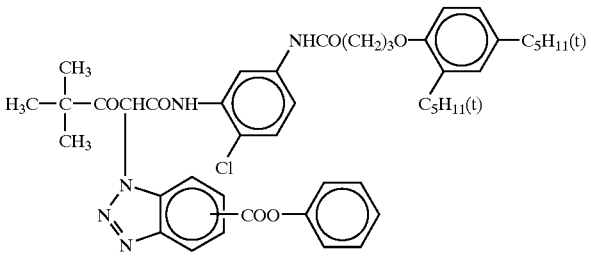
ExY-7
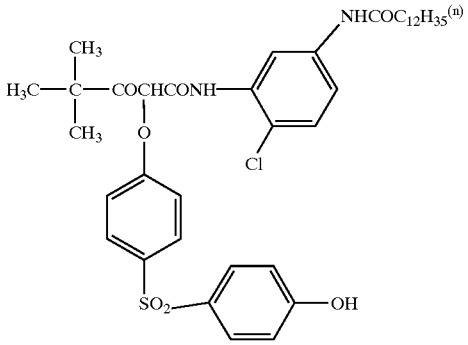
ExC-1
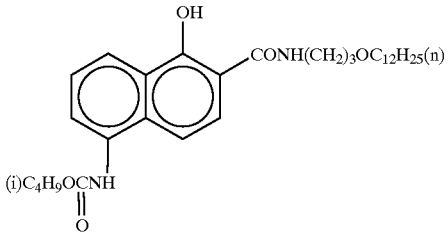
ExC-2
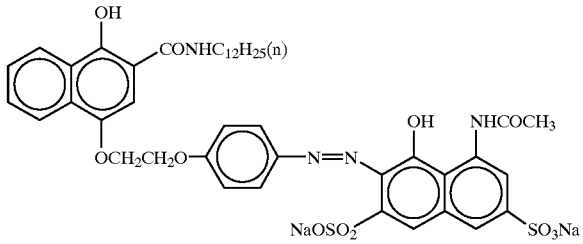
ExC-3
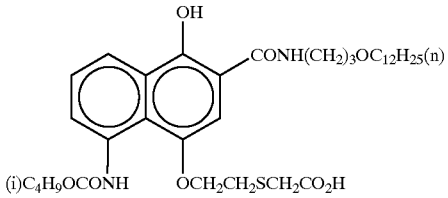
ExC-4
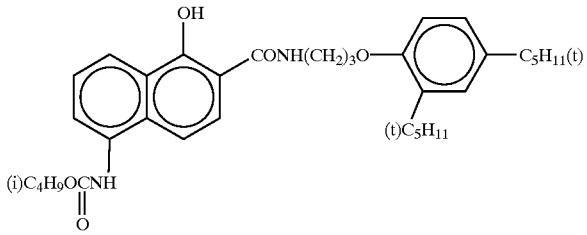
ExC-5
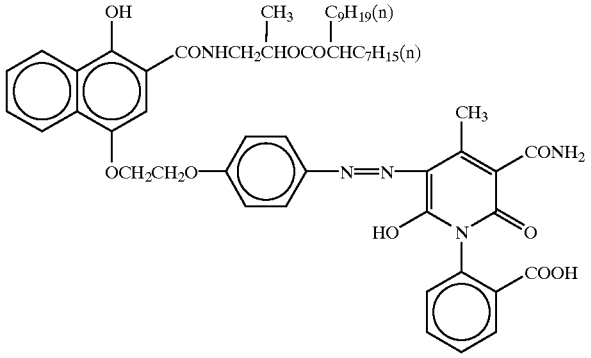
ExC-6
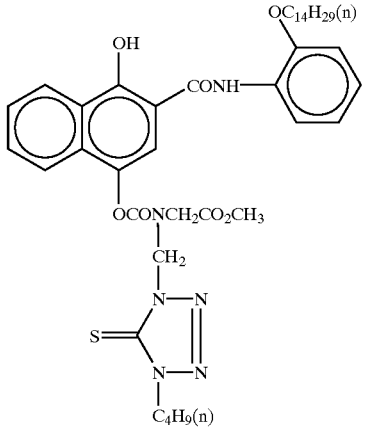
ExC-7
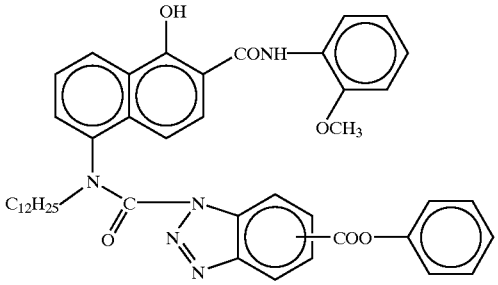
ExC-8
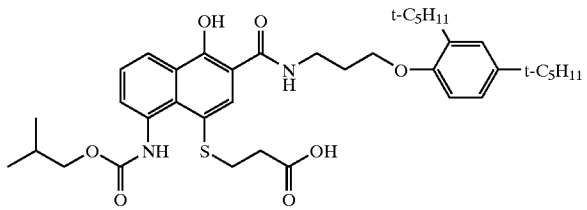

-continued
ExC-9
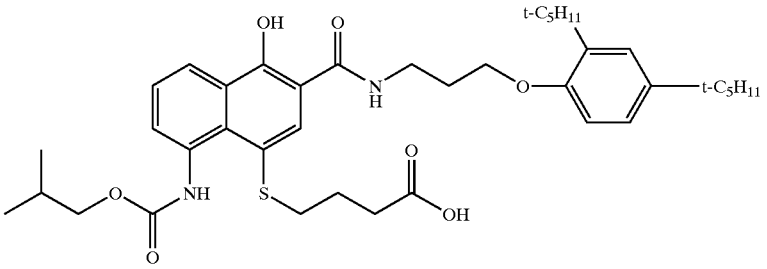
ExM-1
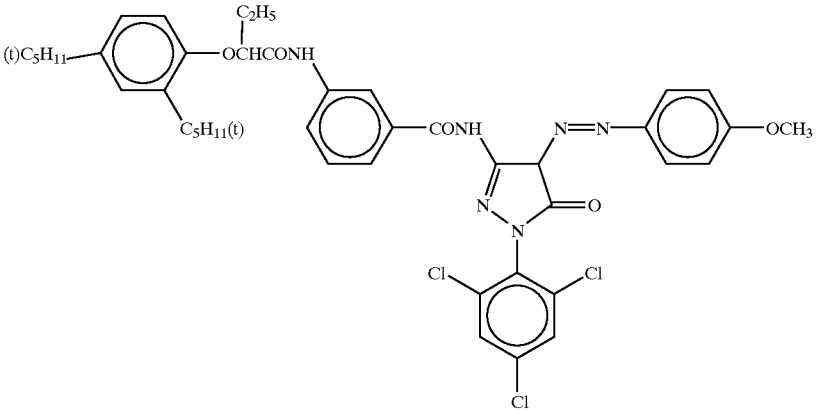
ExM-2
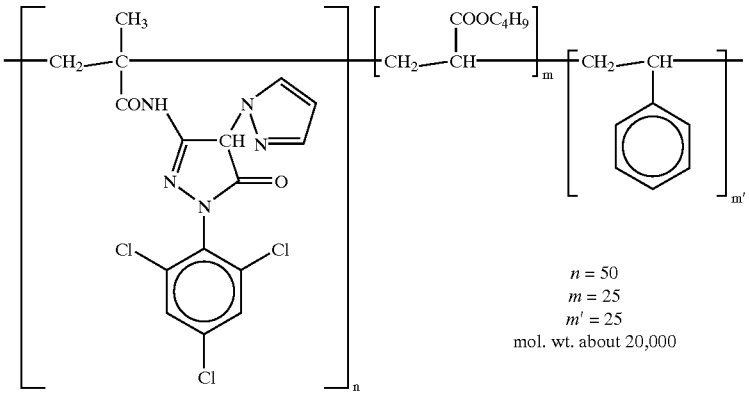
ExM-3
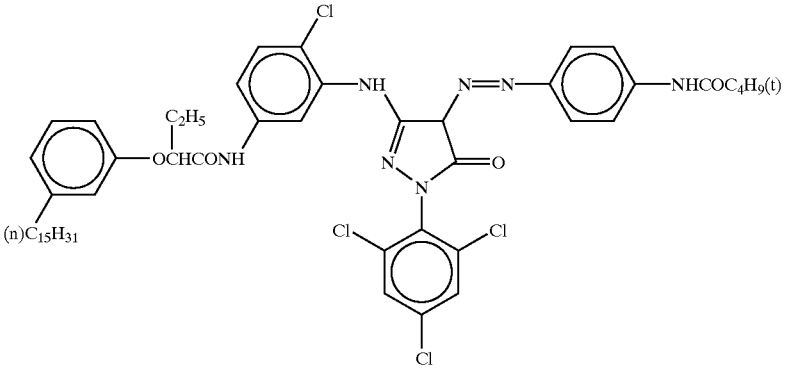

-continued
ExM-4
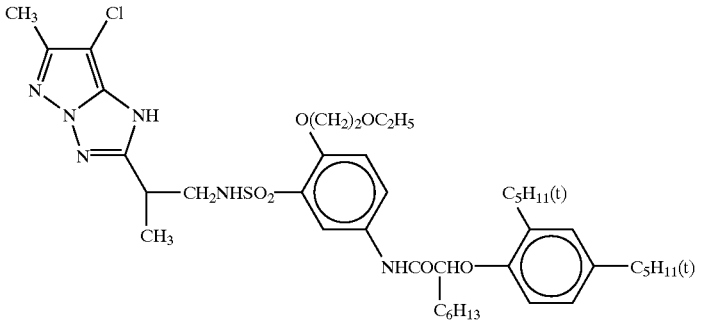
Cpd-1
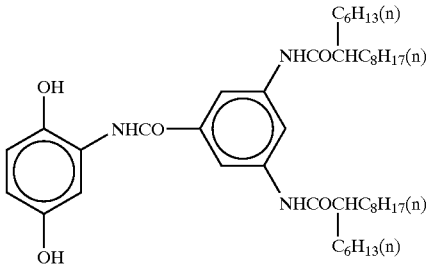
Cpd-2
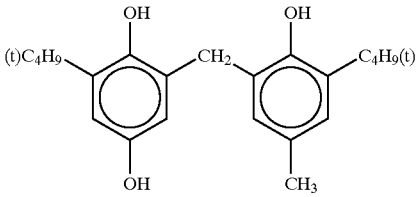
Cpd-3
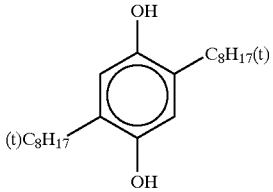
Cpd-4
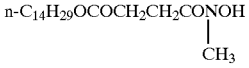
Cpd-5
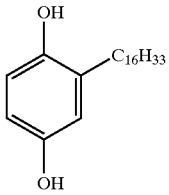
UV-1
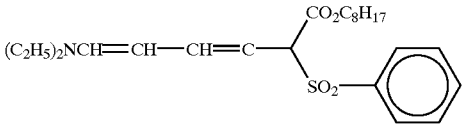
UV-2
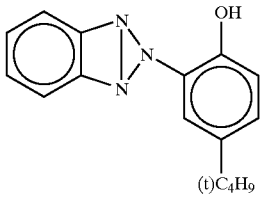
UV-3
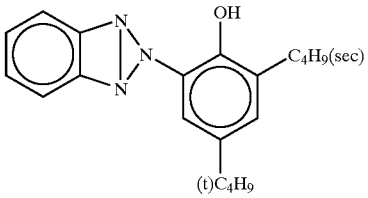
UV-4
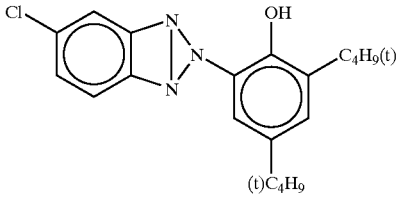
B-1
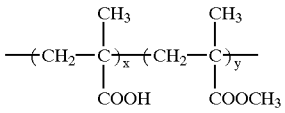
x/y = 10/90 (mass ratio)
weight average molecular weight:
about 35,000

-continued

| | | |
|---|---|---|
| B-2 | 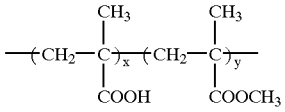 | x/y = 40/60 (mass ratio)<br>weight average molecular weight: about 20,000 |
| B-3 | 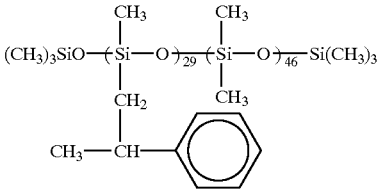 | (mole ratio)<br>weight average molecular weight: about 8,000 |
| B-4 | 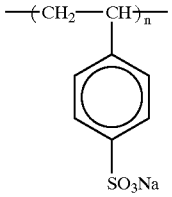 | weight average molecular weight: about 750,000 |
| B-5 | 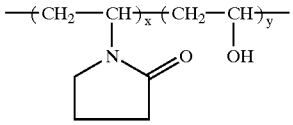 | x/y = 70/30 (mass ratio)<br>weight average molecular weight: about 17,000 |
| B-6 | 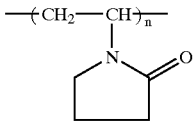 | weight average molecular weight: about 10,000 |

H-1

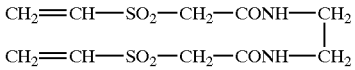

HBS-10

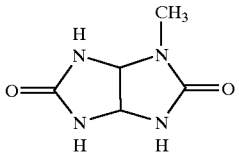

HBS-1 tricresyl phosphate

HBS-2 di-n-butyl phthalate

HBS-3

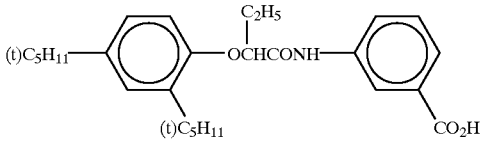

-continued

HBS-4 tri(2-ethylhexyl)phosphate

HBS-5

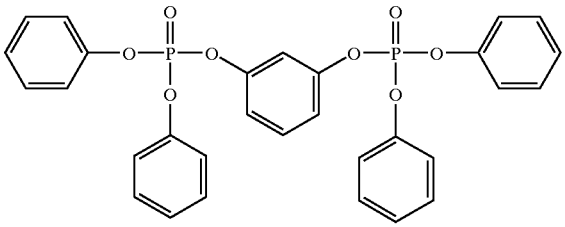

F-1

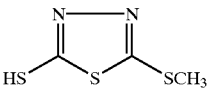

F-2

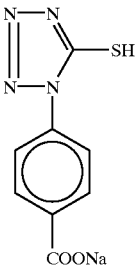

-continued
F-3
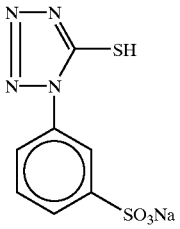
F-4
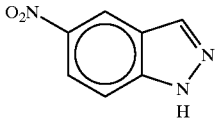
F-5
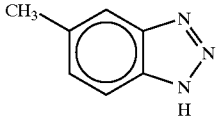
F-6
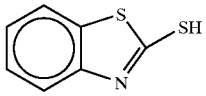
F-7
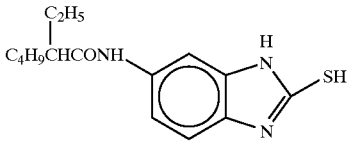
F-8
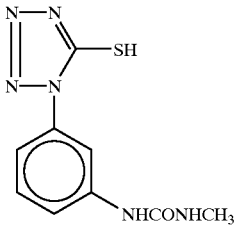
F-9
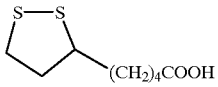
F-10
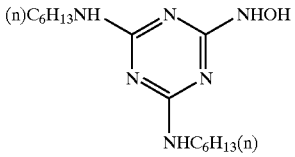
F-11
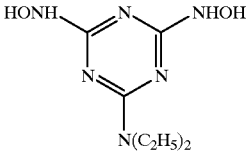
-continued
F-12
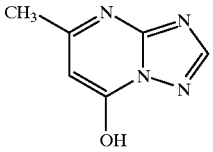
F-13
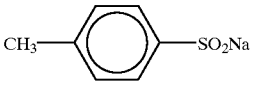
F-14
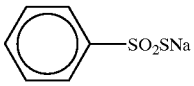
F-15
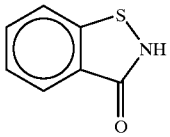
F-16
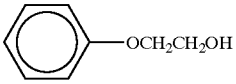
F-17
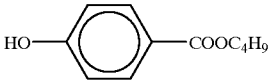
W-1
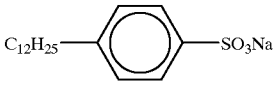
W-2
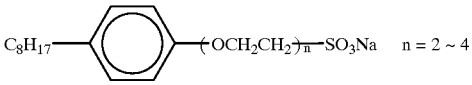
W-3
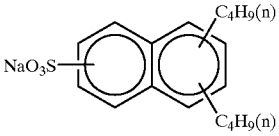
W-4
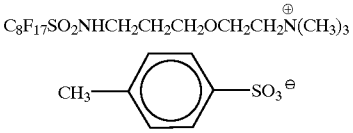

-continued
W-5
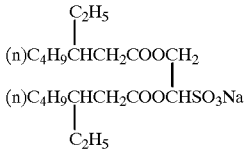
W-6
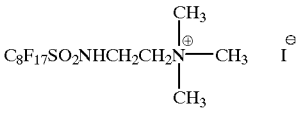
Cpd-6
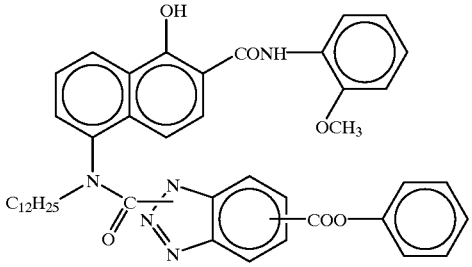
ExF-1
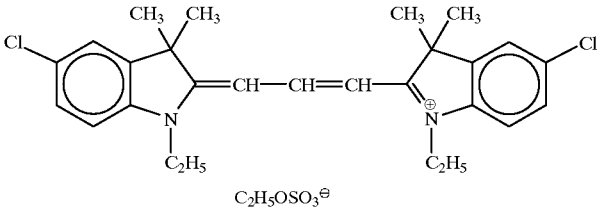
ExF-2
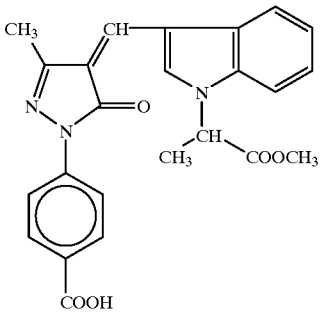
ExF-5
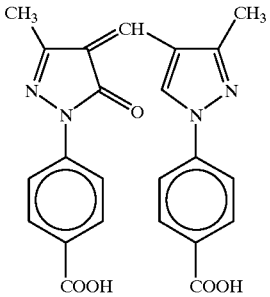
ExF-4
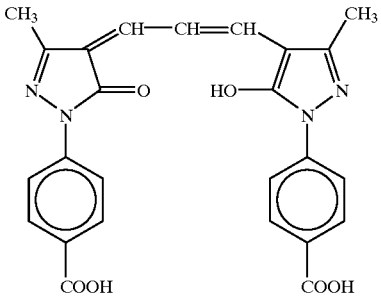

-continued

ExF-7

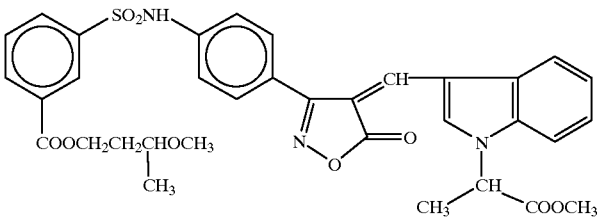

ExF-9

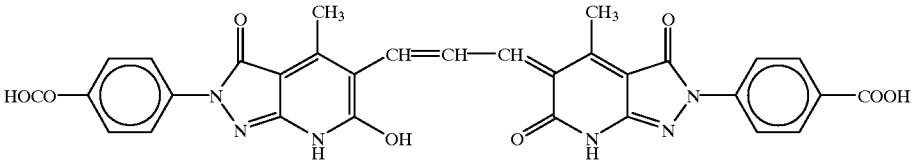

The thus prepared silver halide color photographic light-sensitive material is referred to as sample 1.

Sample 2 was prepared in the same manner, except that the emulsions Em-A, Em-E and Em-L were replaced with the emulsions Em-P, Em-Q and Em-R, respectively, and that the silver quantities were reduced to 48% of those of the emulsions Em-A, Em-E and Em-L. The samples 1 and 2 were exposed through gelatin filter SC-39 produced by Fuji Photo Film Co., Ltd. and a continuous wedge for 1/100 sec.

The development was carried out by the use of automatic processor FP-360B manufactured by Fuji Photo Film Co., Ltd. under the following conditions. The apparatus was reworked so as to prevent the flow of overflow solution from the bleaching bath toward subsequent baths and to, instead, discharge all the solution into a waste solution tank. This FP-360B is fitted with an evaporation correcting means described in JIII Journal of Technical Disclosure No. 94-4992 (issued by Japan Institute of Invention and Innovation).

The processing steps and compositions of processing solutions are as follows.

(Processing steps)

| Step | Time | Temp. | Qty. of replenisher* | Tank vol. |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

* The replenishment rate is a value per 1.1 m of a 35-mm wide lightsensitive material (equivalent to one 24 Ex. film).

The stabilizer was fed from stabilization (2) to stabilization (1) by counter current, and the fixer was also fed from fixing (2) to fixing (1) by counter current. All the overflow of washing water was introduced into fixing bath (2). The amounts of drag-in of developer into the bleaching step, drag-in of bleaching solution into the fixing step and drag-in of fixer into the washing step were 2.5 mL, 2.0 mL and 2.0 mL, respectively, per 1.1 m of a 35-mm wide lightsensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| (Color developer) | Tank soln. (g) | Replenisher (g) |
|---|---|---|
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)amino]-aniline sulfate | 4.5 | 6.5 |
| Water | q.s. ad | 1.0 L |
| pH | 10.05 | 10.18. |

This pH was adjusted by the use of potassium hydroxide and sulfuric acid.

| (Bleaching soln.) | Tank soln. (g) | Replenisher (g) |
|---|---|---|
| Fe(III) ammonium 1,3-diaminopropanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water | q.s. ad | 1.0 L |
| pH | 4.6 | 4.0. |

This pH was adjusted by the use of aqueous ammonia.

(Fixing (1) tank soln.)

5:95 (by volume) mixture of the above bleaching tank soln. and the following fixing tank soln, pH 6.8.

| (Fixing (2)) | Tank soln. (g) | Replenisher (g) |
|---|---|---|
| Aq. soln. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water | q.s. ad 1.0 L | |
| pH | 7.4 | 7.45. |

This pH was adjusted by the use of aqueous ammonia and acetic acid.

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

(Stabilizer): common to tank solution and replenisher.

| | (g) |
|---|---|
| Sodium p-toluenesulfinate | 0.03 |
| Polyoxyethylene p-monononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1,4-bis(1,2,4-triazol-1-ylmethyl)-piperazine | 0.75 |
| Water | q.s. ad 1.0 L |
| pH | 8.5. |

The thus processed samples were subjected to density measurement.

The photographic speed was measured in the same manner as in Example 1. The results are listed in Table 6.

Example 3

Preparation of Emulsion Em-S According to Invention

Emulsion Em-S was prepared in the same manner as in the preparation of emulsion Em-B of Example 2, except that the sensitizing dye was changed to D-40 and that the addition amount thereof was $7.0\times10^{-4}$ mol per mol of silver. The spectral absorption maximum wavelength was 640 nm and the light absorption intensity was 120.

Preparation of Emulsion Em-T According to Invention

Emulsion Em-T was prepared in the same manner as in the preparation of emulsion Em-F of Example 2, except that the sensitizing dye was changed to D-38 and that the addition amount thereof was $1.0\times10^{-3}$ mol per mol of silver. The spectral absorption maximum wavelength was 555 nm and the light absorption intensity was 113.

Samples were prepared by coating cellulose triacetate film supports each having a subbing layer with the emulsions Em-S and -T having undergone the above chemical sensitization, to which the compounds S-1 and A-1 according to the present invention were added in the same amount as in Example 1, with protective layers superimposed thereon, under the coating conditions specified in Table 4 of Example 2. Values of the absorption spectrum absorbance maximum and absorption integrated intensity ranging from 400 nm to 700 nm were compared with respect to the coating samples coated with the Em-S and -T of the present invention after storage at 60° C. in 30% humidity for 3 days on the basis of those of the coating samples immediately after the coating as a standard of 100. With respect to all the coating samples coated with the Em-S and -T of the present invention, the absorption spectrum absorbance maximum and absorption integrated intensity ranging from 400 nm to 700 nm were 95 or more.

The multilayer coating sample 1 obtained in Example 2 is referred to as sample 101 in Example 3.

Samples 102 to 107 were prepared by changing the emulsion constitution of each of the 4th to 6th layers, 9th to 11th layers and 13th to 14th layers of the multilayer coating sample as specified in Tables 7 to 10.

TABLE 6

| | Sensitivity | | | Granularity | | | Total | |
|---|---|---|---|---|---|---|---|---|
| Sample name | Red-sensitive layer | Green-sensitive layer | Blue-sensitive layer | Red-sensitive layer | Green-sensitive layer | Blue-sensitive layer | silver amount ($g/m^2$) | Remarks |
| Sample 1 | 100 | 100 | 100 | 100 | 100 | 100 | 7.356 | Comparative Example |
| Sample 2 | 101 | 100 | 100 | 98 | 95 | 97 | 5.996 | Present invention |

As apparent from the results of Table 6, the sample 2 including the emulsion of the present invention exhibited approximately the same photographic speed as that of the sample 1, irrespective of the reduction of silver quantity, and was excellent in graininess.

Emulsion coating was performed under the same conditions as specified in Table 4 of Example 2, and the obtained samples were allowed to stand still at 40° C. in a relative humidity of 70% for 14 hr. Thereafter, with respect to red-sensitive emulsions and green-sensitive emulsions, the samples were exposed through gelatin filter SC-50 produced by Fuji Photo Film Co., Ltd. and a continuous wedge for 1/100 sec. With respect to blue-sensitive emulsions, the samples were exposed through gelatin filter SC-39 produced by Fuji Photo Film Co., Ltd. and a continuous wedge for 1/100 sec. The exposed samples were developed by means of negative processor FP-350 manufactured by Fuji Photo Film Co., Ltd. under the same conditions as in Example 2 of the present invention. The photographic speed was expressed by a relative value of inverse number of exposure quantity required for realizing a density of fog+0.2.

TABLE 7

| | Sample 101 (comparative example) | | | Sample 102 (present invention) | | |
|---|---|---|---|---|---|---|
| | Emulsion | Coating silver amount | Sensitivity | Emulsion | Coating silver amount | Sensitivity |
| Red-sensitive layer | | | | | | |
| 4th layer | Em-D | 0.577 | 27 | Em-D | 0.477 | 27 |
| | Em-C | 0.347 | | Em-C | 0.447 | |
| 5th layer | Em-B | 0.431 | 51 | Em-B | 0.203 | 71 |
| | Em-C | 0.432 | | Em-C | 0.66 | |
| 6th layer | Em-A | 1.108 | 100 | Em-P | 0.721 | 101 |
| Green-sensitive layer | | | | | | |
| 9th layer | Em-G | 0.333 | 28 | Em-G | 0.333 | 28 |
| | Em-H | 0.329 | | Em-H | 0.329 | |
| | Em-I | 0.088 | | Em-I | 0.088 | |
| 10th layer | Em-F | 0.457 | 49 | Em-F | 0.457 | 49 |
| 11th layer | Em-E | 0.794 | 100 | Em-E | 0.794 | 100 |
| Blue-sensitive layer | | | | | | |
| 13th layer | Em-M | 0.32 | 42 | Em-M | 0.32 | 42 |
| | Em-N | 0.24 | | Em-N | 0.24 | |
| | Em-O | 0.112 | | Em-O | 0.112 | |
| 14th layer | Em-L | 0.714 | 100 | Em-L | 0.714 | 100 |

TABLE 8

| | Sample 103 (present invention) | | | Sample 104 (present invention) | | |
|---|---|---|---|---|---|---|
| | Emulsion | Coating silver amount | Sensitivity | Emulsion | Coating silver amount | Sensitivity |
| Red-sensitive layer | | | | | | |
| 4th layer | Em-D | 0.577 | 27 | Em-D | 0.577 | 27 |
| | Em-C | 0.347 | | Em-C | 0.347 | |
| 5th layer | Em-B | 0.431 | 51 | Em-B | 0.431 | 51 |
| | Em-C | 0.432 | | Em-C | 0.432 | |
| 6th layer | Em-A | 1.108 | 100 | Em-A | 1.108 | 100 |
| Green-sensitive layer | | | | | | |
| 9th layer | Em-G | 0.383 | 40 | Em-G | 0.333 | 28 |
| | Em-H | 0.279 | | Em-H | 0.329 | |
| | Em-I | 0.088 | | Em-I | 0.088 | |
| 10th layer | Em-F | 0.307 | 75 | Em-F | 0.457 | 49 |
| | Em-Q | 0.15 | | | | |
| 11th layer | Em-Q | 0.532 | 100 | Em-E | 0.794 | 100 |
| Blue-sensitive layer | | | | | | |
| 13th layer | Em-M | 0.32 | 42 | Em-M | 0.38 | 61 |
| | Em-N | 0.24 | | Em-N | 0.18 | |
| | Em-O | 0.112 | | Em-O | 0.112 | |
| 14th layer | Em-L | 0.714 | 100 | Em-R | 0.488 | 101 |

TABLE 9

| | Sample 105 (present invention) | | | Sample 106 (present invention) | | |
|---|---|---|---|---|---|---|
| | Emulsion | Coating silver amount | Sensitivity | Emulsion | Coating silver amount | Sensitivity |
| Red-sensitive layer | | | | | | |
| 4th layer | Em-C | 0.689 | 43 | Em-D | 0.577 | 27 |
| | | | | Em-C | 0.347 | |
| 5th layer | Em-S | 0.705 | 65 | Em-B | 0.431 | 51 |
| | | | | Em-C | 0.432 | |
| 6th layer | Em-P | 0.721 | 101 | Em-A | 1.108 | 100 |
| Green-sensitive layer | | | | | | |
| 9th layer | Em-G | 0.333 | 28 | Em-G | 0.44 | 47 |
| | Em-H | 0.329 | | Em-H | 0.22 | |
| | Em-I | 0.088 | | | | |
| 10th layer | Em-F | 0.457 | 49 | Em-T | 0.25 | 69 |
| | | | | Em-Q | 0.15 | |
| 11th layer | Em-E | 0.794 | 100 | Em-Q | 0.532 | 100 |
| Blue-sensitive layer | | | | | | |
| 13th layer | Em-M | 0.32 | 42 | Em-M | 0.932 | 42 |
| | Em-N | 0.24 | | Em-N | 0.24 | |
| | Em-O | 0.112 | | Em-O | 0.112 | |
| 14th layer | Em-L | 0.714 | 100 | Em-L | 0.714 | 100 |

TABLE 10

| | Sample 107 (present invention) | | |
|---|---|---|---|
| | Emulsion | Coating silver amount | Sensitivity |
| Red-sensitive layer | | | |
| 4th layer | Em-C | 0.689 | 43 |
| 5th layer | Em-S | 0.705 | 65 |
| 6th layer | Em-P | 0.721 | 101 |
| Green-sensitive layer | | | |
| 9th layer | Em-G | 0.44 | 47 |
| | Em-H | 0.22 | |
| 10th layer | Em-T | 0.25 | 69 |
| | Em-Q | 0.15 | |
| 11th layer | Em-Q | 0.532 | 100 |

TABLE 10-continued

| | Sample 107 (present invention) | | |
|---|---|---|---|
| | Emulsion | Coating silver amount | Sensitivity |
| Blue-sensitive layer | | | |
| 13th layer | Em-M | 0.38 | 61 |
| | Em-N | 0.18 | |
| | Em-O | 0.112 | |
| 14th layer | Em-R | 0.488 | 101 |

Samples 101 to 107 were exposed through gelatin filter SC-39 produced by Fuji Photo Film Co., Ltd. and a continuous wedge for 1/100 sec. The exposed samples were developed by means of negative processor FP-360B manufactured by Fuji Photo Film Co., Ltd. under the same conditions as in Example 2 of the present invention.

The photographic speed and RMS granularity were measured in the same manner as in Example 2 of the present invention. In Example 3, relative values providing that the value of sample 101 as reference lightsensitive material is 100 are indicated.

TABLE 11

| | Sensitivity | | | Granularity | | | |
|---|---|---|---|---|---|---|---|
| Sample | Red-sensitive layer | Green-sensitive layer | Blue-sensitive layer | Red-sensitive layer | Green-sensitive layer | Blue-sensitive layer | Remarks |
| Sample 101 | 100 | 100 | 100 | 100 | 100 | 100 | Comparative Example |
| Sample 102 | 102 | 100 | 100 | 97 | 100 | 100 | Present invention |
| Sample 103 | 100 | 101 | 100 | 100 | 94 | 100 | Present invention |

TABLE 11-continued

| Sample | Sensitivity | | | Granularity | | | Remarks |
|---|---|---|---|---|---|---|---|
| | Red-sensitive layer | Green-sensitive layer | Blue-sensitive layer | Red-sensitive layer | Green-sensitive layer | Blue-sensitive layer | |
| Sample 104 | 100 | 100 | 102 | 100 | 100 | 95 | Present invention |
| Sample 105 | 104 | 100 | 100 | 95 | 100 | 100 | Present invention |
| Sample 106 | 100 | 103 | 100 | 100 | 92 | 100 | Present invention |
| Sample 107 | 103 | 104 | 102 | 95 | 93 | 95 | Present invention |

It is apparent from Table 11 that samples wherein the emulsion of dye multilayer structure according to the present invention is employed in a high-speed-side emulsion and wherein the low-speed-side emulsion adjacent to the high-speed-side emulsion exhibits a speed of 60% or more based on that of the high-speed-side emulsion are excellent from the viewpoint of photographic speed and graininess. In particular, it is apparent that the green-sensitive layer of sample 103 and red-sensitive layer of sample 102 wherein the emulsion speed of medium-speed sensitive layer is 60% or more based on that of maximum-speed sensitive layer are preferable from the viewpoint of photographic speed and graininess. Also, it is apparent that the blue-sensitive layer of sample 107 and blue-sensitive layer of sample 104 wherein the low-speed-side emulsion exhibits a speed of 60% or more based on that of the high-speed-side emulsion are preferable. Further, it is apparent that the green-sensitive layer of sample 107, green-sensitive layer of sample 106, red-sensitive layer of sample 107 and red-sensitive layer of sample 105 wherein the emulsion speed of medium-speed sensitive layer is 60% or more based on that of maximum-speed sensitive layer and wherein the emulsion speed of low-speed sensitive layer is 60% or more based on that of medium-speed sensitive layer are preferable.

Example 4

The samples 1 and 2 of Example 2 immediately after the preparation thereof and after storage at room temperature for one year at Fuji Photo Film Co., Ltd. Ashigara Laboratory, MinamiAshigara City, Kanagawa Prefecture were subjected to the same exposure and development as described hereinbefore with respect to the method of measuring the specified photographic speed, and the photographic properties thereof were measured. With respect to the graininess, the samples were subjected to 0.005 lux·second exposure and to the same processing as described hereinbefore with respect to the method of measuring the specified photographic speed, and the graininess thereof was measured by the common RMS (Root Mean Square) method using an aperture of 48 $\mu$m diameter.

TABLE 12

| | Sample 1 (comparative example) | Sample 2 (present invention) |
|---|---|---|
| Immediately after preparation | | |
| Specified photographic sensitivity (S) | 804 | 805 |
| RMS granularity blue | 100 | 100 |
| RMS granularity green | 100 | 100 |
| RMS granularity red | 100 | 100 |
| After one year storage | | |
| Specified photographic sensitivity (S) | 776 | 802 |
| RMS granularity blue | 120 | 104 |
| RMS granularity green | 110 | 104 |
| RMS granularity red | 112 | 102 |

It is apparent from Table 12 that the deterioration with the passage of time of the sample 2 whose coating silver quantity was less than 6.0 g/m$^2$ (5.996 g/m$^2$) is less than that of the sample 1 whose coating silver quantity exceeded 7.0 g/m$^2$ (7.356 g/m$^2$). With respect to the performance after one-year storage whose frequency is high in the practical use by general consumers, the sample 2 of the present invention exhibits excellent graininess and realizes image quality superior to that of the comparative example sample.

Example 5

In the color development of samples 101 to 107 of Example 3, the temperature of color developer was changed to 36.8° C. and 38.8° C. With respect to each of the samples, the densities were measured through red, green and blue filters, and the changes ($\Delta S_{0.1}$, $\Delta S_{0.5}$) of photographic speed (inverse number of exposure quantity required for realizing a density of fog density+0.1 and a density of fog density+0.5) were determined, thereby investigating the dependency of samples on processing temperature. The results are listed in Table 13. Relative values providing that the speed change $\Delta S_{0.1}$ of each of red sensitivity, green sensitivity and blue sensitivity with respect to sample 101 is 100 are listed in Table 13. The smaller than 100 the indicated number, the smaller the dependency on processing temperature.

TABLE 13

| Sample | Red-sensitive speed variation | | Green-sensitive speed variation | | Blue-sensitive speed variation | | Remarks |
|---|---|---|---|---|---|---|---|
| | ΔS 0.1 | ΔS 0.5 | ΔS 0.1 | ΔS 0.5 | ΔS 0.1 | ΔS 0.5 | |
| Sample 101 | 100 | 140 | 100 | 145 | 100 | 160 | Comparative example |
| Sample 102 | 94 | 123 | 100 | 145 | 100 | 160 | Present invention |
| Sample 103 | 100 | 140 | 89 | 108 | 100 | 160 | Present invention |
| Sample 104 | 100 | 140 | 100 | 145 | 95 | 123 | Present invention |
| Sample 105 | 90 | 116 | 100 | 145 | 100 | 160 | Present invention |
| Sample 106 | 100 | 140 | 86 | 106 | 100 | 160 | Present invention |
| Sample 107 | 86 | 112 | 84 | 104 | 94 | 122 | Present invention |

It is apparent from Table 13 that samples wherein the emulsion of dye multilayer structure according to the present invention is employed in a high-speed-side emulsion and wherein the low-speed-side emulsion adjacent to the high-speed-side emulsion exhibits a speed of 60% or more based on that of the high-speed-side emulsion are excellent from the viewpoint that the speed variation by the variation of processing temperature is slight to thereby attest to less dependency on processing temperature. In particular, it is apparent that the green-sensitive layer of sample 103 and red-sensitive layer of sample 102 wherein the emulsion speed of medium-speed sensitive layer is 60% or more based on that of maximum-speed sensitive layer are preferable from the viewpoint of less processing variation. Also, it is apparent that the blue-sensitive layer of sample 107 and blue-sensitive layer of sample 104 wherein the low-speed-side emulsion exhibits a speed of 60% or more based on that of the high-speed-side emulsion are preferable. Further, it is apparent that the green-sensitive layer of sample 107, green-sensitive layer of sample 106, red-sensitive layer of sample 107 and red-sensitive layer of sample 105 wherein the emulsion speed of medium-speed sensitive layer is 60% or more based on that of maximum-speed sensitive layer and wherein the emulsion speed of low-speed sensitive layer is 60% or more based on that of medium-speed sensitive layer are preferable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic lightsensitive material comprising at least one silver halide photographic emulsion layer containing a silver halide photographic emulsion prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion, when agitated at 40° C. for 30 min, exhibits a variation of absorption spectrum integrated intensity ranging from 400 nm to 700 nm of 10% or less.

2. A silver halide photographic lightsensitive material comprising at least one silver halide photographic emulsion layer prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion layer, when the silver halide photographic lightsensitive material is aged at 60° C. in 30% humidity for 3 days, exhibits a variation of absorption spectrum integrated intensity ranging from 400 nm to 700 nm of 10% or less.

3. The silver halide photographic lightsensitive material of claim 1 comprising, on one side of a support, photographic constituting element layers composed of a unit redsensitive layer, a unit green-sensitive layer, a unit blue-sensitive layer and a nonlightsensitive layer, wherein each of the unit red-sensitive layer, unit green-sensitive layer and unit blue-sensitive layer comprises two or more layers differing in speed, and wherein, in at least one of the unit red-sensitive layer, unit green-sensitive layer and unit blue-sensitive layer, at least one high-speed-side emulsion layer contains a silver halide photographic emulsion, prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion, when agitated at 40° C. for 30 mm, exhibits a variation of absorption spectrum integrated intensity ranging from 400 nm to 700 nm of 10% or less, and said material further comprising on one side of the support adjacent to the high speed-side emulsion layer, a low-speed-side emulsion layer, which exhibits a speed of 60% or more based on that of the high-speed-side emulsion layer.

4. The silver halide photographic lightsensitive material of claim 2 comprising, on one side of a support, photographic constituting element layers composed of a unit red-sensitive layer, a unit green-sensitive layer, a unit blue-sensitive layer and a nonlightsensitive layer, wherein each of the unit red-sensitive layer, unit green-sensitive layer and unit blue-sensitive layer comprises two or more layers differing in speed, and wherein, in at least one of the unit red-sensitive layer, unit green-sensitive layer and unit blue-sensitive layer, at least one high-speed-side emulsion layer contains a silver halide photographic emulsion, prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion layer, when the silver halide photographic lightsensitive material is aged at 60° C. in 30% humidity for 3 days, exhibits a variation of absorption spectrum integrated intensity ranging from 400 nm to 700 nm of 10% or less, and said material further comprising on one side of the support adjacent to the high speed-side emulsion layer a low-speed-side emulsion layer, which exhibits a speed of 60% or more based on that of the high-speed-side emulsion layer.

5. The silver halide photographic light-sensitive material of claim 1 comprising, on one side of a support, photographic constituting element layers composed of a unit red-sensitive layer, a unit green-sensitive layer, a unit blue-sensitive layer and a nonlightsensitive layer, wherein at least one of the photographic constituting element layers contains the silver halide photographic emulsion, prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion, when agitated at 40° C. for 30 mm, exhibits a variation of absorption spectrum integrated intensity ranging from 400 nm to 700 nm of 10% or less, and whose total silver content is in the range of 0.1 to 7.0 g/m$^2$.

6. The silver halide photographic light-sensitive material of claim 2 comprising, on one side of a support, photographic constituting element layers composed of a unit red-sensitive layer, a unit green-sensitive layer, a unit blue-sensitive layer and a nonlightsensitive layer, wherein at least one of the photographic constituting element layers contains the silver halide photographic emulsion, prepared by mixing a dispersion of silver halide grains, the silver halide grains exhibiting such spectral absorption maximum wavelength and light absorption intensity that, when the spectral absorption maximum wavelength is less than 500 nm, the light absorption intensity is 60 or more, while when the spectral absorption maximum wavelength is 500 nm or more, the light absorption intensity is 100 or more, with an emulsified dispersion, wherein the silver halide photographic emulsion layer, when the silver halide photographic lightsensitive material is aged at 60° C. in 30% humidity for 3 days, exhibits a variation of absorption spectrum integrated intensity ranging from 400 nm to 700 nm of 10% or less, and. whose total silver content is in the range of 0.1 to 7.0 g/m$^2$.

7. The silver halide photographic lightsensitive material according to claim 1, wherein the emulsified dispersion contains a surfactant whose critical micell concentration is $4.0\times10^{-3}$ mol/L or less, the surfactant content being 0.01% by mass or more based on the silver halide photographic emulsion layer.

8. The silver halide photographic lightsensitive material according to claim 2, wherein the emulsified dispersion contains a surfactant whose critical micell concentration is $4.0\times10^{-3}$ mol/L or less, the surfactant content being 0.01% by mass or more based on the silver halide photographic emulsion layer.

9. The silver halide photographic lightsensitive material according to claim 3, wherein the emulsified dispersion contains a surfactant whose critical micell concentration is $4.0\times10^{-3}$ mol/L or less, the surfactant content being 0.01% by mass or more based on the silver halide photographic emulsion layer.

10. The silver halide photographic lightsensitive material according to claim 4, wherein the emulsified dispersion contains a surfactant whose critical micell concentration is $4.0\times10^{-3}$ mol/L or less, the surfactant content being 0.01% by mass or more based on the silver halide photographic emulsion layer.

11. The silver halide photographic lightsensitive material according to claim 5, wherein the emulsified dispersion contains a surfactant whose critical micell concentration is $4.0\times10^{-3}$ mol/L or less, the surfactant content being 0.01% by mass or more based on the silver halide photographic emulsion layer.

12. The silver halide photographic lightsensitive material according to claim 6, wherein the emulsified dispersion contains a surfactant whose critical micell concentration is $4.0\times10^{-3}$ mol/L or less, the surfactant content being 0.01% by mass or more based on the silver halide photographic emulsion layer.

13. The silver halide photographic lightsensitive material according to claim 1, wherein the emulsified dispersion contains a high-boiling organic solvent whose dielectric constant is 7.0 or less, the content of the high-boiling organic solvent being in the range of 0.05 to 10% by mass based on the silver halide photographic emulsion layer.

14. The silver halide photographic lightsensitive material according to claim 2, wherein the emulsified dispersion contains a high-boiling organic solvent whose dielectric constant is 7.0 or less, the content of the high-boiling organic solvent being in the range of 0.05 to 10% by mass based on the silver halide photographic emulsion layer.

15. The silver halide photographic lightsensitive material according to claim 3, wherein the emulsified dispersion contains a high-boiling organic solvent whose dielectric constant is 7.0 or less, the content of the high-boiling organic solvent being in the range of 0.05 to 10% by mass based on the silver halide photographic emulsion layer.

16. The silver halide photographic lightsensitive material according to claim 4, wherein the emulsified dispersion contains a high-boiling organic solvent whose dielectric constant is 7.0 or less, the content of the high-boiling organic solvent being in the range of 0.05 to 10% by mass based on the silver halide photographic emulsion layer.

17. The silver halide photographic lightsensitive material according to claim 5, wherein the emulsified dispersion contains a high-boiling organic solvent whose dielectric constant is 7.0 or less, the content of the high-boiling organic solvent being in the range of 0.05 to 10% by mass based on the silver halide photographic emulsion layer.

18. The silver halide photographic lightsensitive material according to claim 6, wherein the emulsified dispersion contains a high-boiling organic solvent whose dielectric constant is 7.0 or less, the content of the high-boiling organic solvent being in the range of 0.05 to 10% by mass based on the silver halide photographic emulsion layer.

19. The silver halide photographic lightsensitive material according to claim 1, wherein the emulsified dispersion contains a compound of the formula 1:

1

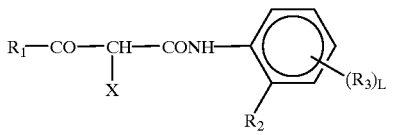

where $R_1$ represents a tertiary alkyl group or an aryl group; $R_2$ represents a hydrogen atom, a halogen atom (F, Cl, Br or I), an alkoxy group, an aryloxy group, an alkyl group or a dialkylamino group; $R_3$ represents a group capable of effecting a substitution on a benzene ring; X represents a hydrogen atom or a heterocycle capable of being eliminated by a coupling reaction with an oxidation product of aromatic primary amine developing agent and capable of bonding at a nitrogen atom with a coupling active site; and L is an integer of 0 to 4, provided that, when L is two or more, two or more $R_3$ groups may be identical with or different from each other.

20. The silver halide photographic lightsensitive material according to claim 2, wherein the emulsified dispersion contains a compound of the formula 1:

1

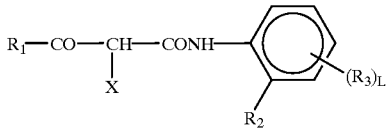

where $R_1$ represents a tertiary alkyl group or an aryl group; $R_2$ represents a hydrogen atom, a halogen atom (F, Cl, Br or I), an alkoxy group, an aryloxy group, an alkyl group or a dialkylamino group; $R_3$ represents a group capable of effecting a substitution on a benzene ring; X represents a hydrogen atom or a heterocycle capable of being eliminated by a coupling reaction with an oxidation product of aromatic primary amine developing agent and capable of bonding at a nitrogen atom with a coupling active site; and L is an integer of 0 to 4, provided that, when L is two or more, two or more $R_3$ groups may be identical with or different from each other.

* * * * *